US008484767B2

(12) United States Patent
Nakayama

(10) Patent No.: US 8,484,767 B2
(45) Date of Patent: Jul. 16, 2013

(54) PROTECTIVE CAP

(75) Inventor: Fumiharu Nakayama, Tokyo (JP)

(73) Assignee: Midori Anzen Co., Ltd., Tokyo (JP)

( * ) Notice: Subject to any disclaimer, the term of this patent is extended or adjusted under 35 U.S.C. 154(b) by 3 days.

(21) Appl. No.: 13/144,871

(22) PCT Filed: Jan. 19, 2010

(86) PCT No.: PCT/JP2010/050558

§ 371 (c)(1),
(2), (4) Date: Jul. 15, 2011

(87) PCT Pub. No.: WO2010/082663

PCT Pub. Date: Jul. 22, 2010

(65) Prior Publication Data

US 2011/0271429 A1 Nov. 10, 2011

(30) Foreign Application Priority Data

Jan. 19, 2009 (JP) ..... 2009-008926

(51) Int. Cl.
*A62B 1/24* (2006.01)

(52) U.S. Cl.
USPC ..... 2/424

(58) Field of Classification Search
USPC ..... 2/410, 424, 425, 9, 10, 15
See application file for complete search history.

(56) References Cited

U.S. PATENT DOCUMENTS

| | | | | |
|---|---|---|---|---|
| 3,601,813 | A * | 8/1971 | Aileo | 2/410 |
| 4,667,348 | A * | 5/1987 | Sundahl | 2/410 |
| 4,887,320 | A * | 12/1989 | Long et al. | 2/424 |

FOREIGN PATENT DOCUMENTS

| | | | |
|---|---|---|---|
| JP | S48-24844 | A | 3/1973 |
| JP | H06-17303 | A | 1/1994 |
| JP | H10-168635 | A | 6/1998 |
| JP | H10-298818 | A | 11/1998 |
| JP | 3154753 | B2 | 2/2001 |
| JP | 2003-49316 | A | 2/2003 |
| JP | 2003-82518 | A | 3/2003 |
| JP | 2003-253519 | A | 9/2003 |

OTHER PUBLICATIONS

International Search Reports in the corresponding International Patent Application No. PCT/JP2010/050558, PCT Forms of PCT/ISA/210 and 237.

Office Action issued Jul. 10, 2012 in a counterpart Japanese Application No. 2010-546675.

Office Action issued Nov. 7, 2012 in a counterpart Korean Application No. 10-2011-7018781.

Office Action issued Nov. 27, 2012 in a counterpart Japanese Application No. 2010-546675.

Office Action issued May 14, 2013 in a counterpart Japanese Application No. 2010-546675.

* cited by examiner

*Primary Examiner* — Tejash Patel

(74) *Attorney, Agent, or Firm* — Novak Druce Connolly Bove + Quigg LLP

(57) ABSTRACT

In a protective cap housing a shield member for covering almost all of a face of a wearer in the interior of a cap body, the protective cap capable of retracting the shield member in the interior of the cap body is provided. It is a protective cap 1 having a cap body 3 formed in a semi-spherical-shell-like form for protecting a head of a wearer, a shield member 5 for protecting almost all of a face of the wearer, and guide means 7 for guiding the shield member 5 to move along a curved surface of the cap body 3 between a housing position P1 to be housed in the cap body 3 and a shielding position P3 for covering almost all of the face of the wearer.

11 Claims, 39 Drawing Sheets

PROTECTIVE CAP

TECHNICAL FIELD

The present invention relates to a protective cap and in particular relates to that provided with a shield plate for covering a face of a wearer.

BACKGROUND ART

There is so far known a protective cap (helmet) with a shield (shield plate) for protecting eyes (an upper half of a face) of a worker as a measure against accidents in which nails bounce back out of nailers to stick in worker's eyes or any others occur. As a method for attaching a shield plate, there are a method in which it is attached to the exterior of a cap body of a protective cap, and another method in which it is attached to the interior of a cap body of a protective cap in such a way that it is allowed to be housed therein. As he or she is likely to fail to attach the shield plate to his or her cap or the shield plate will interfere in work in accordance with the exterior attachment method, the interior attachment method in which the shield plate can be housed in the interior of the cap body when not in use is preferred.

As interior attachment methods, protective caps as described in PTL 1 and PTL 2 can be exemplified for instance.

In the protective cap as described in PTL 1, a face protection plate assembly composed of a support plate, in which three guiding slots are formed and a face protection plate (shield plate) provided on the guiding slots via engagement members to allow it to go up and down, is arranged in between a shock absorber liner and a hammock, lowermost end portions of the guiding slots are so disposed as to place these centers near the exterior below, and a configuration to allow selection from three positions of the face protection plate is applied thereto.

The protection cap as described in PTL 2 has a configuration in which a front shield plate installed in linear guiding slots and left and right side shield plates one end of which is swingably combined with the front shield plate and another end of which is installed in curved guiding holes are provided, and, when the front shield plate is drawn out downward, the side shield plates are coordinately drawn out obliquely downward.

CITATION LIST

Patent Literature

PTL 1: Japanese Unexamined Patent Publication No. 2003-049316

PTL 2: Japanese Unexamined Patent Publication No. 2003-253519

SUMMARY OF INVENTION

Problem to be Solved

In any the aforementioned protective caps with shield plates of the prior art, a shield plate is configured to cover the upper portion (portions of eyes) and sides of a face of a wearer but the lower half of the face of the wearer is exposed and is therefore not protected.

By the way, at a time of maintenance of electric equipments, there are some cases with small probability where sparks are generated from the electric equipments and thus it is required to protect the whole of a face of a wearer by covering it with a shield plate.

However, as the protective cap of the interior attachment method of the prior art has a configuration in which the sliding plate linearly moves to go in and out of the cap body, the dimensions in length of the cap body limits the dimensions in length of the shield plate and therefore a shield plate with enough length to cover the whole of the face of the wearer cannot be used. More specifically, if a shield plate with enough length to cover the whole of the face of the wearer was used in the protective cap of the interior attachment method of the prior art, the sliding plate would not be thoroughly housed in the cap body and therefore a lower portion of the sliding plate would protrude out of the cap body downward to a considerable extent, thereby interfering with the wearer.

The present invention has been achieved in view of the aforementioned problem and is intended to provide a protective cap which houses a shield member for covering almost all of a face of a wearer into the interior of a cap body in that the shield member is housed in the interior of the cap body so as to avoid interference with the wearer.

A protective cap based on a first aspect of the present invention is a protective cap having a cap body formed in a semi-spherical-shell-like form for protecting a head of a wearer, a shield member comprised of a transparent material or a translucent material for protecting almost all of a face of the wearer and guide means for guiding the shield member to move along a curved surface of the cap body between a housing position where the shield member is housed in the cap body, and a shielding position where the shield member covers almost all of the face of the wearer.

A protective cap based on a second aspect of the present invention is a protective cap having a cap body formed in a bowl form, a guide member comprising an arc-like guide portion, the guide member being so formed in the cap body and integrally with the cap body as to have the guide portion fitting along an internal surface at a front side of the cap body, and a shield plate comprised of a transparent material or a translucent material and formed in a plate-like form having a curved surface along the internal surface at the front side of the cap body, the shield plate comprising an engagement portion for engaging with the arc-like guide portion, wherein the engagement portion engages with the guide portion so that the shield plate moves along a curved surface of the cap body between a housing position where the shield member is housed in the cap body and a shielding position where the shield member covers almost all of the face of the wearer.

A protective cap based on a third aspect of the present invention is a protective cap in that, in the protective cap based on the second aspect, the guide member is constituted to comprise a central portion comprising a curved surface along the internal surface at the front side of the cap body to be formed in a plate form, a first side portion provided at one end side in a lateral direction of the central portion and integral with the central portion, a second side portion provided at another end side in the lateral direction of the central portion and integral with the central portion, the guide portion is formed at a portion of a proximal end side of the first side portion and at a portion of a proximal end side of the second side portion, the first side portion and the second side portion engage with the cap body, and the guide portion is provided integral with the cap body and the shield plate is so constituted as to enter into a space formed among the cap body, the central portion of the guide member and the portion of the proximal end side to be housed in the cap body.

A protective cap based on a fourth aspect of the present invention is a protective cap in that, in the protective cap based on the third aspect, the portion of the proximal end side of the first side portion is constituted to comprise a plate-like rising portion rising from a tip end side portion of the first side portion and a plate-like connection portion connecting the rising portion with the central portion, and the guide portion is constituted of an arc-like curved surface in a thickness direction of the rising portion and an arc-like elongated hole formed on the connection portion, the portion of the proximal end side of the second side portion is constituted to comprise a plate-like rising portion rising from a tip end side portion of the second side portion and a plate-like connection portion connecting the rising portion with the central portion, and the guide portion is constituted of an arc-like curved surface in a thickness direction of the rising portion and an arc-like elongated hole formed on the connection portion, and the engagement portion of the shield plate is constituted to comprise an arc-like end surface at one side in a lateral direction of the shield plate engaging with one of a curved surface in a thickness direction of the rising portion of the first side portion, an arc-like end surface at another side in the lateral direction of the shield plate engaging with one of the curved surface in the thickness direction of the rising portion of the second side portion, one engagement piece engaging with the elongated hole of the connection portion of the first side portion, and another engagement piece engaging with the elongated hole of the connection portion of the second side portion.

A protective cap based on a fifth aspect of the present invention is a protective cap having a cap body formed in a bowl form, a guide member comprising an arc-like guide portion, the guide member being so formed in the cap body and integrally with the cap body that a center of the guide portion corresponds with an axis extending in left and right directions at the rear of ears of the wearer of the cap body through a portion, and a shield plate formed in a plate form of a transparent material or a translucent material, the shield plate comprising an engagement portion for engaging with the arc-like guide portion, wherein the engagement portion engages with the guide portion so that the shield plate moves about a center of the guide portion between a housing position where the shield member is housed in the cap body and a shielding position where the shield member covers almost all of the face of the wearer.

A protective cap based on a sixth aspect of the present invention is a protective cap in that, in the protective cap based on the fifth aspect, the guide member is constituted to comprise a central portion comprising a spherical curved surface to be formed in a plate form, a first side portion provided at one end side in a lateral direction of the central portion and integral with the central portion, a second side portion provided at another end side in the lateral direction of the central portion and integral with the central portion, the guide portion is formed at a portion of a proximal end side of the first side portion and at a portion of a proximal end side of the second side portion, the first side portion and the second side portion engage with the cap body, and the guide portion is provided integral with the cap body, and the shield plate is so constituted as to enter into a space formed among the cap body, the central portion of the guide member and the portion of the proximal end side to be housed in the cap body.

A protective cap based on a seventh aspect of the present invention is a protective cap in that, in the protective cap based on the sixth aspect, the portion of the proximal end side of the first side portion is constituted to comprise a plate-like rising portion rising from a tip end side portion of the first side portion and a plate-like connection portion connecting the rising portion with the central portion, the portion of the proximal end side of the second side portion is constituted to comprise a plate-like rising portion rising from a tip end side portion of the second side portion and a plate-like connection portion connecting the rising portion with the central portion, and the engagement portion of the shield plate is constituted to comprise one engagement piece engaging with the elongated hole of the connection portion of the first side portion, another engagement piece engaging with the elongated hole of the connection portion of the second side portion, and a projection for engaging with a central area of the central portion.

A protective cap based on a eighth aspect of the present invention is a protective cap in that, in the protective cap based on the fifth aspect, the guide member is constituted to comprise a central portion comprising a spherical curved surface, and the guide portion is formed at the central portion.

A protective cap based on a ninth aspect of the present invention is a protective cap in that, in the protective cap based on the eighth aspect, the guide member is constituted to comprise the central portion, a first side portion provided at one end side in a lateral direction of the central portion, and a second side portion provided at another end side in the lateral direction of the central portion, a pair of central portion engaging portions formed in the vicinity of the respective side portions on the central portion engages with a pair of central portion to-be-engaged portion provided at sides of the cap body, a first side portion engaging portion provided at the first side portion engages with a first side portion to-be-engaged portion provided at a rear side of the cap body, a second side portion engaging portion provided at the second side portion engages with a second side portion to-be-engaged portion provided at a rear side of the cap body, and the guide member is provided integrally with the cap body, and the shield plate is so constituted as to enter into a space formed between the cap body and the central portion of the guide member to be housed in the cap body.

A protective cap based on a tenth aspect of the present invention is a protective cap in that, in the protective cap based on the eighth or ninth aspect, a guide portion of the guide member is constituted of three oval through holes, an engaging portion of the shield plate is constitute of three cylindrical portions and the cylindrical portions respectively engage with the three through holes constituting the guide portion of the guide member to guide the shield plate to move between the housing position and the shielding position.

A protective cap based on a tenth aspect of the present invention is a protective cap in that, in the protective cap based on any aspect of the first through tenth aspect, a guide portion of the guide member is constituted of three oval through holes, an engaging portion of the shield plate is constitute of three cylindrical portions, and the cylindrical portions respectively engage with the three through holes constituting the guide portion of the guide member to guide the shield plate to move between the housing position and the shielding position.

A protective cap based on a twelfth aspect of the present invention is a protective cap in that, in the protective cap based on the eleventh aspect, a concave portion dented toward an inner side of the main body portion with a predetermined width is formed at a central portion of the visor portion in a lateral direction.

Effects of the Invention

According to the present invention, in a protective cap which houses a shield member for covering almost all of a face of a wearer into the interior of a cap body, it is provided an effect in that the shield member is housed in the interior of the cap body so as to avoid interference with the wearer.

DESCRIPTION OF EMBODIMENTS

First Embodiment

Figure 1:
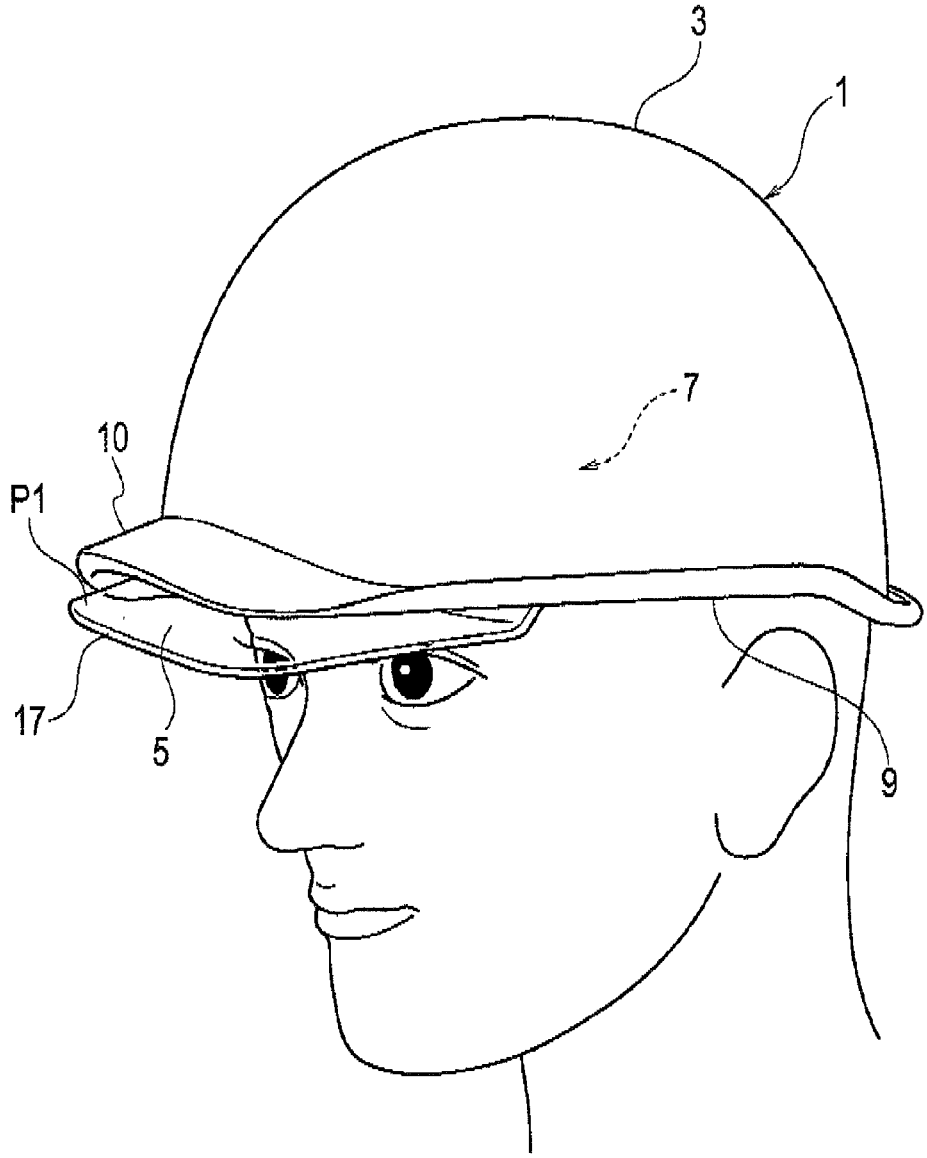
FIG. 1 is an elevational perspective view of a protective cap 1 in accordance with an embodiment of the present invention when a wearer wears the cap.
Figure 2:
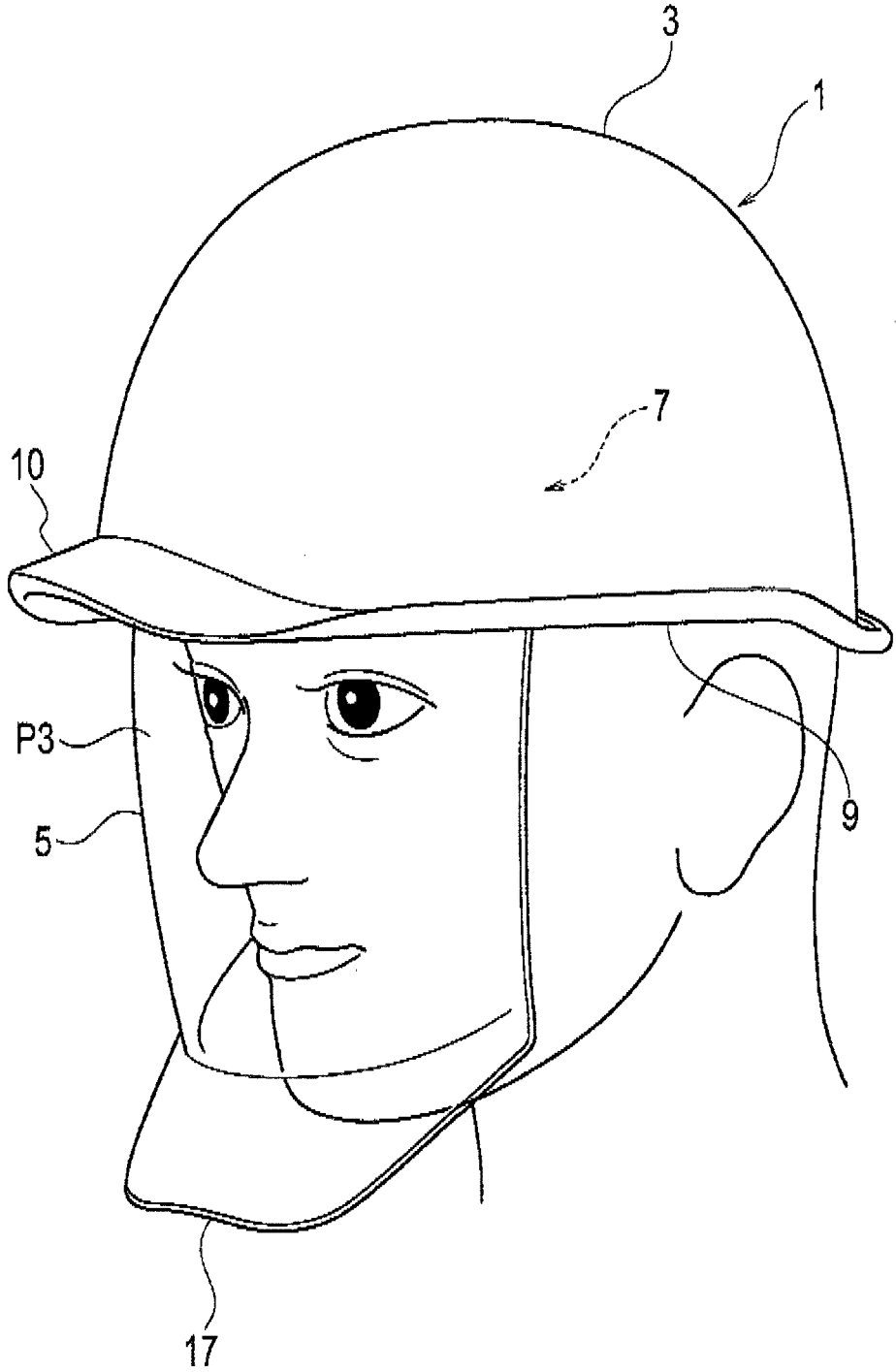
FIG. 2 is an elevational perspective view of the protective cap 1 in accordance with the embodiment of the present invention when the wearer wears the cap.
Figure 3:
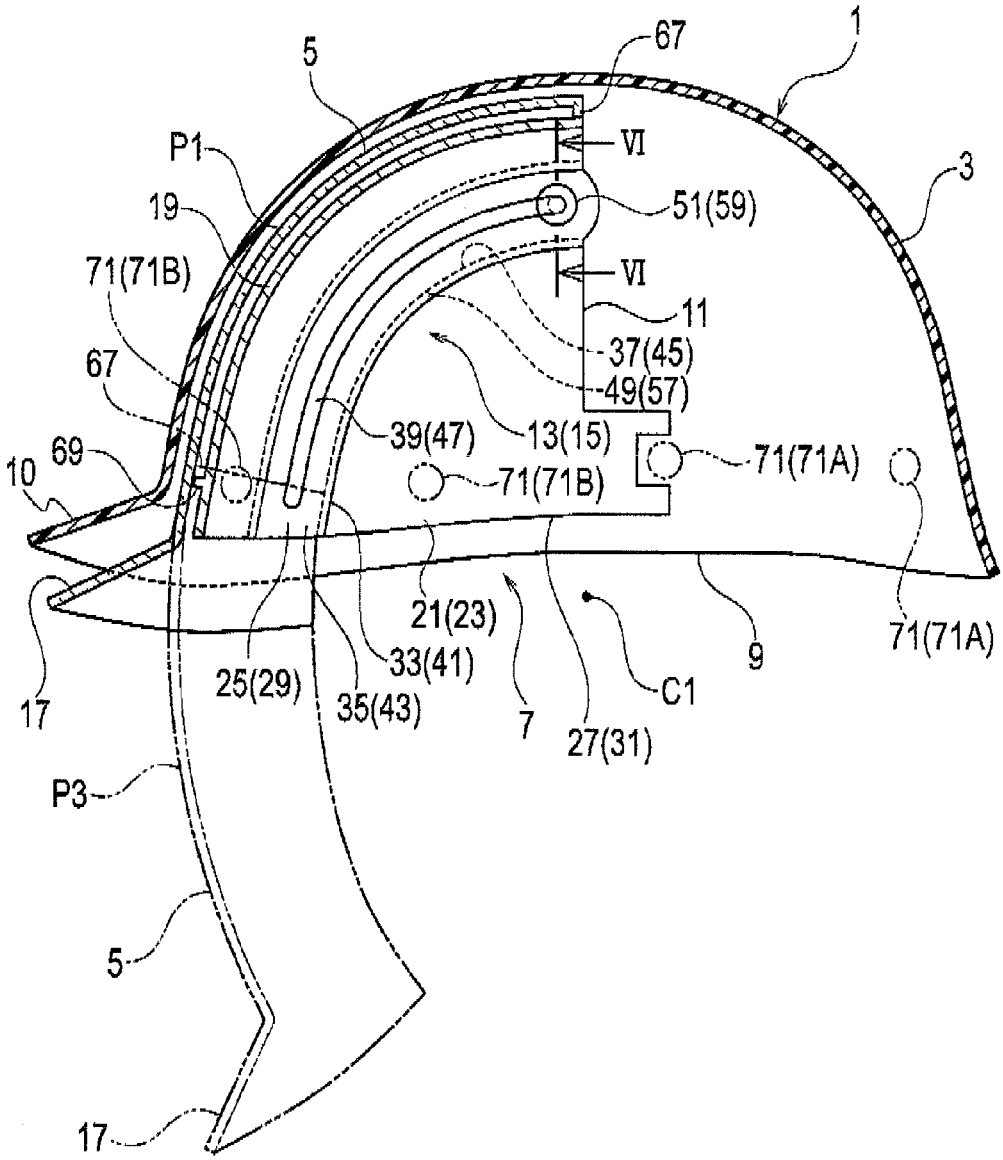
FIG. 3 is a cross sectional view of the protective cap.
Figure 4:
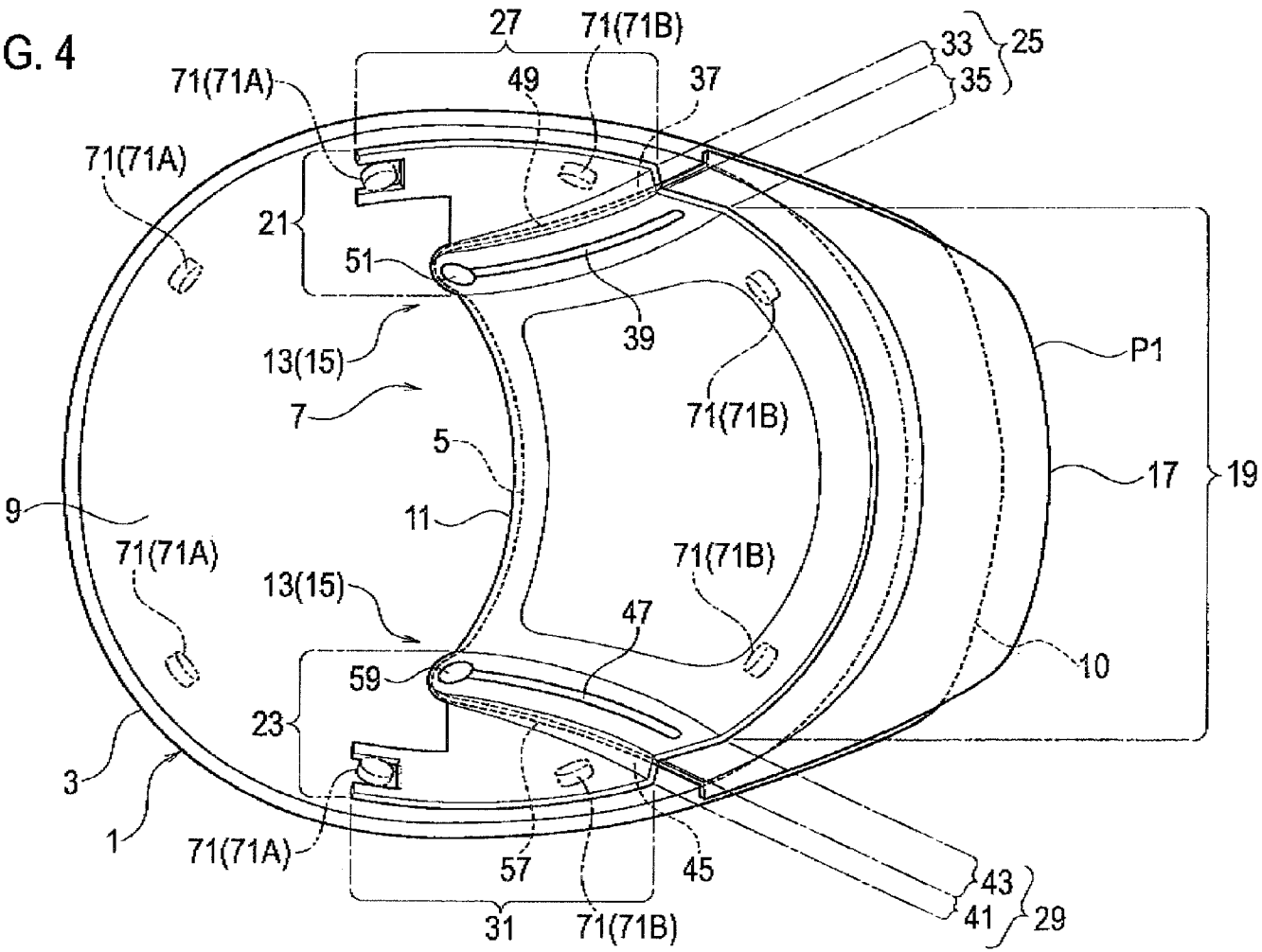
FIG. 4 is a view in which the protective cap 1 is viewed from its interior.
Figure 5:
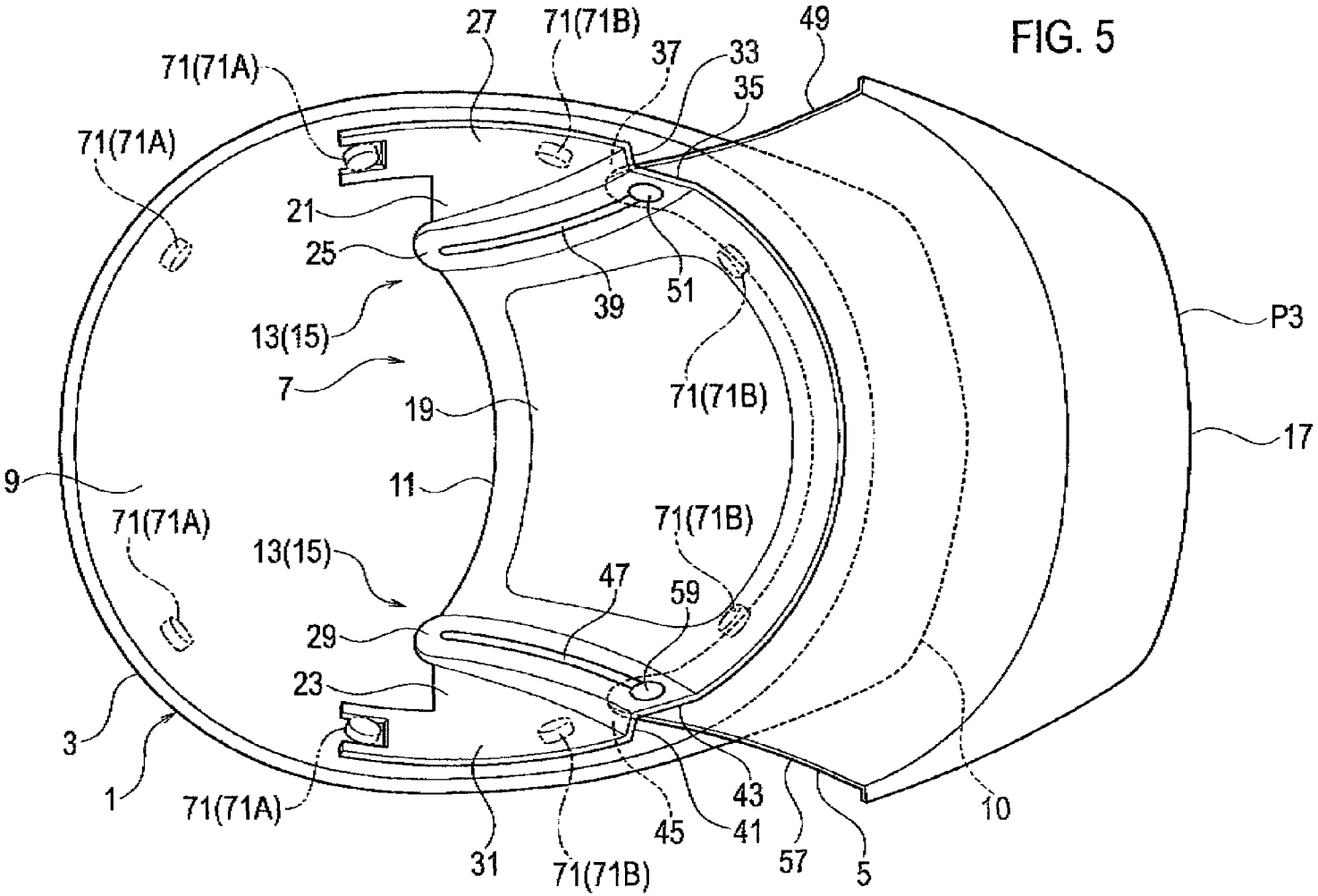
FIG. 5 is a view in which the protective cap 1 is viewed from its interior.

FIG. 1 and FIG. 2 are perspective views of a protective cap 1 when a wearer wears the cap, FIG. 3 is a cross sectional view of the protective cap, and FIG. 4 and FIG. 5 are drawings in which the protective cap 1 is viewed from its interior.

In the meantime, FIG. 1 and FIG. 4 show a state where a shield plate 5 is positioned at a housing position P1, and FIG. 2 and FIG. 5 show a state where the shield plate 5 is positioned at a shielding position P3. Further, FIG. 3 is a cross sectional view taken from a plane passing through a center of the protective cap 1 and developed in front-and-rear and upper-and-lower directions.

Further, in respective embodiments described later, respective directions in protective caps (cap bodies, shield plates, guide members and such) may be explained with using terms of a lateral direction (left-and-right direction), a front-and-rear direction, an upper-and-lower direction, "right", "left", "upper", "lower", "front" and "rear". These respective directions are directions where a standing (upright) wearer of the protective cap wears it. These three directions are substantially perpendicular to each other.

The protective cap (helmet with a shield face) 1 is constituted to for example comprise a cap body 3 formed to be substantially bilaterally symmetrical, a shield plate 5, and a guide means 7 for guiding the shield plate 5.

The cap body 3 is to protect a head of a wearer, and is for example constituted of a resin or such to form a bowl form (semi-spherical-shell-like form).

Here, the semi-spherical shell is one of bodies two bodies formed by dividing a body with a shape formed by removing a second sphere of a slightly smaller radius than a radius of a first sphere having a predetermined radius, which has a common center with the first sphere, into two.

The cap body 3 is formed in a "semi-spherical-shell-like" form and is thus not formed in a perfect semi-spherical shell form. More specifically, the cap body 3 is formed in a shape in which the curvature radius properly changes to fit it with a shape of a head of a wearer. Further an opening portion (an edge; a lowermost end) 9 of the cap body 3 is not a perfect circular shape and is formed in a circle-like shape in which the curvature radius properly changes to fit it with a shape of a head of a wearer.

As the cap body 3 is formed in a semi-spherical-shell-like form, the external surface and the internal surface of the cap body 3 are formed in a smooth spherical-surface-like shape in which sharply curved portions do not exist. Further, as the cap body 3 is formed in a semi-spherical-shell-like form, the opening portion 9 of the cap body 3 becomes substantially horizontal and the opening portion 9 positions at the slightly upper side than wearer's ears when a standing upright wearer wears the protective cap 1 (see FIG. 1 and FIG. 2).

The shield plate (face body; a shield member) 5 is to protect almost all of a face of a wearer and is constituted of a transparent (including colored transparency) or translucent material such as a resin.

The guide means 7 is a means for guiding the shield plate 5 at a time when the shield plate 5 moves relative to the cap body 3, and it is so structured that the shield member 5 moves to draw a circle-like trajectory along a curved internal surface of the cap body 3 (an internal curved surface at the front of the cap body formed in a concave sphere-like form) between a housing position P1 positioned at the upper side and a shielding position P3 positioned at the lower side. The housing position P1 is a position where the shield plate 5 is housed in the front interior of the cap body 3, and the shielding Position P3 is a position where the shield plate 5 covers almost all of a face of a wearer (front face of a head). Meanwhile it is regulated that ears of a wearer hide behind the shield plate 5 when viewed from the front of the wearer in a state where the upright standing wearer wears the protective cap 1 and the shield plate 5 is positioned at the shielding position P3.

As well as the shield plate 5 guided by the guide means 7 is made unlikely to be separated from the cap body 3, the shield plate 5 does not move in the left-and-right direction but moves (swings) with having a predetermined axis C1 (see FIG. 3) extending in the left-and-right direction of the protective cap 1 (cap body 3) as a pivotal center. The predetermined axis C1 extends through positions at the rears of left and right ears of a wearer in the left-and-right direction (a direction perpendicular to a paper face of FIG. 3).

The guide means 7 is constituted to comprise guide portions 13 provided at the guide member 11 and engagement portions 15 provided at the shield plate 5 for example.

The guide portions 13 are formed in an arc-like form (not a perfect arc shape but a shape close to an arc) and, as the guide portions 13 go along the internal surface of the front side of the cap body 3, the guide member 11 is provided integrally with the cap body 3 in the interior of the front side of the cap body 3. The guide portions 13 are provided at both ends in the lateral direction of the guide member 11.

The shield plate 5 is formed to be a plate-like form (curved plate-like form) comprising a sphere-like curved surface (a curved surface being slightly smaller in curvature radius than the face at the front side of the cap body 3). At portions at both ends in the lateral direction of the shield plate 5, engagement portions 15 engaging with the guide portions 13 are provided. Further as the engagement portions 15 engage with the guide portions 13, the shield plate 5 moves between the housing position P1 and the shielding position 23.

Describing the state where the shield plate 5 positions at the housing position P1 in more detail, the shield plate 5 is not thoroughly housed in the interior of the cap body 3 in this state but a lowermost end portion (the lowermost end portion where a visor 17 is provided) of the shield plate 5 and its vicinities protrudes out of the lowermost end portion 9 of the cap body 3 (the opening portion of the front side of the cap body 3) downward. Meanwhile the visor (visor portion) 17 turns over at the lowermost end portion of the shield plate 5. More specifically, the visor 17 bends in its reverse direction (a direction falling apart from a face of a wearer) and then extends out. Thereby, even if a flying object hits the shield plate (the shield plate at the shielding position P3) 5, a situation in which the flying object slides on the shield plate 5 to contact a body of a wearer can be avoided.

Even if the lowermost end portion or its vicinities of the shield plate 5 projects out of the lowermost end portion 9 of the cap body 3 downward in a state where the shield plate 5 is positioned at the housing position P1, it does not interfere with a wearer and the wearer can wear the protective cap 1 without being aware of existence of the shield plate 5 in his or her visual field. Further an uppermost end portion of the shield plate 5 is positioned at the vicinity of the top portion of the cap body 3. In the meantime, it is allowed to omit the visor 17 of the shield plate 5 and apply a configuration in which the shield plate 5 is thoroughly housed in the interior of the cap body 3 in a state where the shield plate 5 is positioned at the housing position P1.

In a state where the shield plate 5 is positioned at the shielding position P3, the lowermost end portion of the shield plate 5 is positioned below a chin of a wearer and then the shield plate 5 covers almost all of a face of the wearer. More specifically, when viewed from the front, all of the face of the wearer is covered with the shield plate 5. The uppermost end portion of the shield plate 5 is positioned in the interior of the cap body 3 in the vicinity of the lowermost end portion of the cap body 3 (the opening portion 9 of the front side of the cap body 3).

The guide member 11 is formed of a resin for example and is integrally constituted to comprise a first side portion 21 and a second side portion 23. A central portion 19 is formed in a plate-like form (curved plate-like form) to comprise a sphere-like curved surface (a curved surface being slightly smaller in curvature radius than the shield plate 5) along the internal surface of the cap body 3 (the internal curved surface of the cap body 3 formed in a concave sphere-like form). The first side portion 21 is integrally provided on the central portion 19 at one end portion side in the lateral direction of the central portion 19. The second side portion 23 is integrally provided on the central portion 19 at another end portion side in the lateral direction of the central portion 19.

The first side portion 21 is constituted of a proximal end portion side portion (a portion at the central portion 19 side) and a tip end portion side portion 27, and the second side portion 23 is likewise constituted of a proximal end portion side portion (a portion at the central portion 19 side) 29 and a tip end portion side portion 31. Further, on the respectively portions 25 and 29, guide portions 13 are formed.

Further, a tip end portion side portion 27 of the first side portion 21 and a tip end portion side portion 31 of the second side portion 23 engage with the cap body 3 (in face contact with lower internal surfaces at sides of the cap body 3, for example) so that the guide member is provided integrally with the cap body 11.

The shield plate 5 enters into a space formed among the cap body 3, the central portion 19 and the proximal portion side portions 25 and 29 of the respective side portions 21 and 23, thereby being housed in the cap body 3.

The tip end portion side portion 27 of the first side portion 21 is formed in a plate-like form (curved plate-like form) comprising a curved surface in face contact with the lower internal surface at one side of the cap body 3, and the tip end portion side portion 31 of the second side portion 23 is likewise formed in a plate-like form (curved plate-like form)

comprising a curved surface in face contact with the lower internal surface at another side of the cap body 3.

The proximal end portion side portion 25 of the first side portion 21 is constituted to comprise a standing portion 33 and a connection portion 35. The standing portion 33 is formed in an elongated plate-like form so to have its lateral direction in a direction of standing to stand from the tip end portion side portion 27 of the first side portion 21 in a direction, for example, substantially perpendicular thereto. The connection portion 35 is formed in an elongated plate-like form. One end, portion in the lateral direction thereof is provided integrally with the central portion 19 and another end portion in the lateral direction thereof is provided integrally with the standing portion 33, thereby connecting the standing portion 33 with the central portion 19.

In a state where the guide member 11 is provided integrally with the cap body 3, the standing portion 33 stands in a direction perpendicular to the internal surface of the cap body 3 (a direction to the interior of the cap body 3) and the connection portion 35 (respective surfaces in its thickness direction of the connection portion 35) extends in substantially front-and-rear and upper-and-lower directions.

Likewise the proximal end portion side portion of the second side portion 23 is constituted of a standing portion 41 and a connection portion 43.

Further, each guide portion 13 is constituted of one curved surface (an arc-like curved surface positioned at the front when the guide member 11 is installed in the cap body 3) 37 in its thickness direction of the standing portion 33, an elongated slot 39 in an arc-like shape formed on the connection portion 35, one curved surface (a convex arc-like curved surface positioned at the front when the guide member 11 is installed in the cap body 3) 45, and an elongated slot 47 in an arc-like shape formed on the connection portion 43.

The engagement portions 15 of the shield plate 5 are constituted of respective end faces 49, 59 in the lateral direction of the shield 5 and respective engagement pieces 51, 59. The end face 49 is one end face in the lateral direction of the shield plate 5, is made to from a convex arc-like shape having substantially the same curvature radius as that of the curved surface 47 of the standing portion 33, and is in line contact (more accurately, face contact) with and engages with the curved surface 37 to form a sliding contraposition. The end face 57 is another end face in the lateral direction of the shield plate 5, is formed in a similar way to the end face 49, and engages with the curved surface 45 of the standing portion 41.

Figure 6:
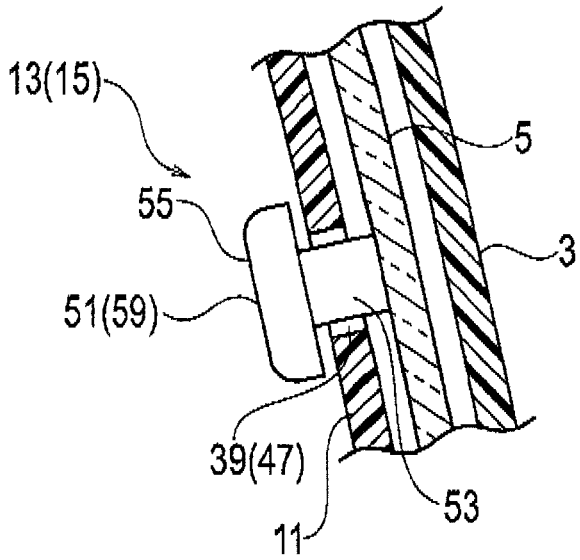
FIG. 6 is a VI-VI cross sectional view in FIG. 3.

Further, the engagement piece 51, as shown in FIG. 6 (the VI-VI cross section in FIG. 3), projects inward relative to the shield plate 5 at the upper end portion side of one end side in the lateral direction of the shield plate 5, and is provided integrally with the shield plate 5. The engagement piece 51 is formed in an umbrella-like shape comprising a proximal end portion 53 in a cylindrical shape and an umbrella portion 55 formed in a circular disc-like shape having a larger outer diameter than the proximal end portion 53. The engagement piece 51 has the proximal end portion 53 with a diameter slightly smaller than a width of the elongated slot 39 entering into the elongated slot 39 to engage therewith forming a sliding contraposition. Meanwhile the outer diameter of the umbrella portion 55 is made larger than the width of the elongated slot 39. Likewise at another side in the lateral direction of the shield plate 5, the engagement piece 59 is provided and the engagement piece 59 engages with the elongated slot 47.

It has a double structure in which the cap body 3 is disposed outside and the guide member 11 is disposed inside in the front of the protective cap 1 as shown in FIG. 3 when the guide member 11 is installed in the interior of the cap body 3. Then the shield plate 5 enters in between the cap body 3 and the guide member 13.

When the guide member 11 is installed in the cap body 3, a center of the arc-like curved surface 37(45) of the standing portion 33(41) and a center of the arc-like elongated slot 39(47) of the connection portion 35(43) substantially correspond to each other, and these centers are positioned at ear portions of a wearer. Thus the shield plate 5 is made to swing with having an axis C1 extending in the left-and-right direction of the protective cap through the ear portions of the wearer as its center. However, it does not swing to draw a trajectory of a perfect arc but swings to draw a trajectory of an arc-like shape close to an arc.

Further, the curved surface 37(45) of the standing portion 33(41) is positioned at the side of the pivotal center axis C1 relative to the elongated slot 39(47) of the connection portion 35(43) and the curvature radius of the elongated slot 39(47) of the connection portion 35(43) is larger than the curvature radius of the curved surface of the standing portion 33(41).

Further, a cross section of the central portion 19 of the guide member 11 (the cross section shown in FIG. 3), a cross section of the shield plate 5 (the cross section shown in FIG. 3), and a cross section of the front side portion of the cap body 3 (the cross section shown in FIG. 3) are formed in a arc-like shape having the pivotal center axis C1 to be its substantial center. Further the central portion 19 of the guide member 11 is disposed outside of the elongated slot 39(47) of the connection portion 35(43), the shield plate 5 is disposed outside relative to the central portion 19 of the guide member 11, and the front side portion of the cap body 3 is dispose outside relative to the shield plate 5.

A curvature radius of the central portion 19 of the guide member 11 is made larger than a curvature radius of the elongated slot 39(47), a curvature radius of the shield plate 5 is made larger than a curvature radius of the central portion 19 of the guide member 11, and a curvature radius of the front side portion of the cap body 3 is made larger than a curvature radius of the shield plate 5.

Further, in the cross section shown in FIG. 3, in a case where the shield plate 5 is positioned at the housing position P1, the uppermost end portion of the curved surface of the standing portion 33(41), the uppermost end portion of the elongated slot 39(47), the uppermost end portion of the central portion 19 of the guide member 11, and the uppermost end portion of the shield plate 5 are positioned at the upper side of the cap body 3 in the upper-and-lower direction, and positioned at the center portion of the cap body 3 in the front-and-rear direction. Further, the lowermost end portion of the curved surface 37(45) of the standing portion 33(41), the lowermost end portion of the elongated slot 39(47), the lowermost end portion of the central portion 19 of the guide member 11, and the lowermost end portion of the shield plate 5 are positioned close to the lowermost end portion at the front of the cap body 3.

Further, the protective cap 1 is provided with a retaining means 61 for retaining the shield plate 5. The retaining means 61 is to retain the shield plate 5 not to readily move the shield plate 5 relative to the cap body 3 when the shield plate 5 is positioned at the housing position P1 or the shielding position P3.

Figure 7:
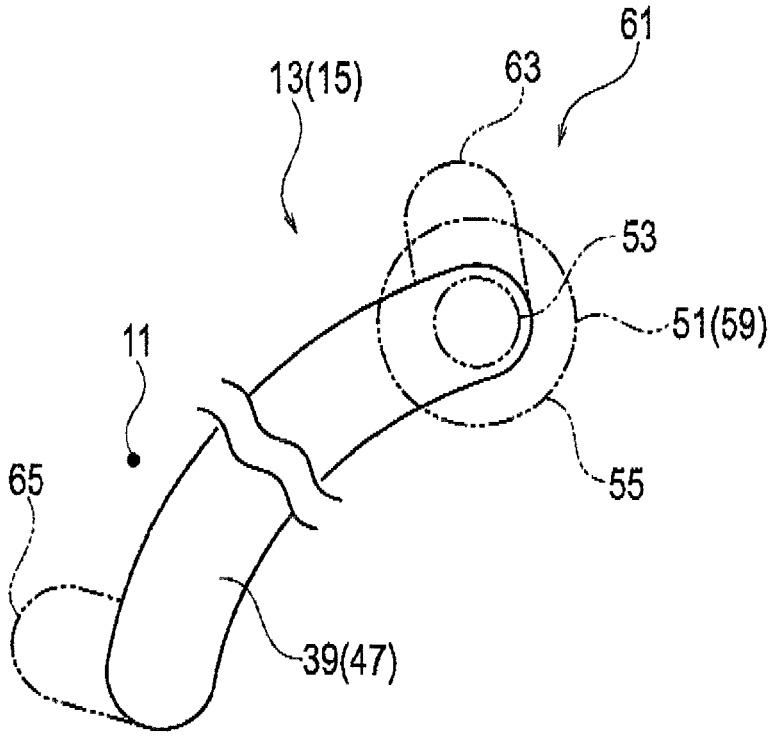
FIG. 7 is a drawing showing a concrete configuration of a retaining means 61.

The retaining means 61 is constituted to comprise respective cutouts 63,65 as shown in FIG. 7 for example. The cutout 63 connects with the elongated slot 39(47) at its uppermost end portion and is then provided with being directed upward relative to the elongated slot 39(47). The cutout 65 connects with the elongated slot 39(47) at its lowermost end portion and is then provided directed forward relative to the elongated slot 39(47).

Further, when the shield plate 5 is positioned at the housing position P1, the proximal end portion 53 of the engagement piece 51(59) enters into the cutout 63, thereby the shield plate 5 is made not to easily move. Moreover, when the shield plate 5 is positioned at the shielding position P3, the proximal end portion 53 of the engagement piece 51(59) enters into the cutout 65, thereby the shield plate 5 is made not to easily move.

Further, the protective cap 1 is provided with a stopper for preventing the central portion in the lateral direction of the shield plate 5 from moving downward to the extent beyond necessity when the shield plate 5 moves downward so as to position at the shielding position P3. The stopper is constituted of a projection 67 formed on the shield plate 5 and a projection 69 provided on the central portion 19 of the guide member 11.

By the way, the protective cap 1 is provided with a not-shown interior body (a hammock for example), and the cap body 3 and the guide member 11 are provided with a plurality of locking portions 71 for locking the hammock. Among the locking portions 71, the respective locking portions 71A positioned at the rear side are provided on the internal surface of the cap body 3 in an integral manner, and the respective locking portions 71B positioned at the front side are provided on the internal surface of the guide member 11 in an integral manner.

Operation for getting the shield plate 5 in and out when wearing the protective cap 1 will be described hereinafter.

First, in a state where the shield plate 5 is positioned at the shielding position P1, a wearer wears the protective cap 1. In a case where he or she needs to position the shield plate 5 at the shielding position P3 and then work, he or she pushes a lowermost end portion (the visor 17 for example) of the shield plate 5 forward to a small extent, then the engagement piece 51(59) gets out of the cutout 63, thereby the shield plate 5 is made movable. In this state, he or she has the shield plate 5 to move downward along the elongated slot 39(47), then the engagement piece 51(59) enters in the cutout 65 and the shield plate 5 is positioned at the shielding position P3, thereby the shield plate 5 is made not to easily move from the shielding position P3.

On the other hand, in a case where he or she seeks changes the shield plate 5 at the shielding position P3 into the housing position P1, he or she pushes a lowermost end portion (the visor 17 for example) of the shield plate 5 slightly forward, then the engagement piece 51(59) gets out of the cutout 65, thereby the shield plate 5 is made movable. In this state, he or she has the shield plate 5 to move upward along the elongated slot 39(47), then the engagement piece 51(59) enters in the cutout 65, thereby the shield plate 5 is made to position at the shielding position P3.

According to the protective cap 1, the shield plate 5 is steadily installed in the cap body 3 and is made to move along the curved surface of the cap body 3 by means of the guide means 7, thereby preventing failure to attach the shield plate 5 and allowing elongation of a movement stroke without making the cap body 3 larger with keeping its conventional shape. Further even if the length (height) of the shield plate 5 is sufficient to cover almost all of the face of the wearer, the shield plate 5 can be housed in the interior of the cap body 3 without interfering with the wearer.

Further, as the cap body 3 is formed in a semi-spherical-shell-like form in which a portion covering ears of a wearer is removed, the protective cap 1 is small-sized and its weight is reduced, and further it gives a feeling of being liberated to the wearer. Moreover, as the outside (convex side) surface and the inside (concave side) surface of the cap body 3 are smoothly curved, stiffness of the cap body 3 is increased.

Further, in accordance with the protective cap 1, as the shield plate 5 comprising a curved surface along the front internal surface of the cap body 3 and formed in a plate-like shape is guided by the guide portion 13 of an arc-like shape and then moves to draw a trajectory of an arc-like shape, its movement stroke can be further elongated. Even if a shield plate 5 having a sufficient length to cover almost all of a face of a wearer, it is further made easier that the shield member 5 is substantially housed in the cap body 3 without interfering with the wearer.

Further, in accordance with the protective cap 1, as the guide portion 13 of the arc-like shape is provided along the front internal surface of the cap body 3, a cap body 3 of a semi-spherical-shell-like shape which will not cover ears of a wearer can be used. More specifically, if it employs a configuration which makes the cap body support the shield plate 5 at the pivotal center C1, a pivotal axis for supporting the shield plate 5 (a pivotal axis positioned at the pivotal center C1 of the shield plate 5) is required to be additionally provided, thus the cap body 3 cannot be formed in a semi-spherical-shell-like shape. However, the protective cap 1 makes it possible that, without providing the cap body 3 with ear portions, the shape of the cap body 3 can be made to be the semi-spherical-shell-like shape.

Further, in accordance with the protective cap 1, as the guide member 11 is constituted as a integral body and is provided integrally with the cap body 3 so as to be in contact with the cap body 3 at two portions in the left-and-right direction in the cap body 3, stiffness of the guide member 11 of itself and attachment stiffness when the guide member 11 is attached to the cap body 3 are increased.

Further, one can provide the locking portion 715 for locking the hammock constituting the interior body in the interior of the central portion 19 of the guide member 11 to avoid interference with the guide member 13 and the shield plate 5.

Further, in accordance with the protective cap 1, the shield plate 5 is made to engage with four portions (the respective surfaces 37,45 and the respective elongated slots 39,47) of the guide member 11 and then move, the shield plate 5 is made to move in a smooth and stable state relative to the cap body 3.

By the way, in the protective cap 1, the shield plate 5 is made supported at both ends in the lateral directions thereof and then move, it can be additionally constituted in that the shield plate 5 is made supported at its central portion in the lateral direction and then move. For example, it may be constituted in that an engagement piece similar to the engagement piece 51 is provided at a central portion in the lateral direction of the shield plate 5 and an elongated slot engaging with the engagement piece (an elongated slot similar to the elongated slot 39) is provided at the central portion 19.

Further, as the shield plate, that of a half type covering only an upper half of a face of a wearer can be used.

Second Embodiment

Figure 8:
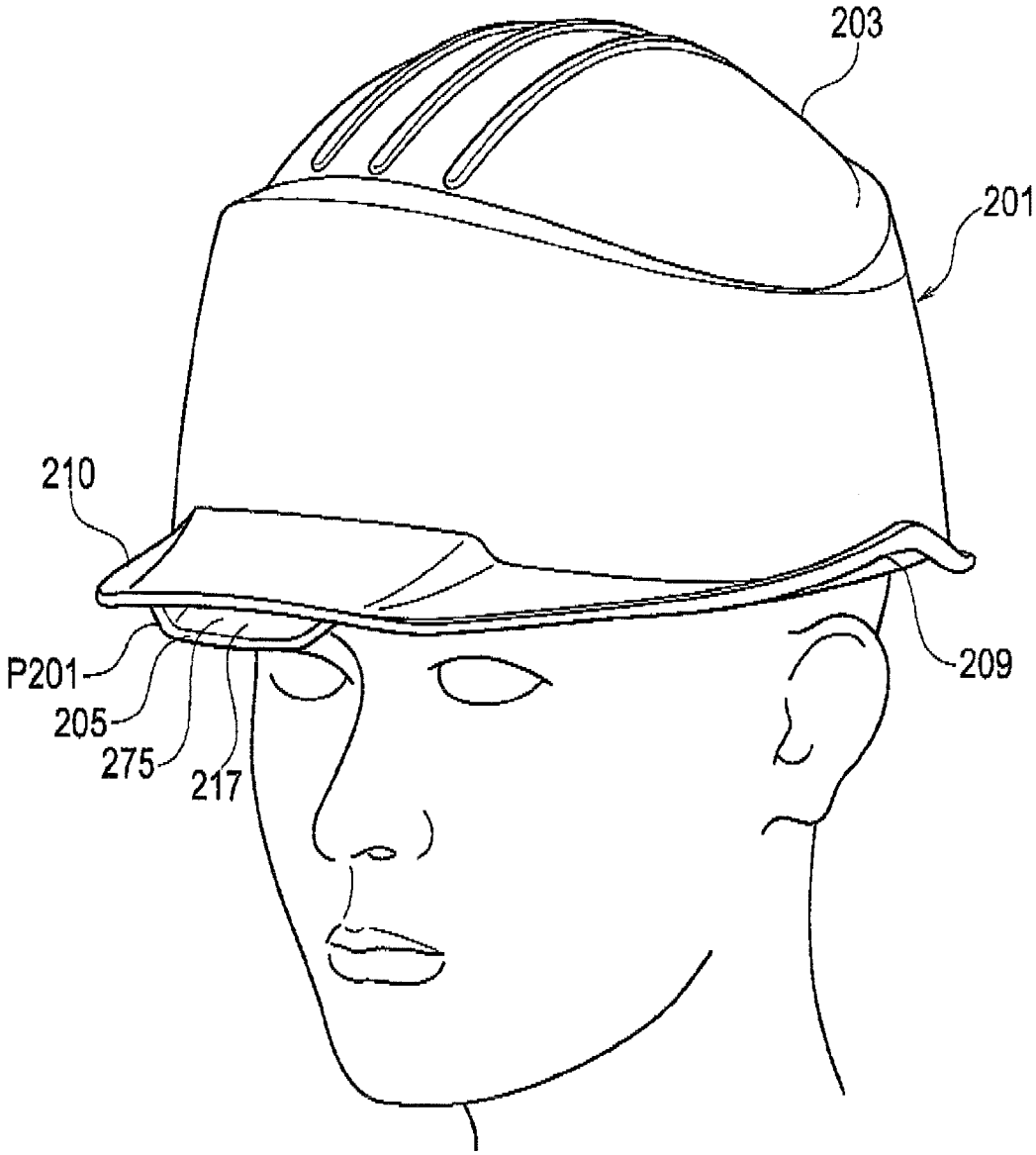
FIG. 8 is an elevational perspective view of a protective cap 201 in accordance with a second embodiment of the present invention when a wearer wears the cap.
Figure 9:
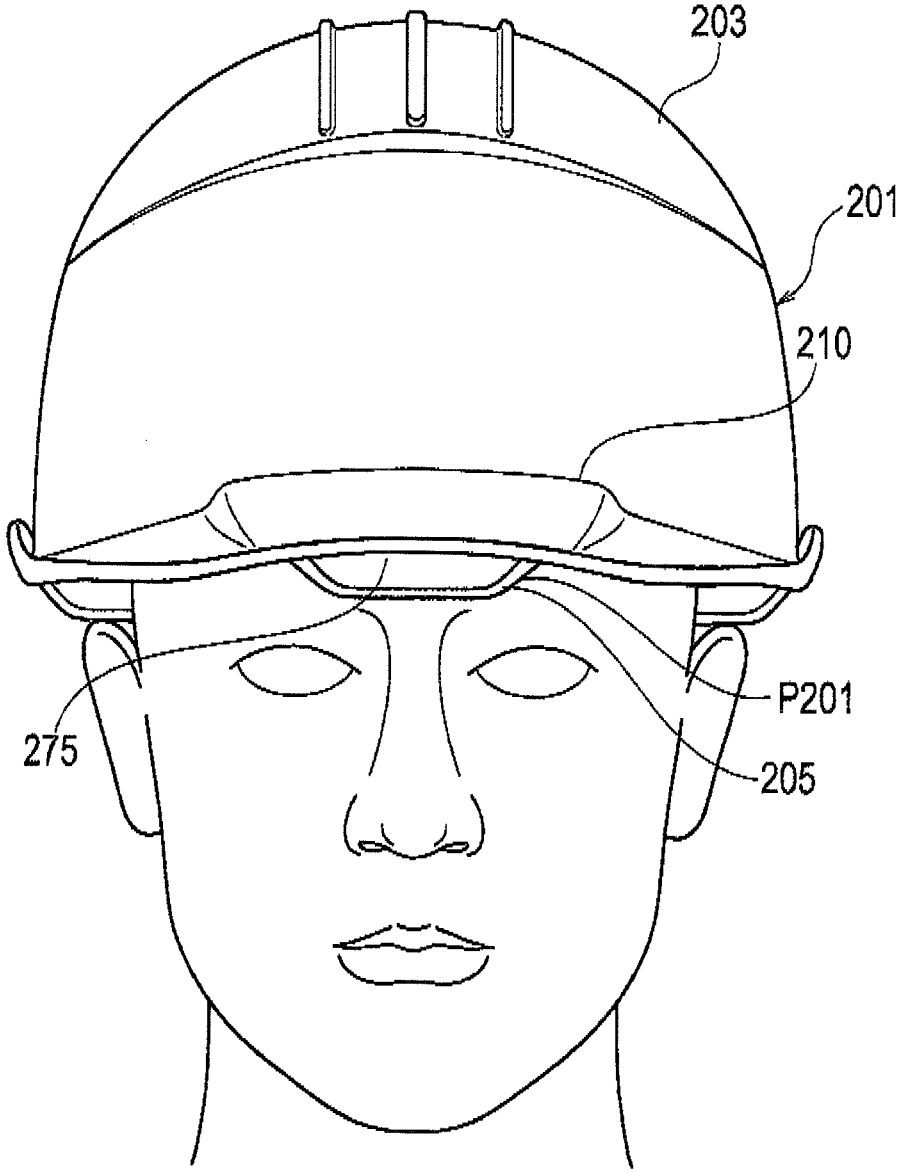
FIG. 9 is an elevational view of the protective cap 201 when the wearer wears the cap.
Figure 10:
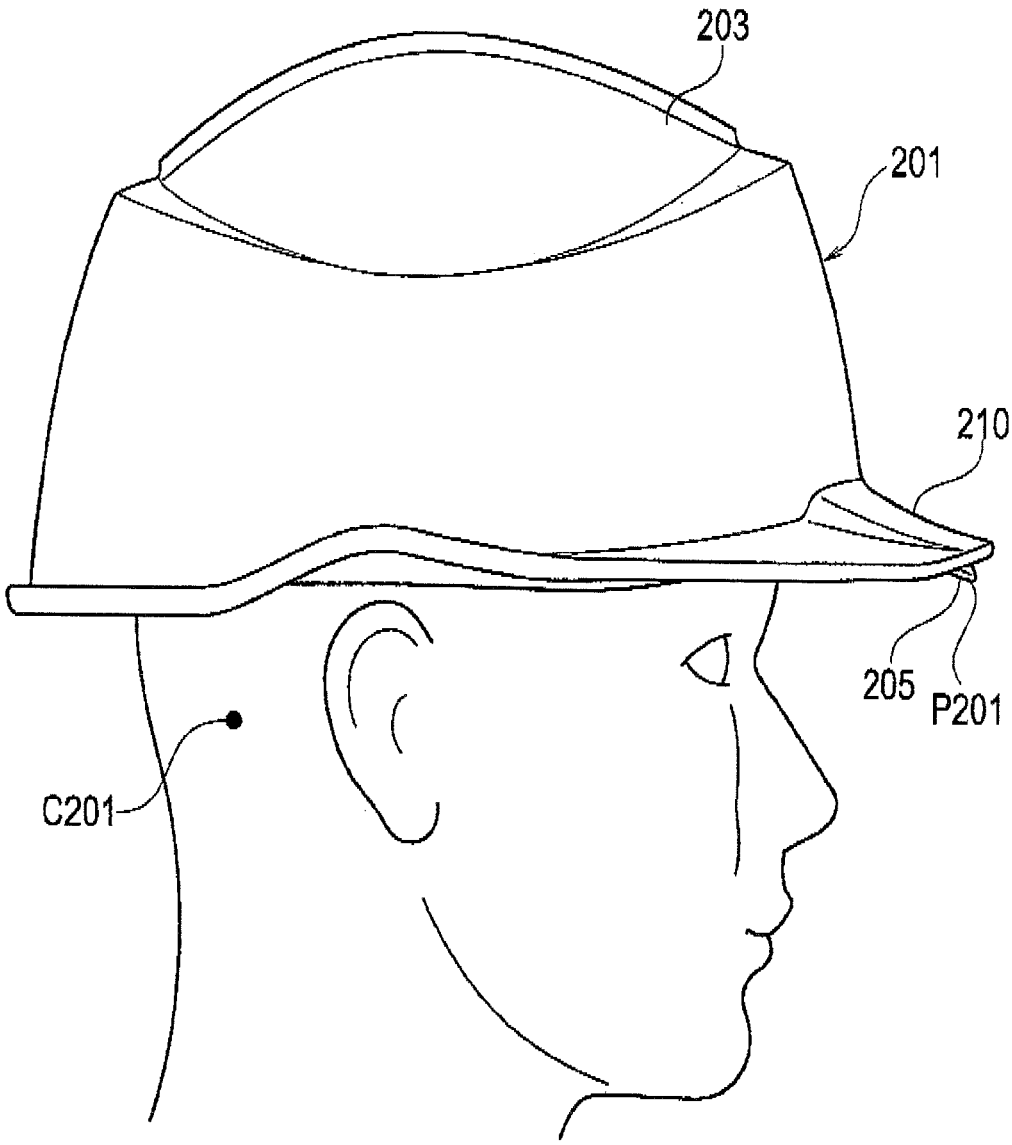
FIG. 10 is an elevational view of the protective cap 201 when the wearer wears the cap.
Figure 11:
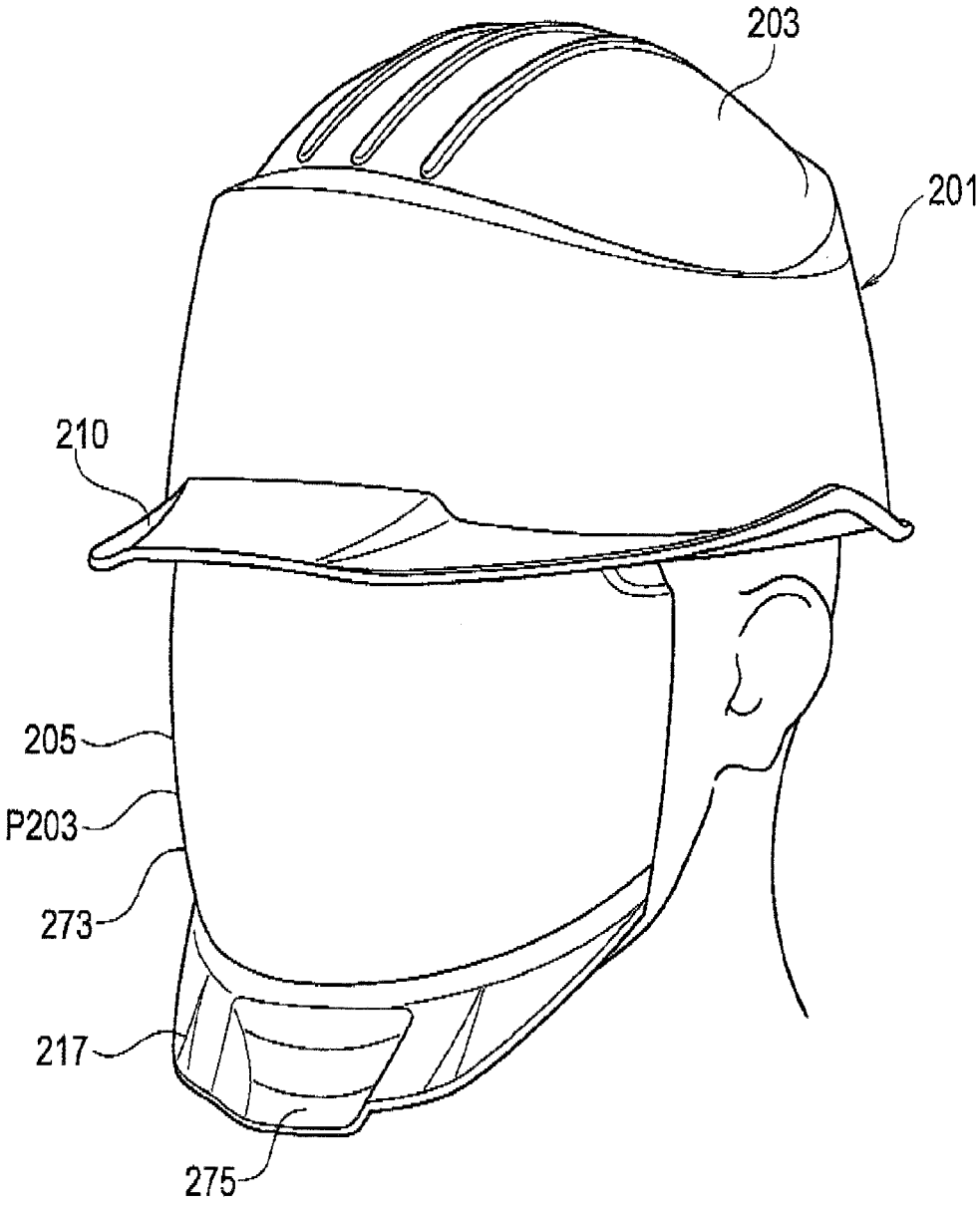
FIG. 11 is a perspective view of the protective cap 201 when the wearer wears the cap.
Figure 12:
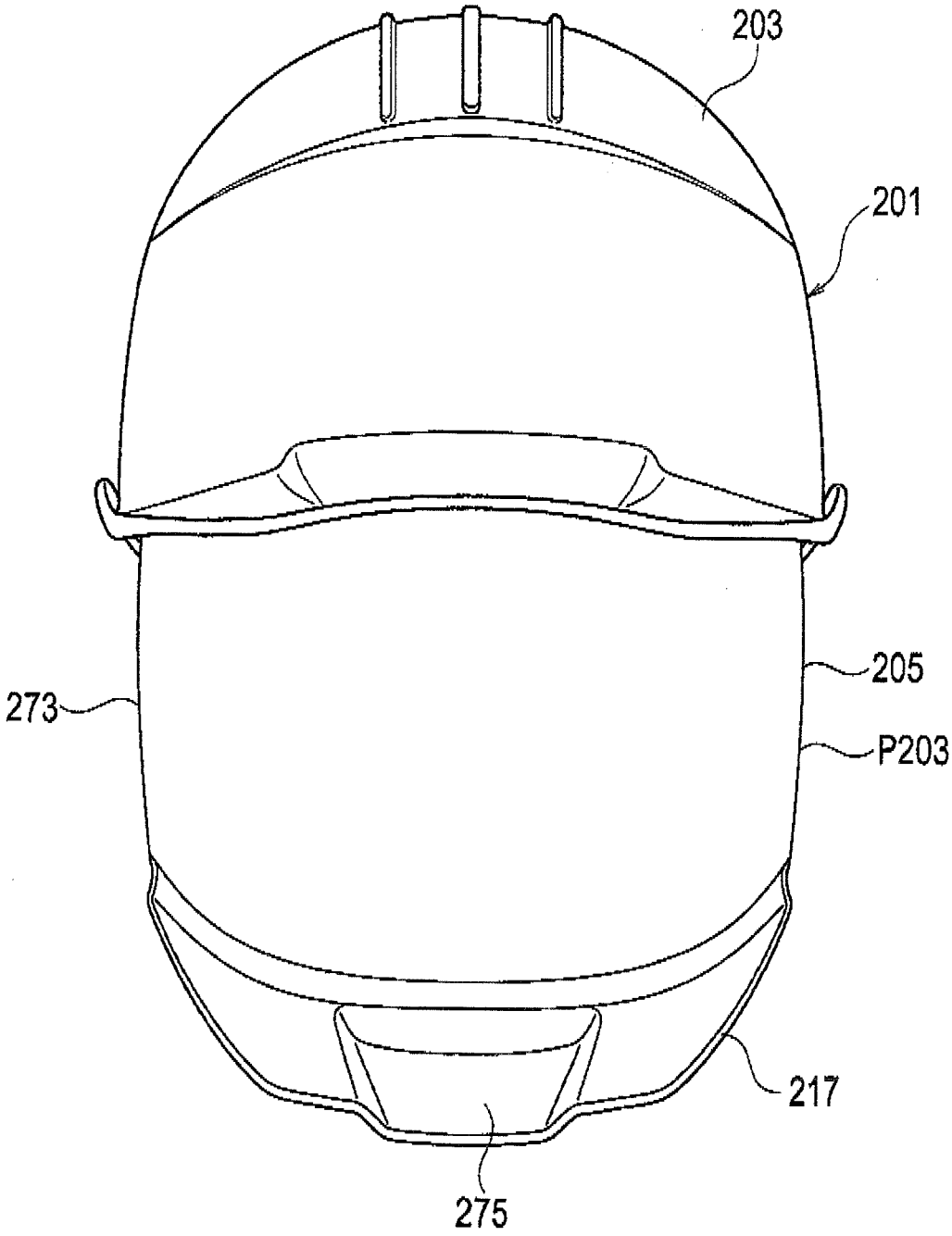
FIG. 12 is an elevational view of the protective cap 201 when the wearer wears the cap.
Figure 13:
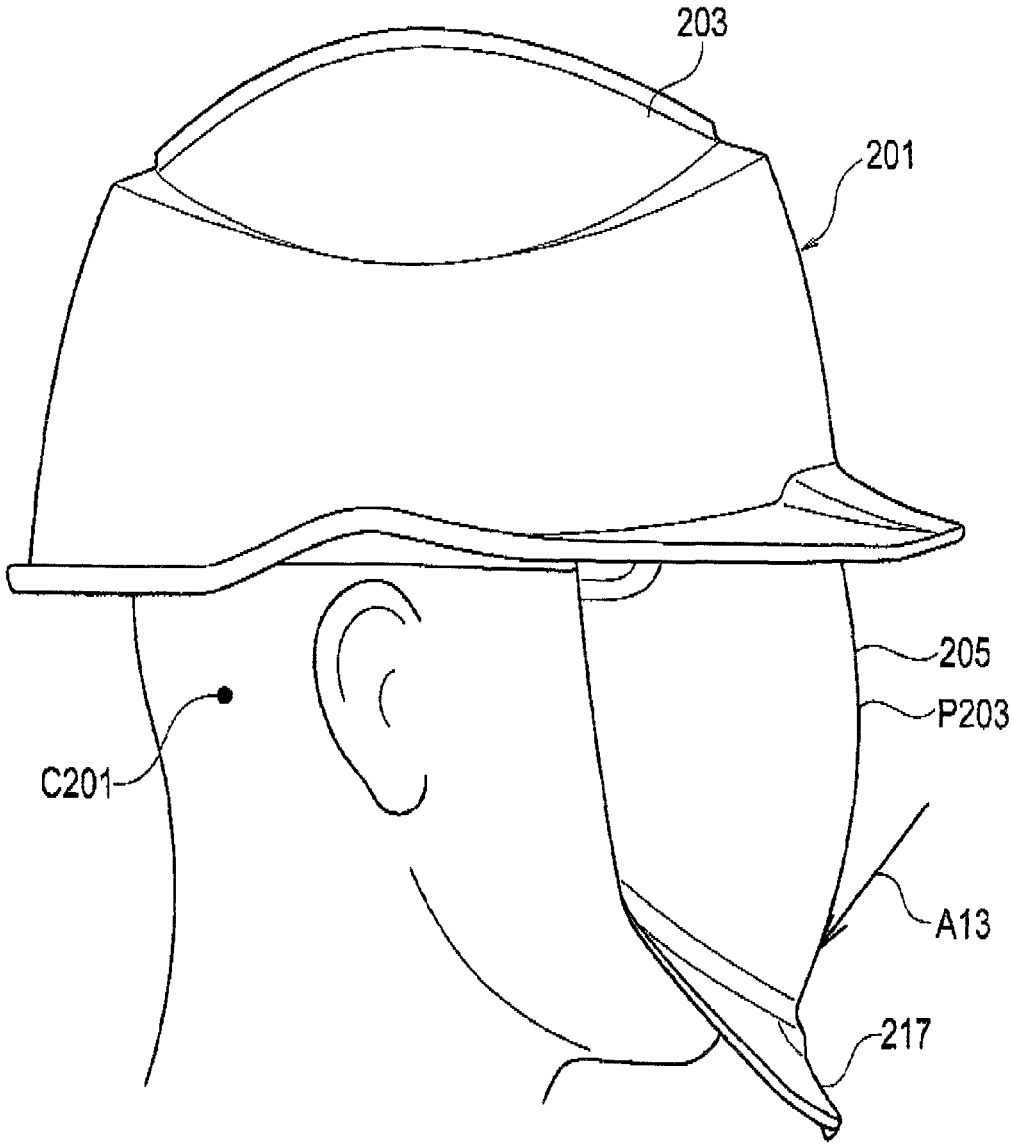
FIG. 13 is an elevational view of the protective cap 201 when the wearer wears the cap.

FIG. 8 and FIG. 11 are perspective views of a protective cap 201 when a wearer wears the cap, FIG. 9 and FIG. 12 are elevational views when the wearer wears the protective cap 201, and FIG. 10 and FIG. 13 are side views when the wearer wears the protective cap 201.

Meanwhile, FIG. 8, FIG. 9 and FIG. 10 show a state where a shield plate 205 is positioned at a housing position P201, and FIG. 11, FIG. 12 and FIG. 13 show a state where the shield plate 205 is positioned at a shielding position P203.

Figure 14:
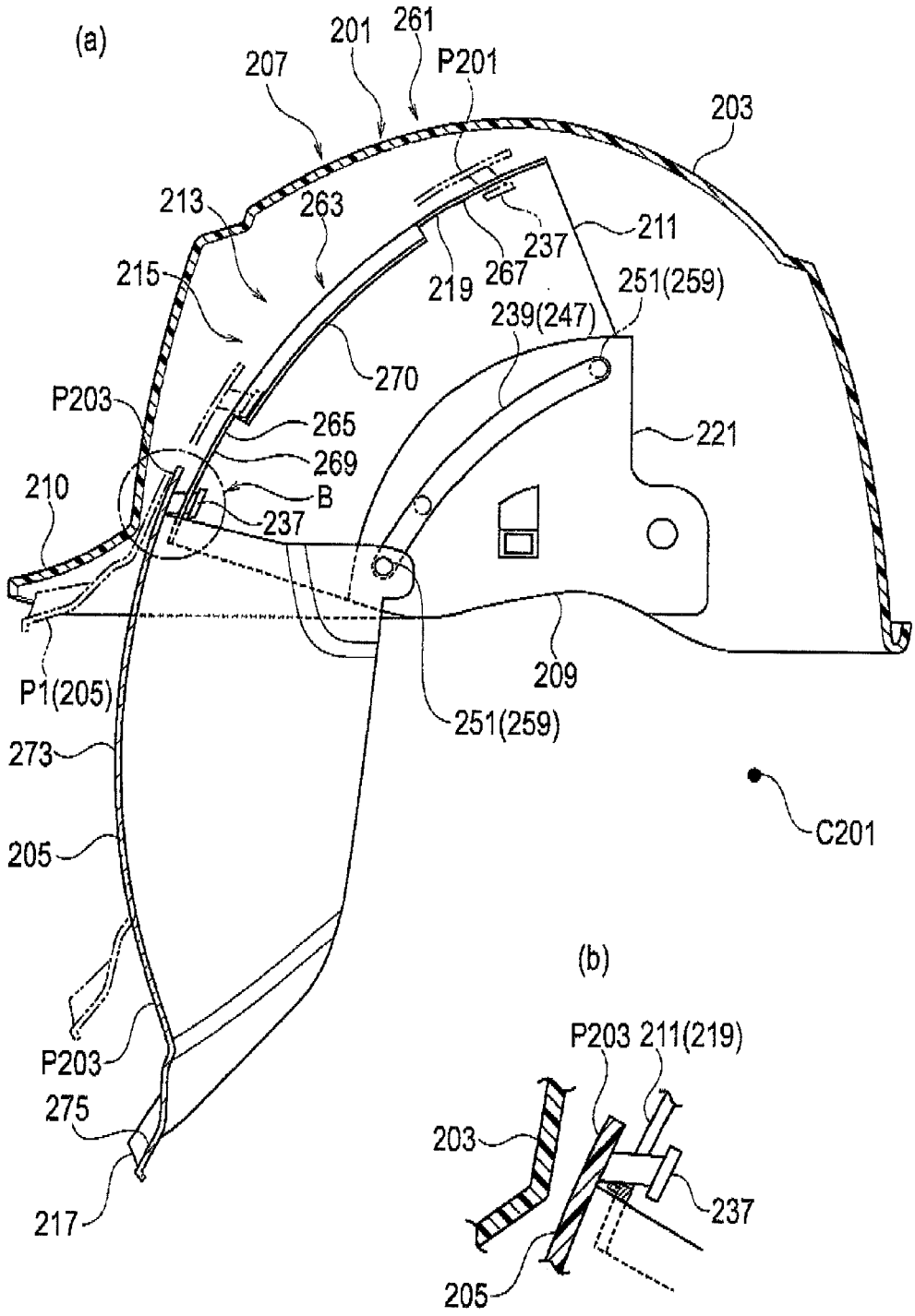
FIG. 14 is a cross sectional view of the protective cap 201.
Figure 15:
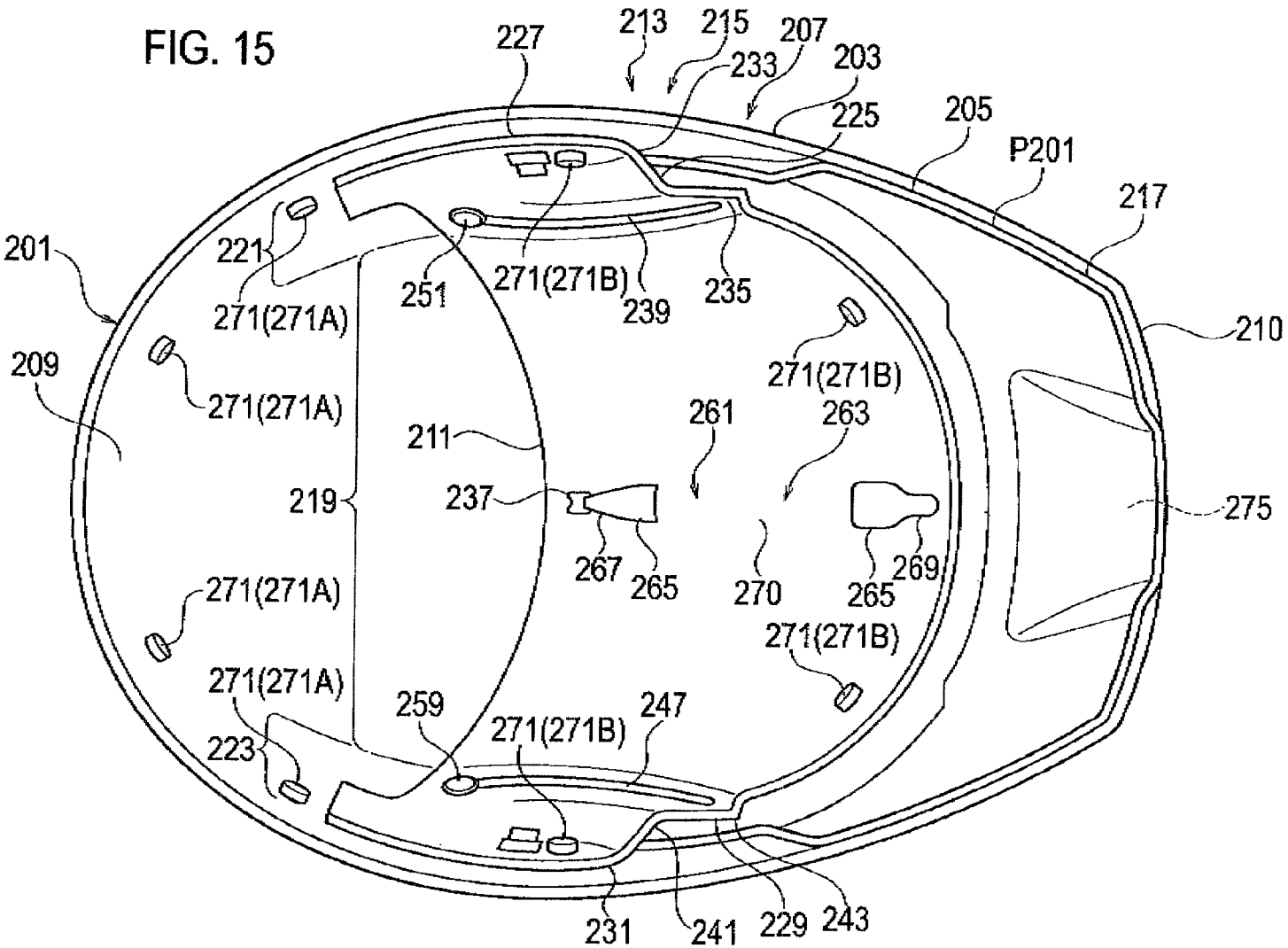
FIG. 15 is a perspective view in which the protective cap 201 is viewed from its interior.

FIG. 14 is a cross sectional view of the protective cap 201 taken from a plane extending through a center of the protective cap 201 in its front-and-rear and upper-and-lower directions, and FIG. 15 is a perspective view when the protective cap 201 is viewed from its interior. Meanwhile, FIG. 14(*b*) is an enlarged view of a part B in FIG. 14(*a*).

Figure 16:
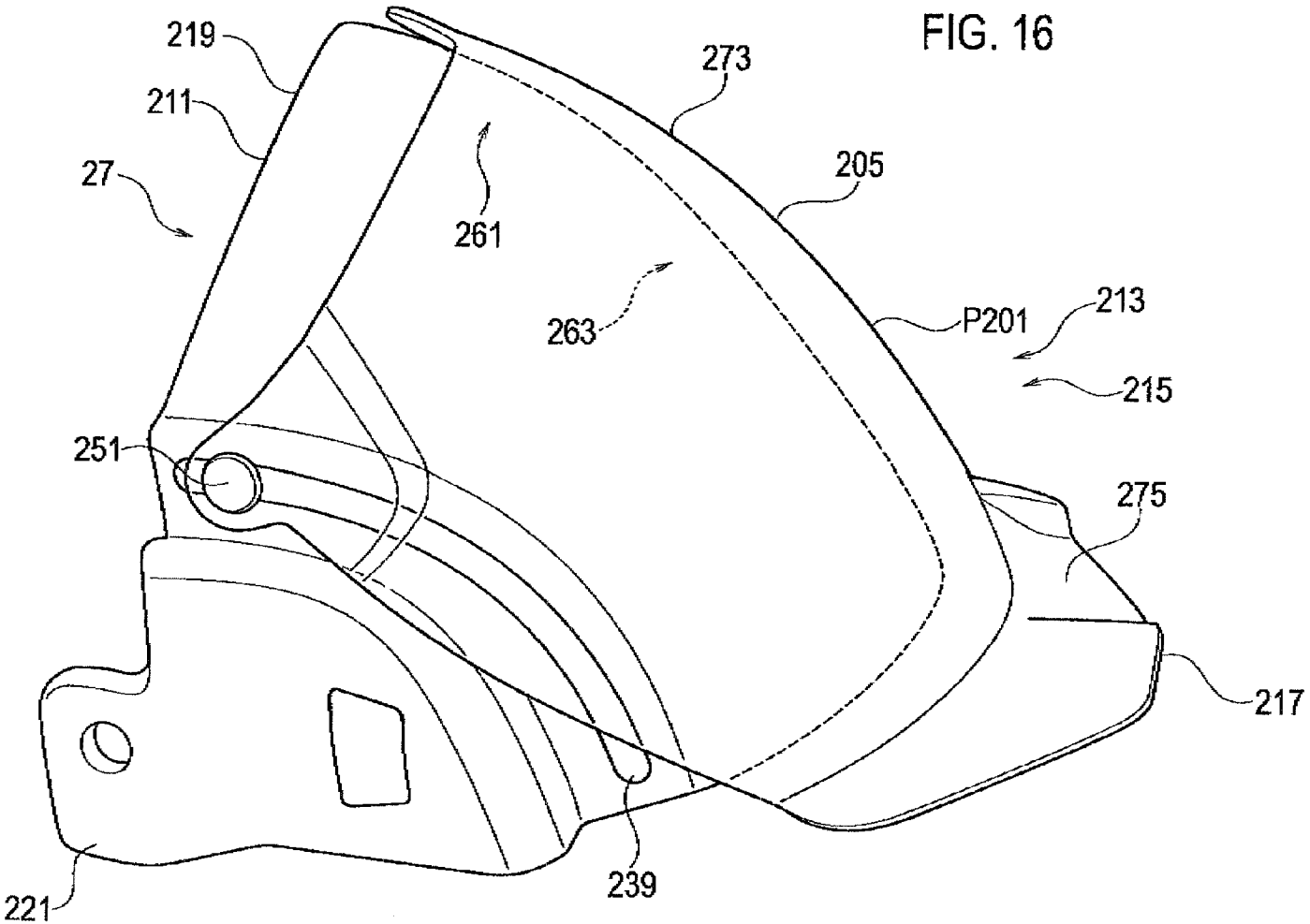
FIG. 16 is a perspective view showing a state where a guide member 211 and a shield plate 205 are assembled.
Figure 17:
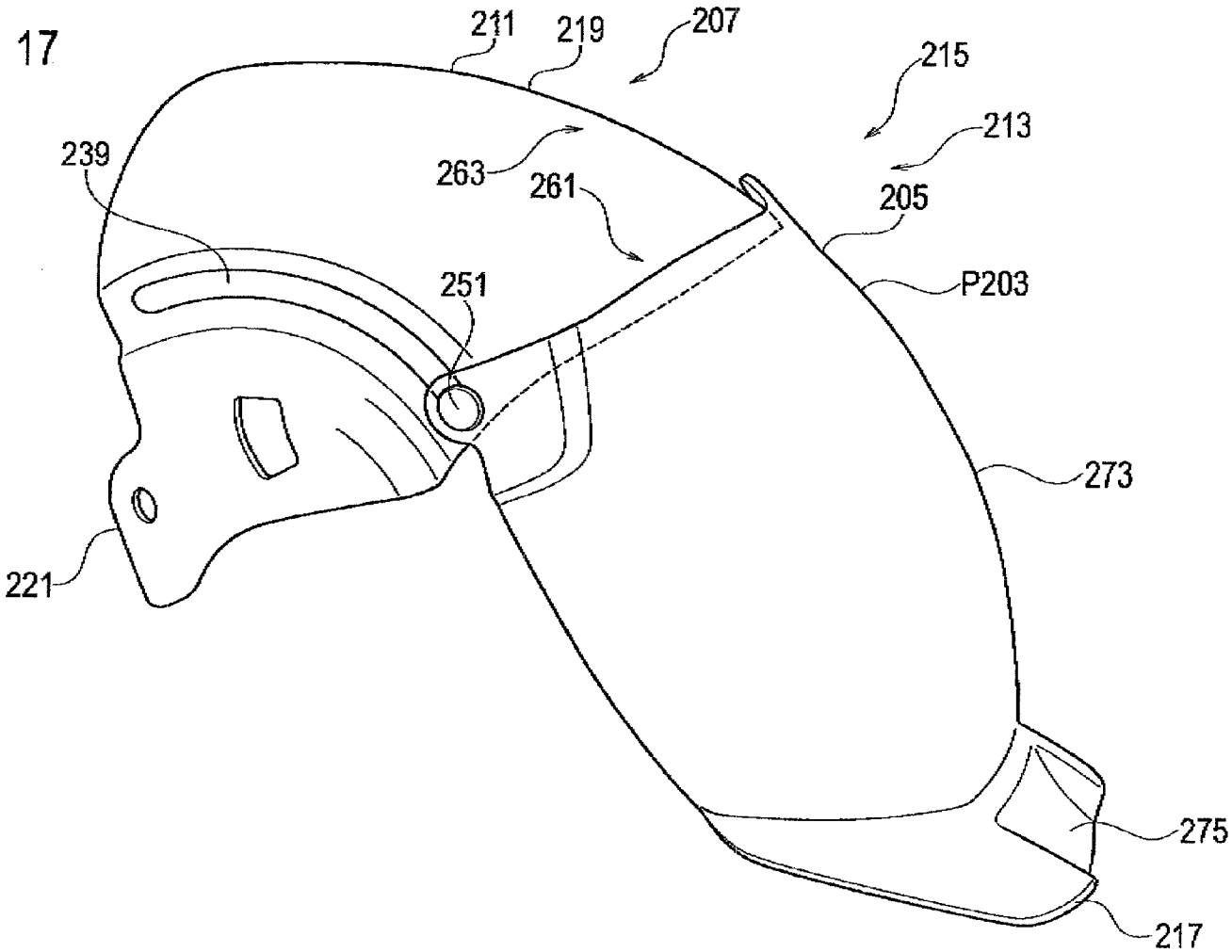
FIG. 17 is a perspective view showing a state where a guide member 211 and a shield plate 205 are assembled.

FIG. 16 and FIG. 17 are perspective views showing a state where a guide member 211 and the shield plate 205 are assembled. Meanwhile, FIG. 16 shows a state where the shield plate 205 is positioned at the housing position P201 and FIG. 17 shows a state where the shield plate 205 is positioned at the shielding position P203.

Figure 18:
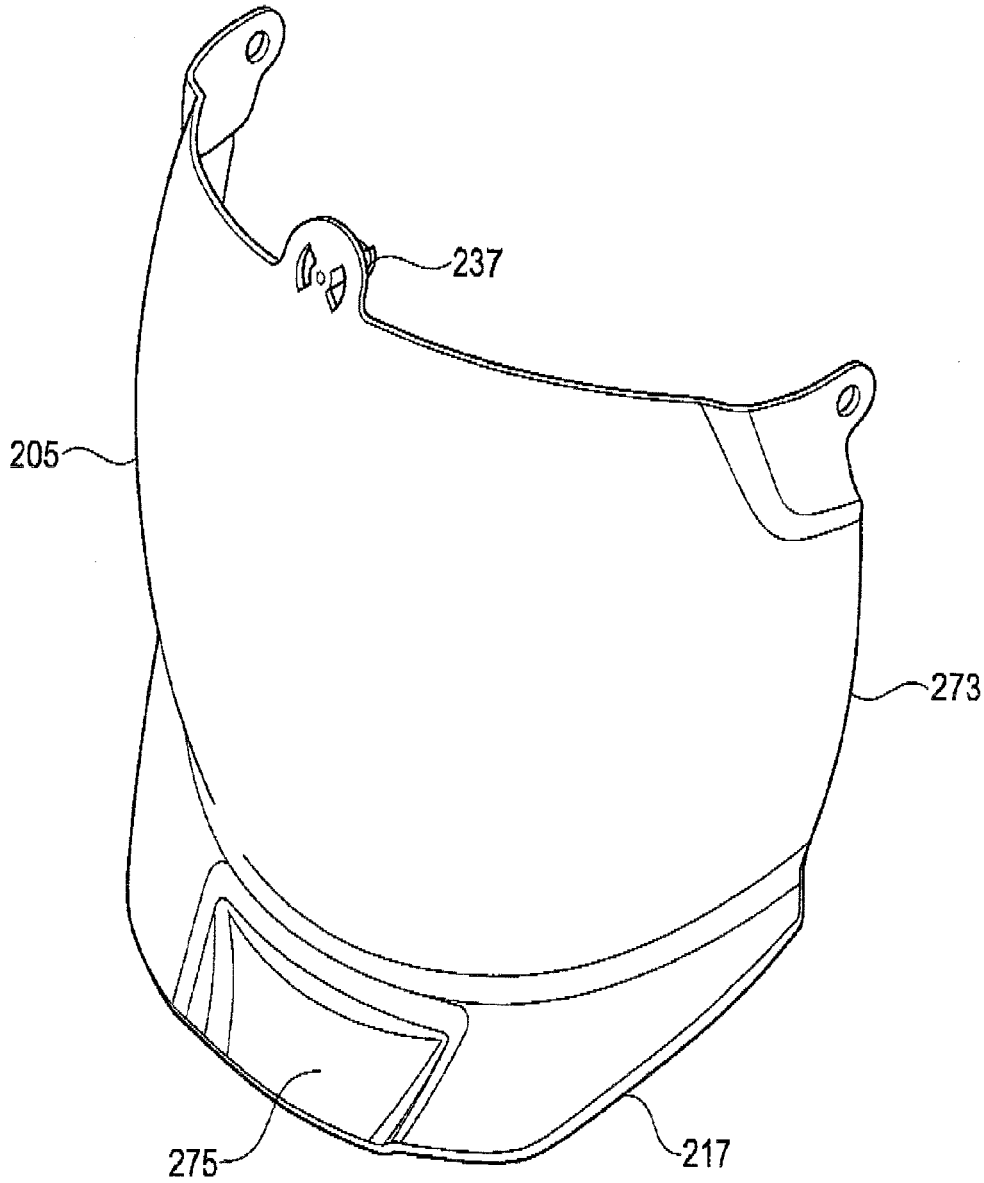
FIG. 18 is a perspective view showing a summarized configuration of the shield plate 205.
Figure 19:
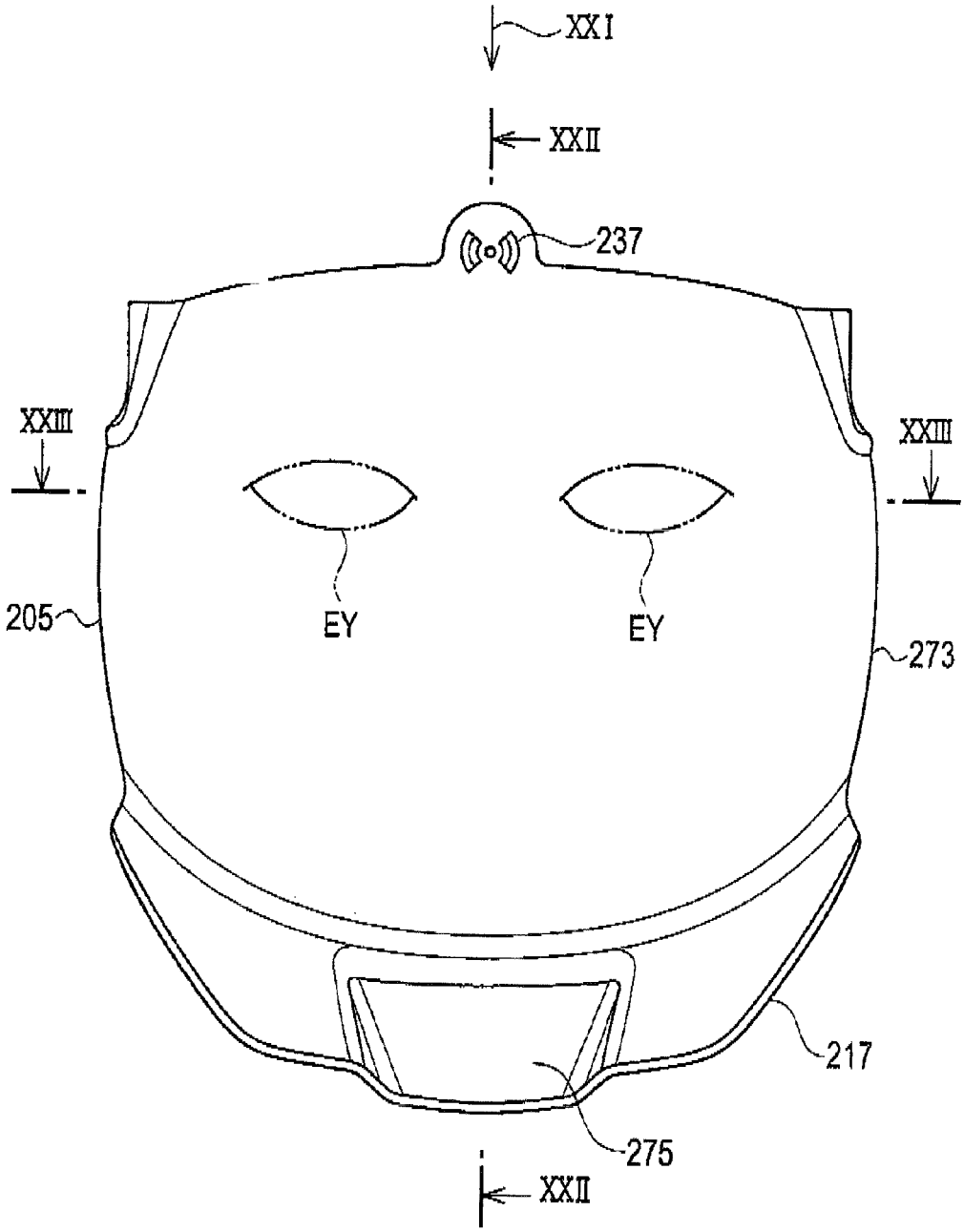
FIG. 19 is a perspective view showing a summarized configuration of the shield plate 205.
Figure 20:
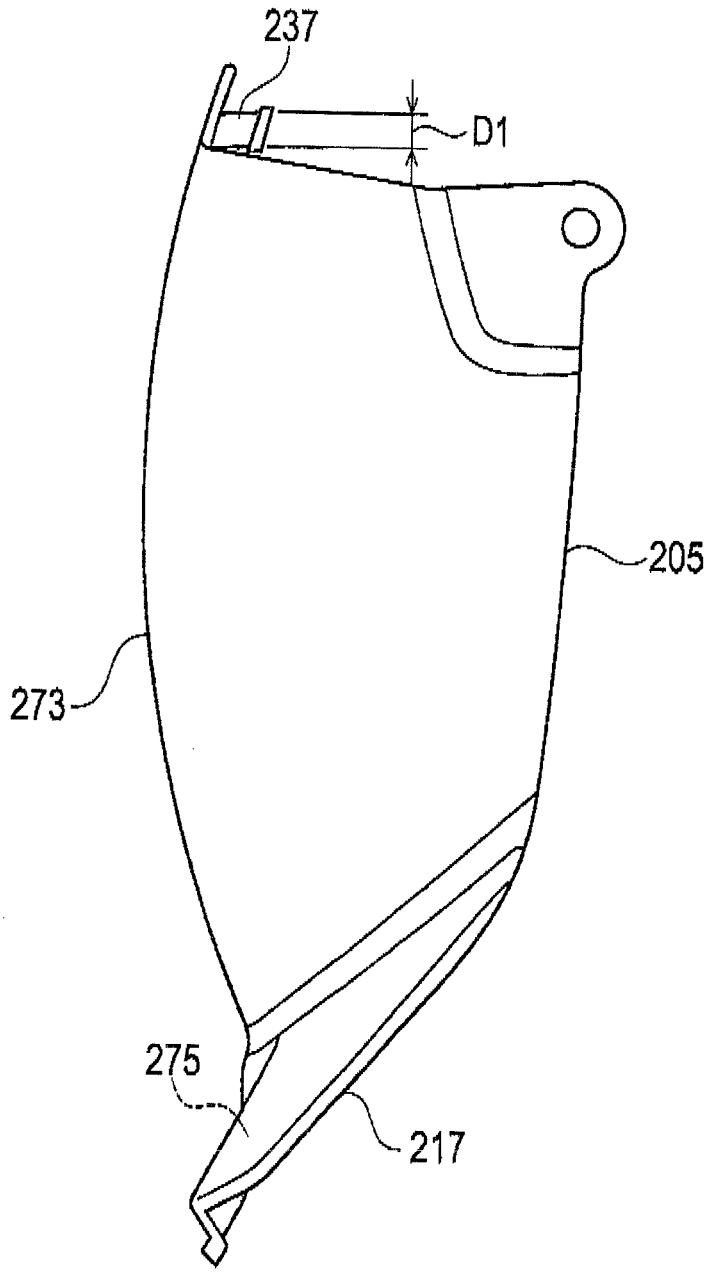
FIG. 20 is a perspective view showing a summarized configuration of the shield plate 205.
Figure 21:
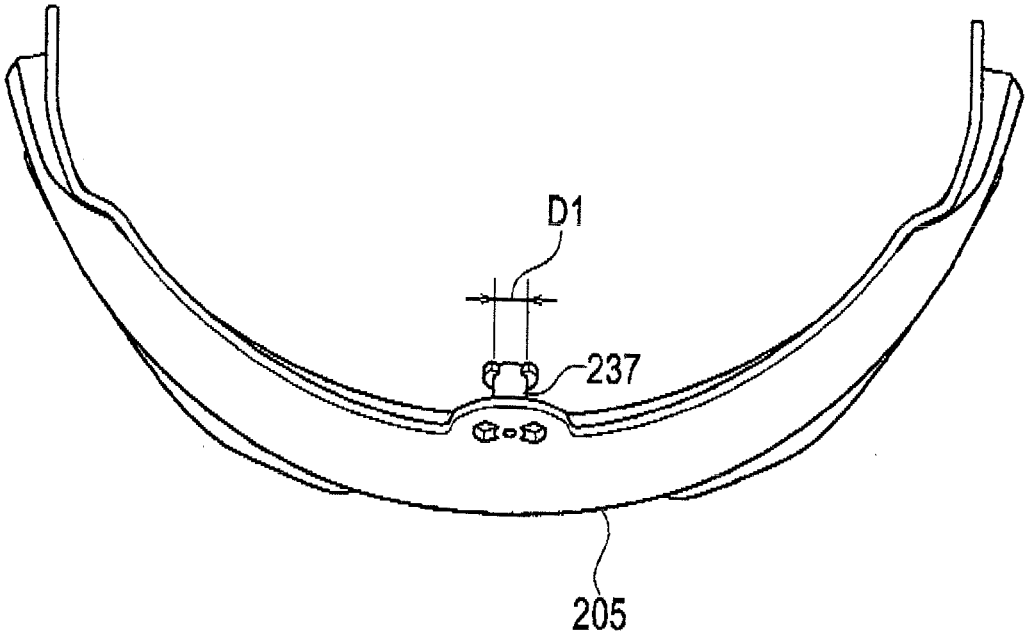
FIG. 21 is a drawing viewed from an arrow XXI in FIG. 19.
Figure 22:
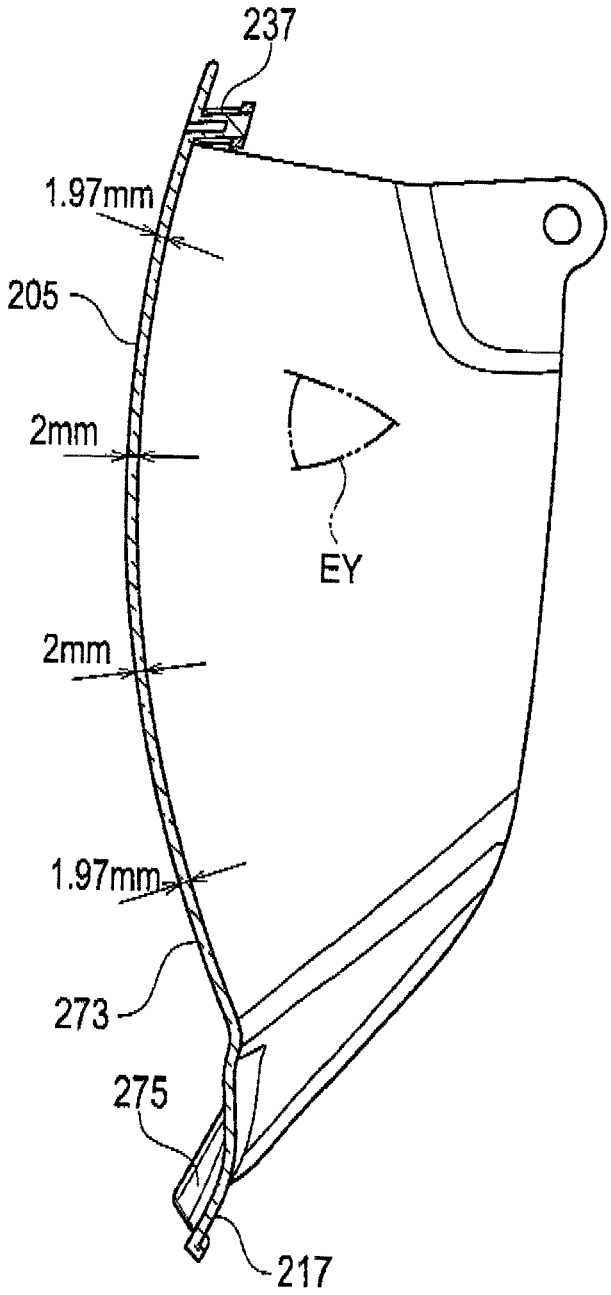
FIG. 22 is a drawing of a cross section XXII-XXII in FIG. 19.
Figure 23:
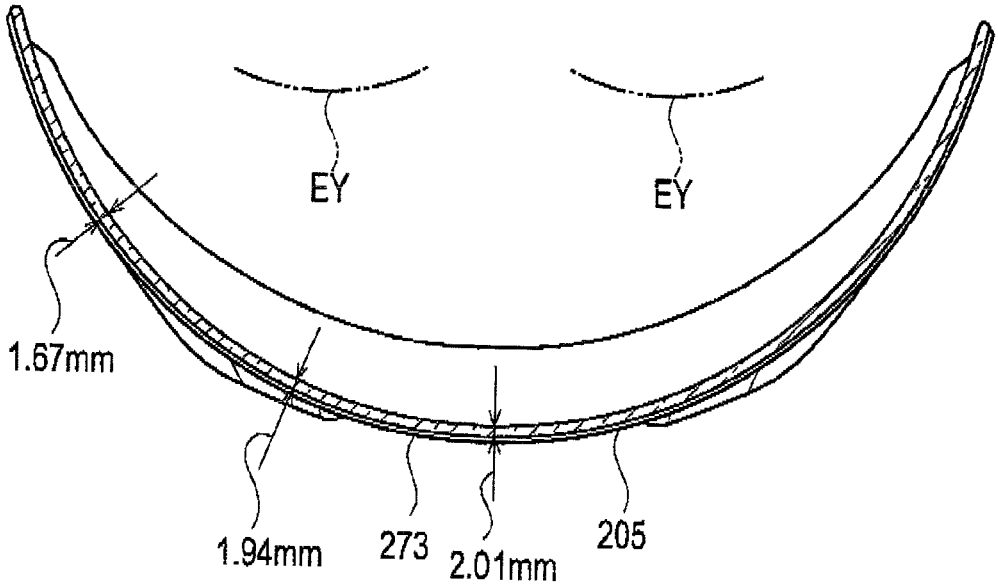
FIG. 23 is a drawing of a cross section XXIII-XXIII in FIG. 19.

FIG. 18 is a perspective view showing a summarized configuration of the shield plate 205, FIG. 19 is an elevational view showing a summarized configuration of the shield plate 205, FIG. 20 is a side view showing a summarized configuration of the shield plate 205, FIG. 21 is a drawing viewed from an arrow XXI in FIG. 19, FIG. 22 is a drawing showing a cross section XXII-XXII in FIG. 19, and FIG. 23 is a drawing showing a cross section XXIII-XXIII in FIG. 19.

Figure 24:
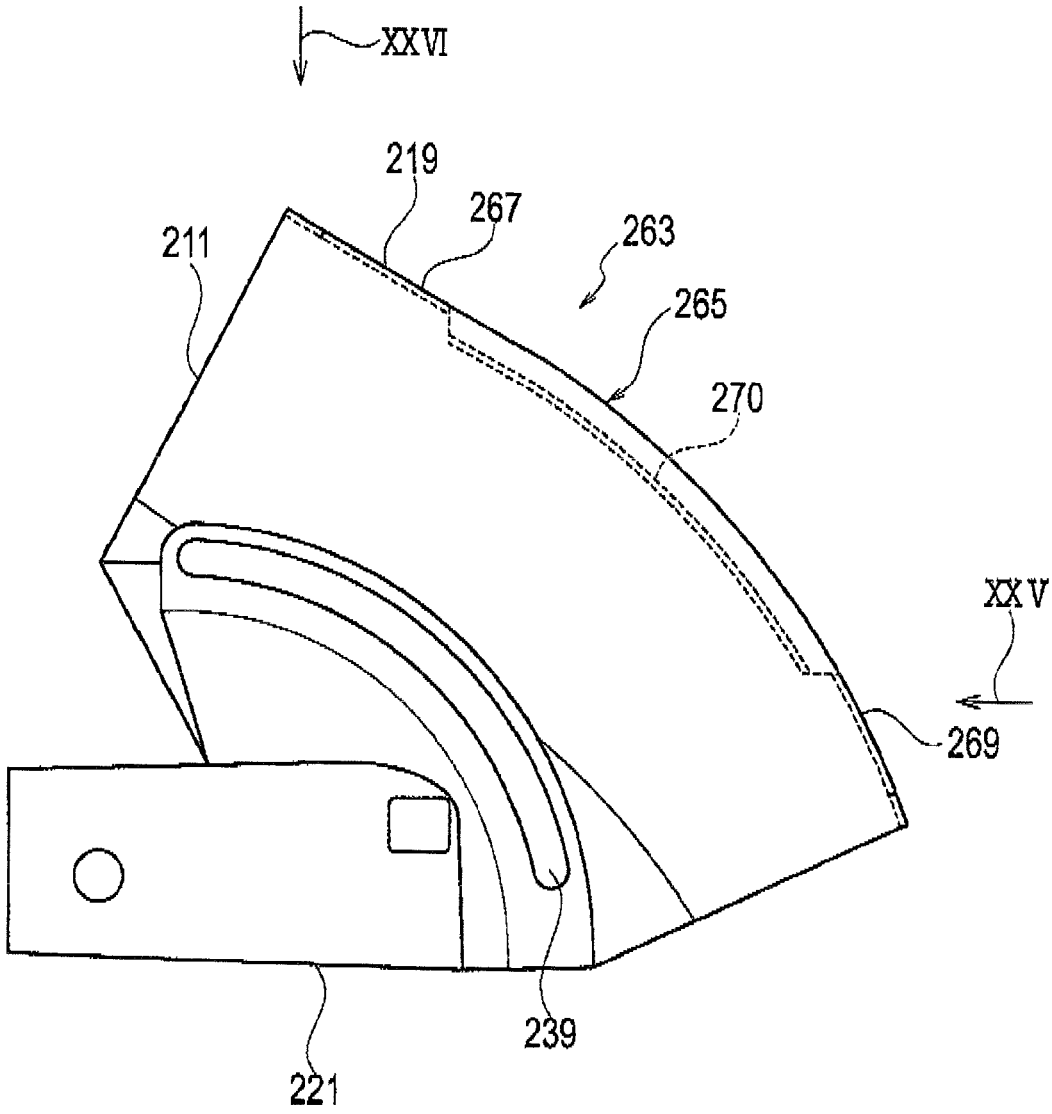
FIG. 24 is an elevational view showing a summarized configuration of the guide member 211.
Figure 25:
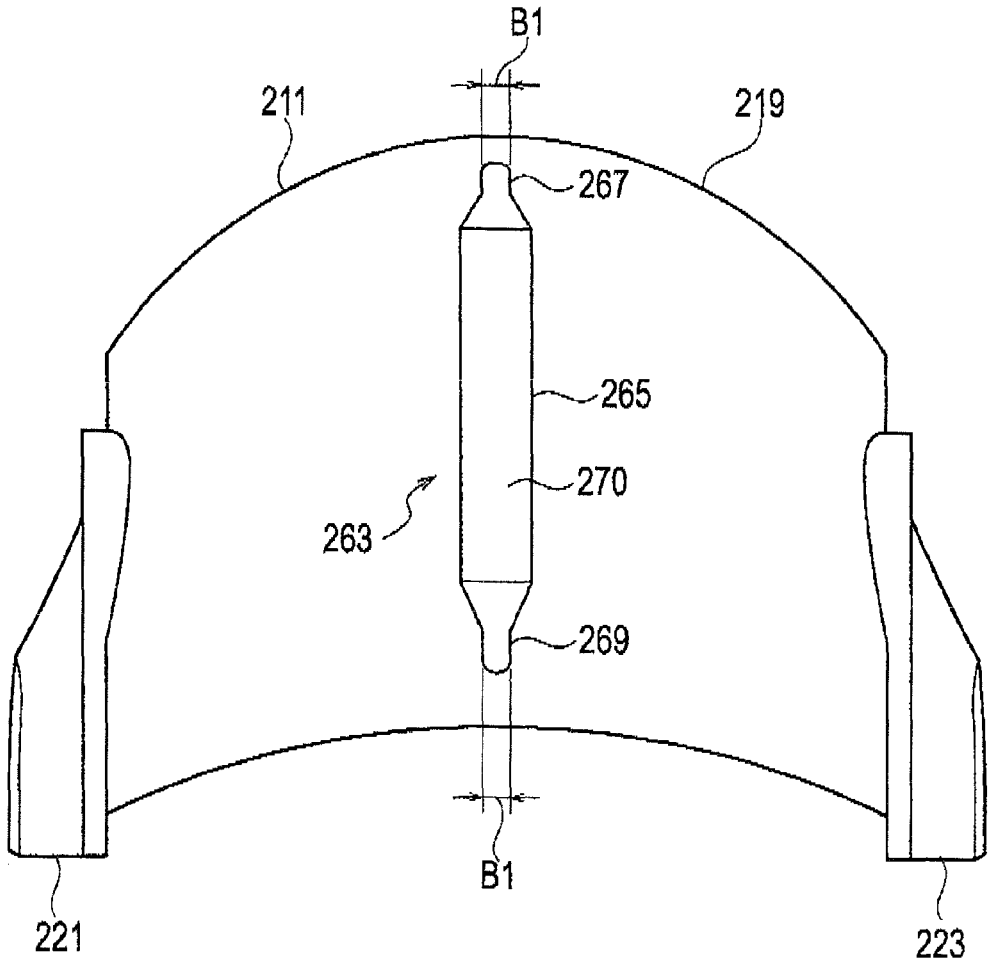
FIG. 25 is a drawing viewed from an arrow XXV in FIG. 24.
Figure 26:
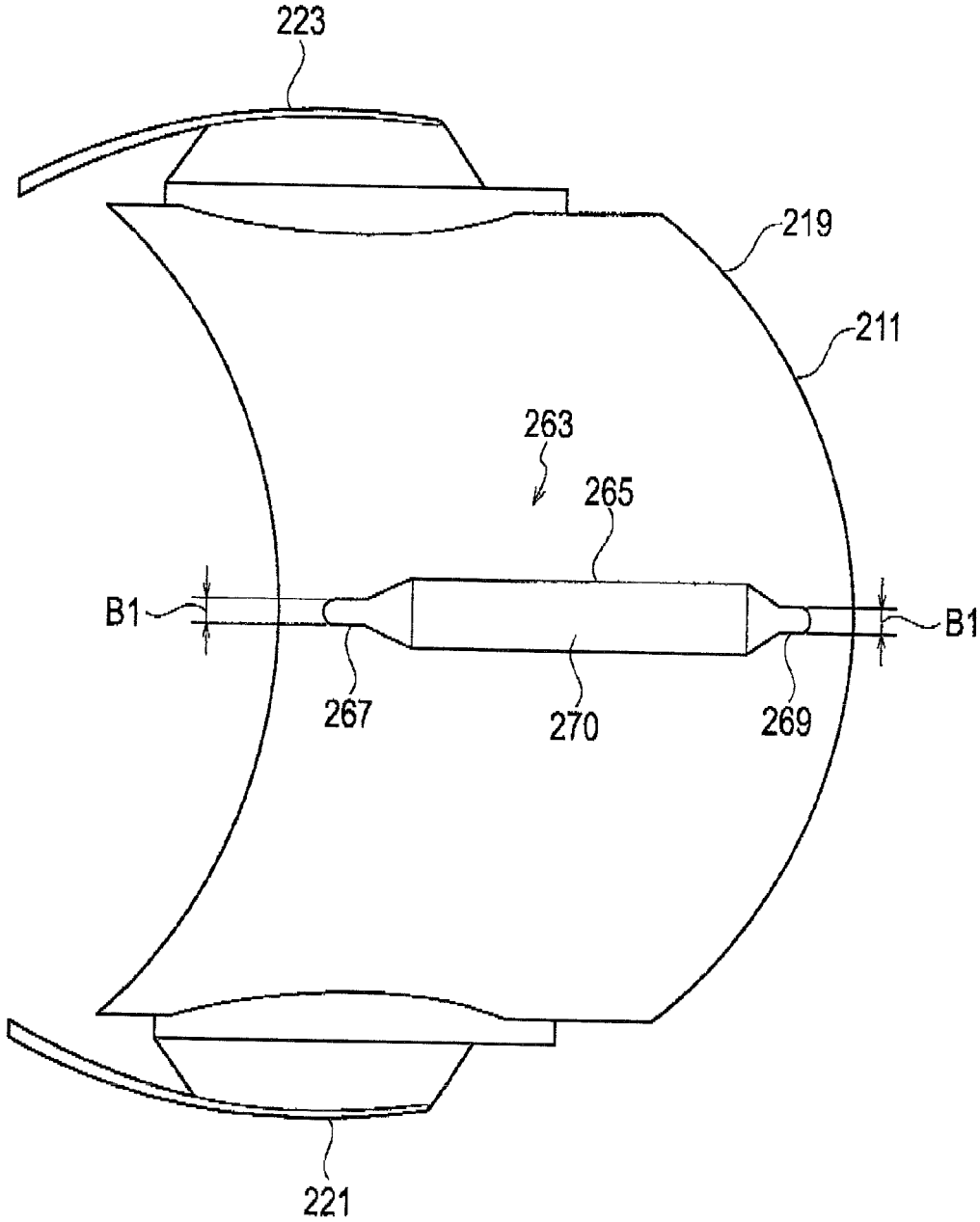
FIG. 26 is a drawing view from an arrow XXVI in FIG. 24.

FIG. 24 is an elevational view showing a summarized configuration of the guide member 211, FIG. 25 is a drawing viewed from an arrow XXV in FIG. 24, and FIG. 26 is a drawing view from an arrow XXVI in FIG. 24.

The protective cap (helmet with a shield face) 201 is constituted to for example comprise a cap body 203 formed to be substantially bilaterally symmetrical, a shield plate 205, and a guide means 207 for guiding the shield plate 205.

The cap body 203 is to protect a head of a wearer, and is for example constituted of a resin or such to form a bowl form (semi-spherical-shell-like form).

The cap body 203 is formed in a "semi-spherical-shell-like" form and is thus not formed in a perfect semi-spherical shell form. More specifically, the cap body 203 is formed in a shape in which the curvature radius properly changes to fit it with a shape of a head of a wearer. Further an opening portion (an edge; a lowermost end) 209 of the cap body 203 is not a perfect circular shape and is formed in a circle-like shape in which the curvature radius properly changes to fit it with a shape of a head of a wearer.

As the cap body 203 is formed in a semi-spherical-shell-like form, the external surface and the internal surface of the cap body 203 are formed in a smooth spherical-surface-like shape in which sharply curved portions do not exist. Further, as the cap body 203 is formed in a semi-spherical-shell-like form, the opening portion 209 of the cap body 203 becomes substantially horizontal and the opening portion 209 positions at the slightly upper side than wearer's ears when a standing upright wearer wears the protective cap 201 (see FIG. 8-FIG. 13). Meanwhile, a visor portion 210 is provided at the front side of the opening portion 209 of the cap body 203.

The shield plate (face body; a shield member) 205 is, like as the shield plate 5, to protect almost all of a face of a wearer and is constituted of a transparent (including colored transparency) or translucent material such as a resin.

The guide means 207 is a means for guiding the shield plate 205 at a time when the shield plate 205 moves relative to the cap body 203, and it is so structured that the shield plate 205 moves to draw a circle-like trajectory between the housing position P201 and the shielding position P203. The housing position P201 positioned at the upper side is a position where the shield plate 205 positioned at the lower side is housed in the front interior of the cap body 203, and the shielding position P203 is a position where the shield plate 205 covers almost all of a face of a wearer (a front surface of a head).

As well as the shield plate 205 guided by the guide means 207 is made unlikely to be separated from the cap body 203, the shield plate 205 does not move in the left-and-right direction but moves (swings) to have a predetermined axis C201 (see FIG. 10, FIG. 13 and FIG. 14) extending in the left-and-right direction of the protective cap 201 (cap body 203) as a pivotal center. The predetermined axis C201 extends through positions of left and right ears of a wearer in the left-and-right direction (a direction perpendicular to paper faces of FIG. 10, FIG. 13 and FIG. 14).

The guide means 207 is constituted to comprise guide portions 213 provided at the guide member 211 and engagement portions 215 provided at the shield plate 205 for example.

The guide portions 213 are formed in an arc-like form. In a state where the guide member 211 is installed in the cap body 203, the guide portion 213 has a predetermined axis C201 as its center and, is then provided integrally with the cap body 302 at the interior of the front side of the cap body 203. Further, the guide portions 213 are provided at both end portions in the lateral direction and the central portion of the guide member 211 for example.

The shield plate 205 is formed in a curved plate-like shape. At portions at both ends in the lateral direction and the central portion of the shield plate 205 for example, engagement portions 215 engaging with the guide portions 213 are provided. Further as the engagement portions 215 engage with the guide portions 213, the shield plate 205 moves between the housing position P201 and the shielding position P203.

Describing the state where the shield plate 205 positions at the housing position P201 in more detail, the shield plate 205 is not thoroughly housed in the interior of the cap body 203 in this state but a lowermost end portion (the lowermost end portion where a visor 217 is provided) of the shield plate 205 and its vicinities protrudes out of the lowermost end portion 209 of the cap body 203 (the opening portion of the front side of the cap body 203) downward. Meanwhile the visor (visor portion) 217 turns over at the lowermost end portion of the shield plate 205. More specifically, the visor 217 bends in its reverse direction (a direction falling apart from a face of a wearer) and then extends out. Thereby, even if a flying object hits the shield plate (the shield plate at the shielding position P203) 205, a situation in which the flying object slides on the shield plate 205 to contact a body of a wearer can be avoided.

Even if the lowermost end portion or its vicinities of the shield plate 205 projects out of the lowermost end portion 209 of the cap body 203 downward, it does not interfere with a wearer and the wearer can wear the protective cap 201 without being aware of existence of the shield plate 205 in his or her visual field. Further an uppermost end portion of the shield plate 205 is positioned at the vicinity of the top portion of the cap body 203. In the meantime, it is allowed to omit the visor 217 of the shield plate 205 and apply a configuration in which the shield plate 205 is thoroughly housed in the interior of the cap body 203 in a state where the shield plate 205 is positioned at the housing position P201.

In a state where the shield plate 205 is positioned at the shielding position P203, the lowermost end portion of the shield plate 205 is positioned below a chin of a wearer and then the shield plate 205 covers almost all of a face of the wearer. More specifically, when viewed from the front, all of the face of the wearer is covered with the shield plate 205 (see FIG. 11-FIG. 13). The uppermost end portion of the shield plate 205 is positioned in the interior of the cap body 203 in the vicinity of the lowermost end portion of the cap body 203 (the opening portion 209 of the front side of the cap body 203).

The guide member 211 is formed of a resin for example and is integrally constituted to comprise a first side portion 221 and a second side portion 223. A central portion 219 is formed in a plate-like shape (curved plate-like shape) to comprise a sphere-like curved surface. The first side portion 221 is integrally provided on the central portion 229 at one end portion side in the lateral direction of the central portion 219. The side portion 223 is integrally provided on the central portion 219 at another end portion side in the lateral direction of the central portion 219.

The first side portion 221 is constituted of a proximal end portion side portion (a portion at the central portion 219 side) 225 and a tip end portion side portion 227, and the second side portion 223 is likewise constituted of a proximal end portion side portion (a portion at the central portion 219 side) 229 and a tip end portion side portion 231. Further, on the respectively portions 225 and 229, parts of guide portions 213 are formed.

Further, a tip end portion side portion 227 of the first side portion 221 and a tip end portion side portion 231 of the second side portion 223 engage with the cap body 203 (in face contact with lower internal surfaces at sides of the cap body 203, for example) so that the guide member 211 is provided integrally with the cap body 211.

The shield plate 205 enters into a space formed among the cap body 203, the central portion 219 and the proximal portion side portions 225 and 229 of the respective side portions 221 and 223, thereby being housed in the cap body 203.

The tip end portion side portion 227 of the first side portion 221 is formed in a plate-like form (curved plate-like form) comprising a curved surface in face contact with the lower internal surface at one side of the cap body 203, and the tip end portion side portion 231 of the second side portion 223 is likewise formed in a plate-like form (curved plate-like form) comprising a curved surface in face contact with the lower internal surface at another side of the cap body 203.

The proximal end portion side portion 225 of the first side portion 221 is constituted to comprise a standing portion 233 and a connection portion 235. The standing portion 233 is formed in an elongated plate-like form so to have its lateral direction in a direction of standing to stand obliquely from the tip end portion side portion 227 of the first side portion 221 in an intersecting direction. The connection portion 235 is formed in an elongated plate-like form. One end portion in the lateral direction thereof is provided integrally with the central portion 219 and another end portion in the lateral direction thereof is provided integrally with the standing portion 233, thereby connecting the standing portion 233 with the central portion 219.

In a state where the guide member 211 is provided integrally with the cap body 203, the standing portion 233 stands in an obliquely forward direction from the internal surface of the cap body 203 (a direction to the interior of the cap body 203) and the connection portion 235 (respective surfaces in its thickness direction of the connection portion 235) extends in substantially front-and-rear and upper-and-lower directions.

Likewise the proximal end portion side portion 229 of the second side portion 223 is constituted of a standing portion 241 and a connection portion 243.

The guide portion 213 of the guide member 211 is constituted of an elongated slot 239 formed on the connection portion 235, an elongated slot 247 in an arc-like shape formed on the connection portion 243, a to-be-engaged portion 263 (a groove 265; a central portion of the central portion 219) formed to extend in the upper-and-lower direction of the guide member 211 at the central portion in the lateral direction of the guide member 211.

The engagement portion 215 of the shield plate 205 is constituted of respective engagement pieces 251,259 provided at both ends in the lateral direction of the shield plate 205 and a projection provided on the shield plate 205.

The engagement pieces 251,259 are formed like as the engagement pieces 51,59 in accordance with the first embodiment as shown in FIG. 6. Further, the engagement pieces 251,259 engage with to elongated slots 239,247 to form a sliding contraposition.

The projection 237 is provided integrally with the shield plate 205 to project inward into the interior (concave surface side) of the shield plate 205 at the central portion in the lateral direction of the shield plate 205, and at the uppermost end side in the upper-and-lower direction of the shield plate 205.

At both end portions in the longitudinal direction of the groove 265, portions 267,269 penetrating the guide member 211 are formed. At the central portion in the longitudinal direction of the groove 265, a guide concave portion 270 in an elongated plate-like shape dented toward the inside of the guide member 211 is formed. Further, as the engagement piece 251 engages with the elongated slot 239, the engagement piece 259 engages with the elongated slot 247, and a tip end portion of the projection 237 engages with the guide concave portion 270 to form a sliding contraposition, the shield plate 205 is guided to move.

It has a double structure in which the cap body 203 is disposed outside and the guide member 211 is disposed inside in the front of the protective cap 201 as shown in FIG. 14 when the guide member 211 is installed in the interior of the cap body 203. Then the shield plate 205 enters in between the cap body 203 and the guide member 211.

When the guide member 211 is installed in the cap body 203, a center of the arc-like elongated slot 239(247) of the connection portion 235(243) corresponds with a center of a predetermined axis C201 (see FIG. 10, FIG. 13 and FIG. 14). Thus the shield plate 205 is made to swing to have the predetermined axis C201 as its center.

Further, a cross section of the central portion 219 of the guide member 211 (a cross section shown in FIG. 14) is formed in an arc-like shape, a center of which is the predetermined axis C201. Further, a cross section of the shield plate 205 (a cross section shown in FIG. 14) is formed in an arc-like shape having a predetermined axis C203 as its center. The predetermined axis C203 runs in parallel with the predetermined axis C201 and is positioned slightly upward and rearward relative to the predetermined axis C201.

A curvature radius of the central portion 219 of the guide member 211 is made larger than a curvature radius of the elongated slot 239(247), and a curvature radius of the central portion 219 of the guide member 211 and a curvature radius of the shield plate 205 are substantially equal to each other.

Further, in the cross section shown in FIG. 14, in a case where the shield plate 205 is positioned at the housing position P201, the uppermost end portion of the central portion 219 of the guide member 211 and the uppermost end portion of the shield plate 205 are positioned at the upper side of the cap body 203 in the upper-and-lower direction of the cap body 203, and positioned at the central portion of the cap body 203 in the front-and-rear direction of the cap body 203. Further, the lowermost end portion of the central portion 219 of the guide member 211 and the lowermost end portion of the shield plate 205 are positioned in the vicinity of the lowermost end portion at the front of the cap body 203.

Further, the protective cap 201 is provided with a retaining means 261 for retaining the shield plate 205. The retaining means 261 is to retain the shield plate 205 not to readily move the shield plate 205 relative to the cap body 203 when the shield plate 205 is positioned at the housing position P201 or the shielding position P203.

The retaining means 261 is for example constituted of a projection 237 provided on the shield plate 205 and a to-be-engaged portion 263 provided on the guide member 211. The to-be-engaged portion 263 is constituted to comprise a groove 265 formed to extend in the upper-and-lower direction of the guide member 211 at the central portion in the lateral direction of the guide member 211.

The portion 267 at the side of one end portion (uppermost end portion) in the longitudinal direction in the guide groove 265 is formed to have a width B1 narrower than the central portion, and the portion 269 at the aide of another end portion (lowermost end portion) in the longitudinal direction in the guide groove 265 is also likewise formed to have a narrow width B1. Further, the outer diameter D1 of the column-like projection 237 provided on the shield plate 205 is formed to be slightly larger than the width B1.

Further, when the shield plate 205 is positioned at the housing position P201, the projection 237 enters into the portion 267 at the side of the uppermost end portion, thereby the shield plate 205 is made not to easily move. Moreover, when the shield plate 205 is positioned at the shielding position P203, the projection 237 enters into the portion 269 at the side of the lowermost end portion, thereby the shield plate 205 is made not to easily move.

By the way, the protective cap 201 is provided with a not-shown interior body (a hammock for example), and the cap body 203 and the guide member 211 are provided with a plurality of locking portions 271 for locking the hammock. Among the locking portions 271, the respective locking portions 271A are provided on the internal surface of the cap body 203 in an integral manner, and the respective locking portions 271B positioned at the front side are provided on the internal surface of the guide member 211 in an integral manner.

The shield plate 205 will be described in more detail hereinafter.

The shield plate 205 is, as described above be installed in the cap body 203 for protecting a head of a wearer and cover almost all of a face of the wearer, and is formed in a curved plate-like shape of a transparent body or a translucent body.

The shield plate 205 is formed in a curved plate-like shape with a convex shape at one side in the thickness direction and a concave shape at another side in the thickness direction. Further, the thickness is gradually reduced from a central portion toward a periphery portion (see FIG. 22 and FIG. 23). Meanwhile the shield plate 205 is constituted of a resin such as acryl or polycarbonate, and is formed by injection molding. Further the shield plate 205 is formed in accordance with the ANSI regulation into a thickness about from 1.6 mm to 2.0 mm. It is made unbreakable even if it is subject to a high-speed impact test.

As the shield plate 205 is formed in a curved plate-like shape, the internal surface (one surface in the thickness direction) of the shield plate 205 opposed to a face of a wearer is formed into a concave shape and the external surface as another surface in the thickness direction is formed into a convex shape. Further, the shield plate 205 is so formed that the curvature radius in the left-and-right direction is smaller than the curvature radius in the upper-and-lower direction and also a ratio of change in thickness in the left-and-right direction is made larger than a ratio of change in thickness in the upper-and-lower direction (see FIG. 22 and FIG. 23). Meanwhile a center of the arc in the upper-and-lower direction of the shield plate corresponds with the axis C203. On the other hand, a center of an arc in the left-and-right direction of the shield plate 205 substantially corresponds with an axis through a center of the opening portion 209 of the cap body 203, for example.

Further the shield plate 205 is constituted to comprise a main body portion 273 and a visor portion 217, and the main body portion 273 is formed in a curved plate-like shape as described above. The convex surface (concave surface) of the main body portion 273 of the shield plate 205 is formed in a predetermined shape close to a predetermined three-dimensional curved surface. The aforementioned three-dimensional curved surface is one of four three-dimensional curved surfaces obtained from a side surface of a barrel-like solid which is a columnar shape with a swelling central portion in the axial direction by cutting it in a first plane including the axis and a second plane including the axis and intersecting the first plane in a predetermined angle.

Meanwhile, as shown in FIG. 19, the uppermost end of the main body portion 273 of the shield plate 205 and both ends in the left-and-right direction are formed in linear shapes when viewed from the front, and the lowermost end of the main body portion 273 of the shield plate 205 is formed in a downward convex arc-like shape.

The visor 217 is as described above bent as opposed to the main body portion 273 below the main body portion 273 and projects.

As described in more detail, the visor portion 217 is as shown in FIG. 19 formed in a crescent shape when viewed from the front and in a plate-like shape, and a portion formed in a convex shape in the crescent shape connects with the lowermost end of the main body portion 273 of the shield plate 205 and then projects downward from the lowermost end of the main body portion 273 to be integral with the main body portion 273. Further, as shown in FIG. 20 (FIG. 13), when a upright wearer wears the cap body 203 and covers his or her face with the shield plate 205, the visor portion 217 projects toward to gradually fall apart (forward) from the face of the wearer from the uppermost end (the end at the side of the main body 273) toward the lowermost end.

Further, at the central portion in the lateral direction of the visor portion 217, a concave portion 275 dented into the interior of the main body portion 273 (to the rear: to a face of a wearer) with a predetermined width is formed.

Operation for getting the shield plate 205 in and out when wearing the protective cap 201 will be described hereinafter.

First, in a state where the shield plate 205 is positioned at the shielding position P201, a wearer wears the protective cap 201. In a case where he or she needs to position the shield plate 205 at the shielding position P203 and then work, he or she pulls the lowermost end portion (the visor portion 217 for example) of the shield plate 205 downward so as to move the shield plate 205 downward, the projection 237 enters into the portion 269 at the lowermost end portion side of the guide groove 265 and then the shield plate 205 is positioned at the shielding position P203, thereby the shield plate 205 is made not to easily move from the shielding position P203.

On the other hand, in a case where he or she seeks to change the shield plate 205 at the shielding position P203 into the housing position P201, he or she pushes the shield plate 205 upward so as to move it upward, the projection 237 enters into the portion 267 at the uppermost end side of the guide groove 265, then the shield plate 205 is positioned at the housing position P201, thereby the shield plate 205 is made not to easily move from the housing position P201.

According to the protective cap 201, as the shield plate 205 has a configuration in that its thickness is gradually reduced from the central portion toward the peripheral portions, a difference between an optical path length (an optical path length in the shield plate) in a case where a wearer see the front via the shield plate 205 and an optical path length (an optical path length in the shield plate) in a case where the wearer see peripheries via the shield plate 205 can be made smaller. Even if a wearer see a matter via peripheral portions of the shield plate 205, distortion of images can be made as small as possible.

Figure 27:
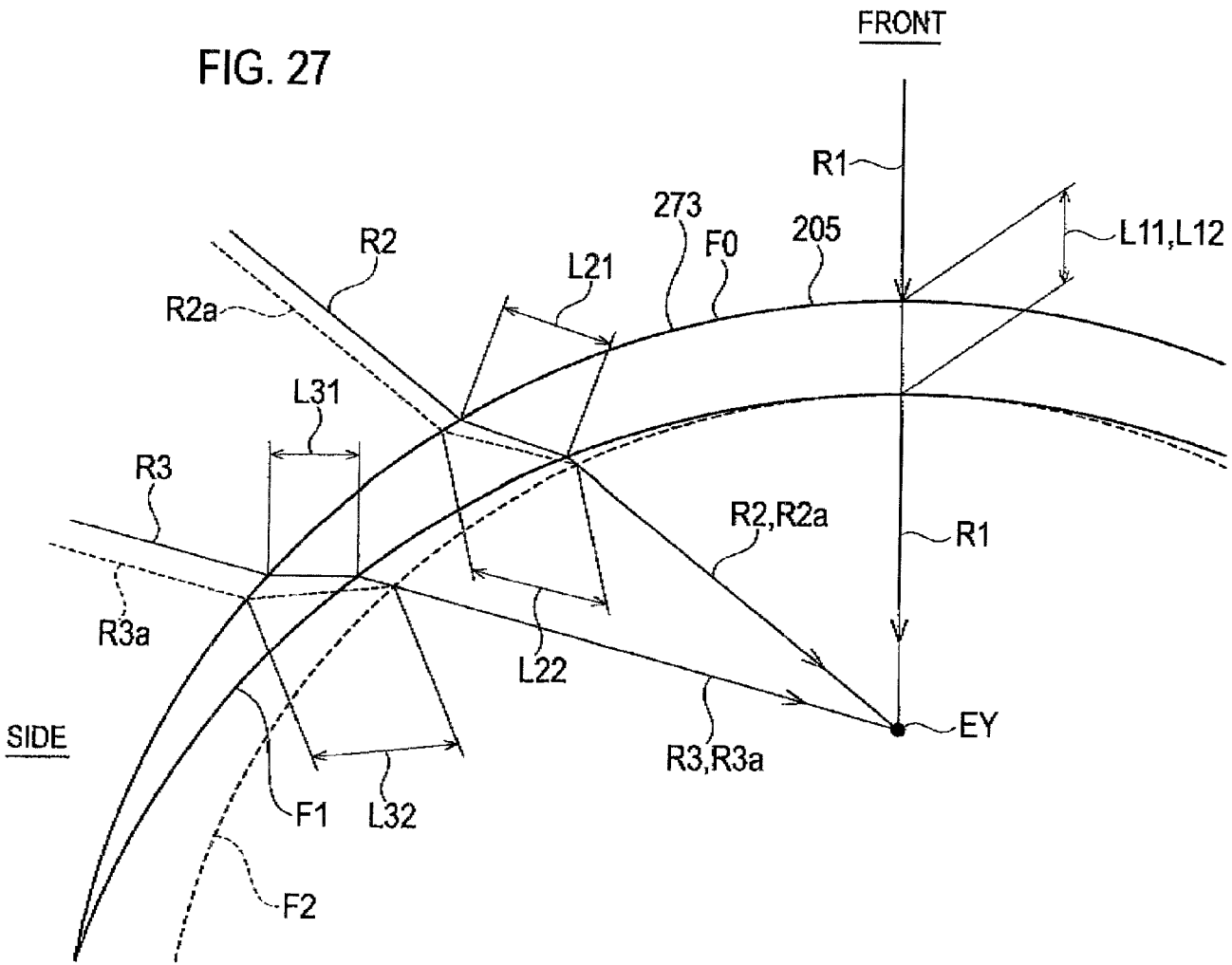
FIG. 27 is a drawing showing a cross section of the shield plate 205 and also corresponding to FIG. 23.

More specifically, as shown in FIG. 27 (the drawing showing the cross section of the shield plate 5 and corresponding to FIG. 23), as a difference between the optical path length L11 and the optical path length L21 in the shield plate 205 is made smaller and a difference between the optical path length L11 and the optical path length L31 is made smaller, distortion of images can be made as small as possible.

Here, the reference sign F0 shown in FIG. 27 denotes a surface (convex surface) at the outside of the shield plate 5 in accordance with the present embodiment, and the reference sign F1 denotes a surface (concave surface) at the inside of the shield plate 205 in accordance with the present embodiment. Thereby the thickness of the shield plate 205 in accordance with the present embodiment gradually gets thinner from the central portion toward the peripheral portion. On the other hand, the reference sign F0 denotes a surface at the outside of the conventional shield plate and the reference sign F2 denotes a surface at the inside of the conventional shield plate, thereby the thickness of the conventional shield plate is constant.

The reference sign R1 denotes an optical path of light impinging from the front onto an eye EY of a wearer, the reference signs R2, R2*a* denote optical paths of light impinging from sides (peripheral portions of the shield plate) onto the eye EY of the wearer, and the reference signs R3, R3*a* denote optical paths of light impinging from sides further away onto the eye EY of the wearer.

The optical path length L11 of the light (the light through the optical path R1) from the front onto the eye EY of the wearer in the shield plate 205 and the optical path length (the optical path length in the conventional shield plate) L12 are equal to each other.

On the other hand, because the shield plate has a considerably large refractive index as compared with that of air, on the basis of the Snell's law, the optical path length (the optical path length in the shield plate 205 in accordance with the present embodiment) L21 is made shorter than the optical path length (the optical path length in the conventional shield plate) L22 in the shield plate by light from the side surfaces to the eye EY of the wearer (light in the optical path R2, R2*a*), and the optical path length L21 is substantially equal to the optical path length L11. Likewise, the optical path length L31 is made shorter than the optical path length L32 and the optical path length L31 is substantially equal to the optical path length L11. Thereby it allows that distortion of images is made as small as possible.

Further, in accordance with the protective cap 201, as the curvature radius of the shield plate 205 in the left-and-right direction is formed smaller than the curvature radius in the upper-and-lower direction and the rate of change in thickness in the left-and-right direction is formed larger than the rate of change in thickness in the upper-and-lower direction, distortion of images when a wearer see objects via peripheral portions of the shield plate 5 can be made as small as possible according to a shape of a face of the wearer.

More specifically, as the curvature radius in the upper-and-lower direction of the shield plate 205 is made larger than the curvature radius in the left-and-right direction, it fits with the shape of the face of the wearer to cover the face of the wearer. Further, as the curvature radius in the upper-and-lower direction of the shield plate 205 is made larger than the curvature radius in the left-and-right direction, the rate of change in thickness in the upper-and-lower direction of the shield plate 205 is made smaller than the rate of change in thickness in the left-and-right direction, distortion of images is made as small as possible.

Further according to the protective cap 201, as the visor portion 217 of the shield plate 205 is bent to project in a direction opposed to the main body 273 (a direction falling apart from a face of a wearer) below the main body 273, as described above, even if a flying object hits the shield plate 205, a situation in which the flying object slides on the shield plate 5 to contact a body of a wearer can be avoided.

More specifically, as shown in FIG. 13 by an arrow A13, if a flying object flying from a direction obliquely forward collides with the lower part of the shield plate 205 in a shallow angle, it gives rise to a case where the aforementioned flying object colliding and bouncing back reaches a breast or a stomach of the wearer. Meanwhile, as a wearer in FIG. 13 turns in a horizontal direction, the aforementioned suspicion is not so considerable, however, when he or she works with keeping his or her face upward, a suspicion in which a flying object colliding and bouncing back reaches a breast or a stomach under influence of the gravity. However, as the visor portion 217 is provided, the flying object colliding and bouncing back is made to re-collide with the visor portion 217 and then falls down to any sites apart from the wearer. It can be avoided that it reaches the body of the wearer.

Further, according to the protective cap 201, as the concave portion 275 is provided, a wearer of the protective cap 201 can conveniently operate the shield plate 205.

More specifically, in a state where the shield plate 205 exists at the housing position P201 for example, as the concave portion 275 is provided on the visor 217 of the shield plate 205, a gap into which a wearer can put his or her fingers is held between the visor portion 217 of the shield plate 205 and the visor portion 210 of the cap body 203. Further, the shield plate 205 existing at the housing position P201 is easily moved downward and then can be made positioned at the shielding position P203.

Further according to the protective cap 201, as the shield plate 205 is steadily installed in the cap body 205 and the guide means 207 makes the shield plate 205 swing with having the predetermined axis C201 as its center failure to attach the shield plate 205 is prevented and the movement stroke of the shield plate 205 is elongated with keeping the conventional shape and without making the cap body 203 bigger. Further, although the length (height) of the shield plate 205 is sufficiently long to cover almost all of a face of a wearer, the shield plate 205 can be substantially housed in the interior of the cap body 203 not to interfere with the wearer.

Further, as the cap body 203 is formed in a semi-spherical-shell-like shape from which portions to cover ears of a wearer are removed, the protective cap 201 is small-sized and then its weight is reduced, and further it gives a feeling of being liberated to the wearer.

Further, in accordance with the protective cap 201, as the shield plate 5 is guided by the arc-like guide portion 213 to move to draw a trajectory of an arc-like shape, the movement stroke of the shield plate 205 can be further elongated and, although the shield plate 205 having a sufficient length to cover almost all of a face of a wearer is used, it is made further easier to substantially house the shield plate 205 in the interior of the cap body 203 not to interfere with the wearer.

Further in accordance with the protective cap 201, as the guide portion 213 in the arc-like shape is formed in the arc-like shape having the predetermined axis C201 as its center and then provided in the interior of the cap body 203, the cap body 203 in the semi-spherical-shell-like shape which does not cover ears of a wearer can be used. More specifically, if it has a configuration in which the shield plate 205 is made supported by the cap body at the predetermined axis C201, a swinging axis for supporting the shield plate 205 (an axis positioned at the axis C201 of the shield plate 205) needs to be additionally provided, thereby ear portions (portions to cover ears of a wearer) or such are necessary to be provided in the cap body 203 and therefore the cap body 203 must not be made in a semi-spherical-shell-like shape. However, the protective cap 201 allows it not to have the cap body 203 provided with the ear portions and make a shape of the cap body 203 be in a semi-spherical-shell-like shape.

Further, in accordance with the protective cap 201, as the guide member 211 is integrally constituted and also made contact with the cap body 203 at two portions in the left-and-right direction of the cap body 203 to be integrally provided, stiffness of the guide member 211 of itself and attachment stiffness when the guide member 211 is attached to the cap body 203 are increased.

Further, the locking portion 271B for locking the hammock constituting the interior body can be provided in the interior of the central portion 219 of the guide member 211 so as not to interfere with the shield plate 205 of the guide portion 213.

Meanwhile, as the shield plate, that of a half type covering an upper half of a face of a wearer can be used. Further in the first embodiment the shield plate 5 may be formed likewise as the shield plate 5 in accordance with the second embodiment. More specifically, it can be formed in a shape in which thickness is gradually made thinner from the central portion toward the peripheral portion.

Third Embodiment

What differs in a protective cap 501 in accordance with a third embodiment of the present invention from the protective cap 1 in accordance with the first embodiment and the protective cap 201 in accordance with the second embodiment is mainly a configuration of a guide means 505 for guiding a shield plate 503, and, in other points, it is constituted in substantially the same way as the protective cap 1 in accordance with the first embodiment and the protective cap 201 in accordance with the second embodiment and further it serves substantially the same effects.

The shield plate 503 guided by the guide means 505 is constituted in substantially the same way as those of the respective embodiments (the second embodiment for example). Like as the protective cap 1 in accordance with the first embodiment and the protective cap 201 in accordance with the second embodiment a concave portion 275 and a visor 217 are provided and are made to move between a housing position P501 and a shielding position P503 as having an axis C501 as its swinging center.

Figure 28:
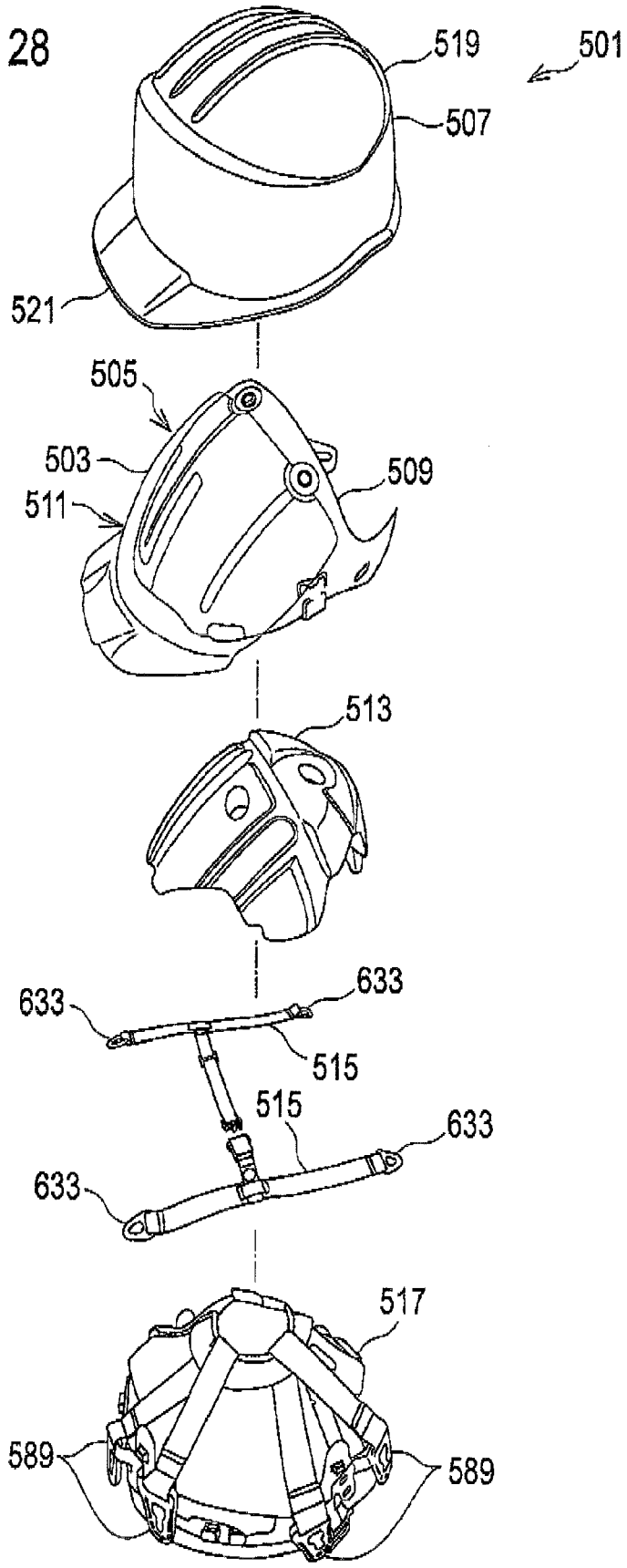
FIG. 28 is an exploded perspective view showing a summarized configuration of a protective cap in accordance with a third embodiment of the present invention.

FIG. 28 is an explosive perspective view showing a summarized configuration of the protective cap 501 in accordance with the third embodiment.

The protective cap 501 in accordance with the third embodiment is constituted to comprise a guide member 509 constituting a cap body 507 and a guide means 505, a shield plate 503, a shock absorbing member (a shock absorbing liner) 513, a chin-strap 515, and an interior body (hammock) 517. The shock absorbing member 513 is for example formed of a foamed polystyrene in a bowl-like shape. Further, inside the cap body 507, after installing an assembly 511 of the guide member 509 and the shield plate 503 in the cap body 507, by installing the shock absorbing member 513 in the inside of the cap body 507 and the assembly 511, and thereafter installing the chin-strap 515 and the hammock 517 in the cap body 507 and the guide member 509, then the protective cap 501 is assembled and then generated.

Meanwhile, in the protective cap 1 in accordance with the first embodiment and in the protective cap 201 in accordance with the second embodiment, a shock absorbing member and a chin-strap are not mentioned, however, in the protective cap 1 in accordance with the first embodiment or in the protective cap 201 in accordance with the second embodiment, a configuration in which a shock absorbing member and a chin-strap is provided may be applied.

Figure 36:
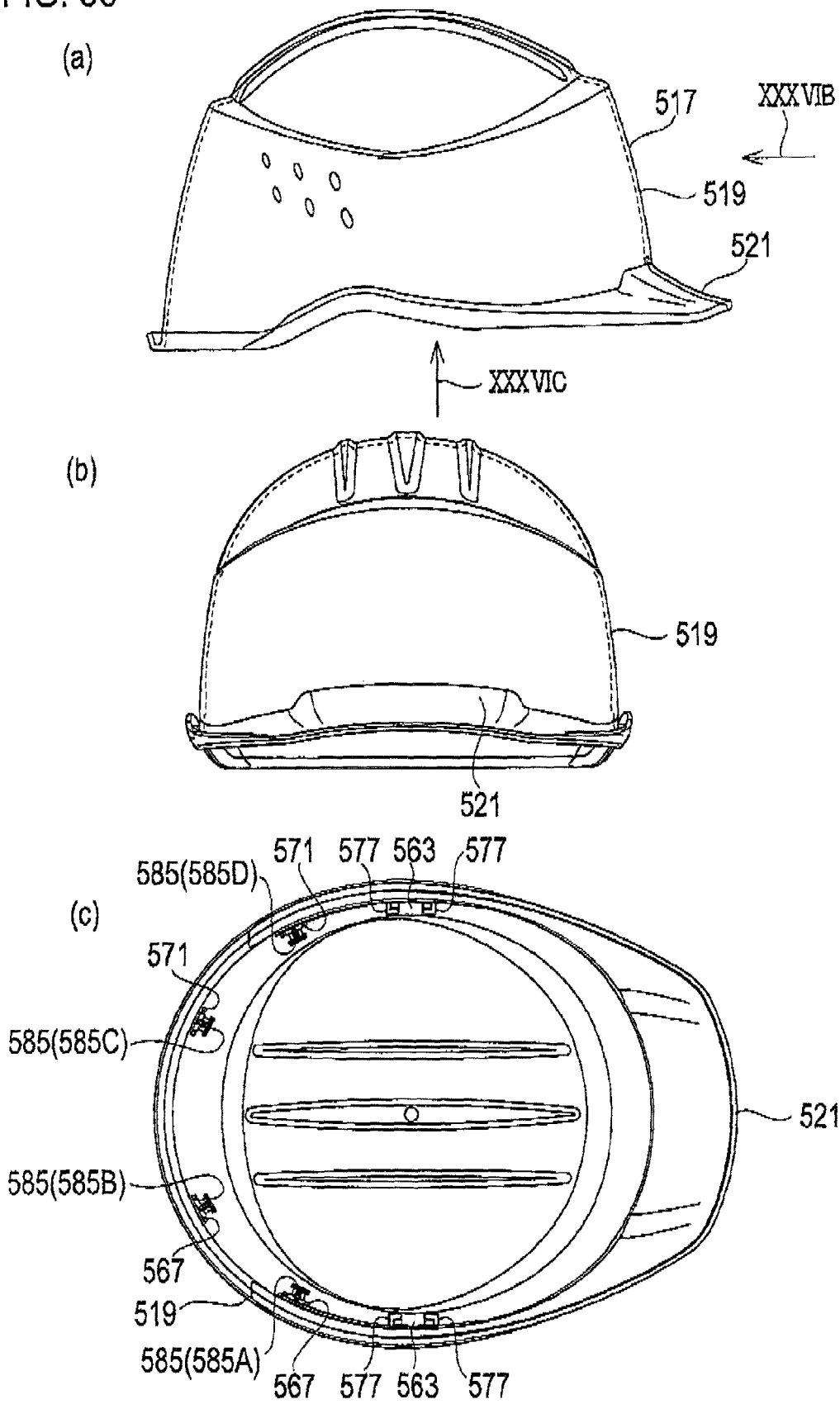
FIG. 36 is a drawing showing a summarized configuration of a cap body.

The cap body 507 is constituted in substantially the same way as the cases of the protective cap 1 in accordance with the first embodiment and the protective cap 201 in accordance with the second embodiment. More specifically, the protective cap 507 is to protect a head of a wearer and is for example constituted of a material such as resin and formed in a bowl-like shape (a semi-spherical-shell-like shape for example) as shown in FIG. 36 (a drawing showing a summarized, configuration of the cap body 507). Meanwhile, FIG. 36(*a*) is a side view of the cap body 507, FIG. 36(*b*) is an elevational view of the cap body 507 and also a view viewed from an arrow XXXVIB in FIG. 36(*a*), and FIG. 36(*c*) is a bottom view of the cap body 507 and also a view viewed from an arrow XXXVIC in FIG. 36(*a*).

The cap body 507 of the protective cap 501 is constituted of a cap body main body portion 519 and a cap body visor portion 521, and is formed in two colors for example. The cap body main body portion 519 is constituted of an opaque resin, and the cap body visor portion 521 is constituted of a transparent (including colored transparency) resin or a translucent resin. In the protective cap 1 in accordance with the first embodiment and in the protective cap 201 in accordance with the second embodiment, the cap body may be constituted of a cap body main body portion and a cap body visor portion.

The shield plate 503 is, as described above, constituted in substantially the same way as the protective cap 201 in accordance with the second embodiment for example, except the portion related to the guide means 505 (a portion engaging with the guide member 509).

The guide means 505 will be described in detail hereinafter.

Figure 29:
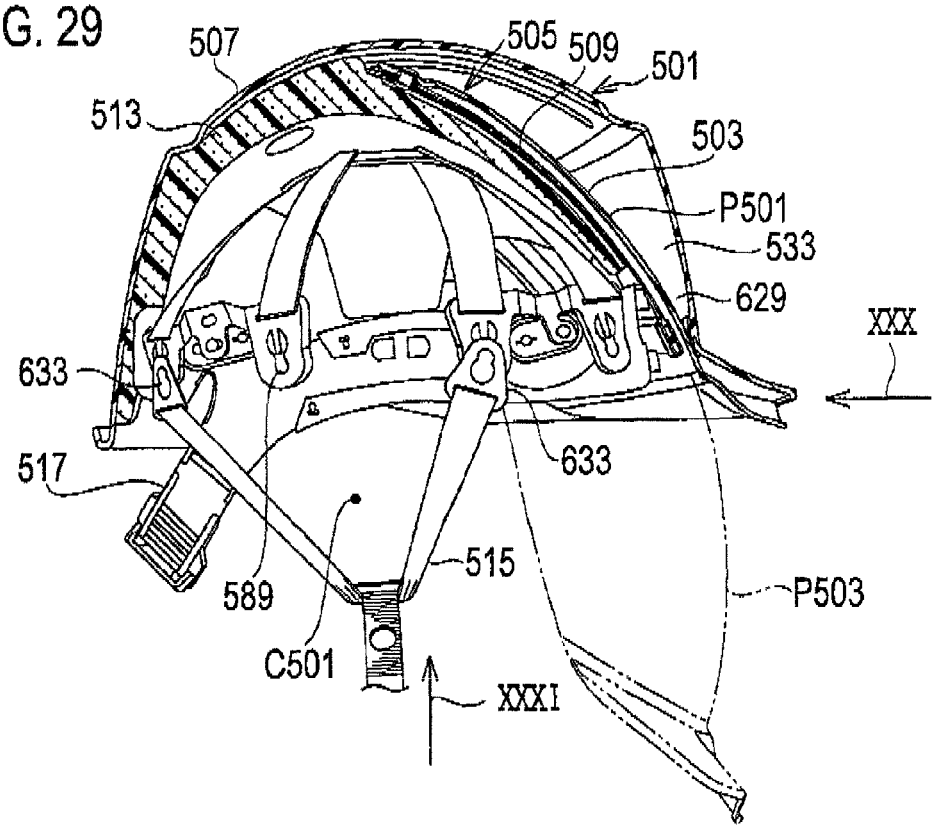
FIG. 29 is a cross sectional view showing a summarized configuration of the protective cap.
Figure 30:
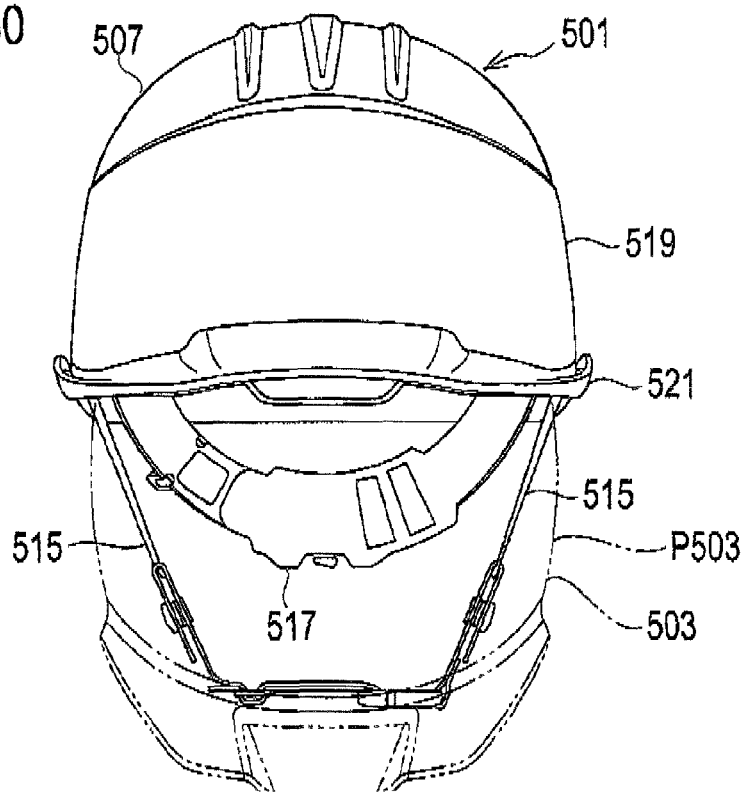
FIG. 30 is an elevational view of the protective cap and also viewed from an arrow XXX in FIG. 29.
Figure 31:
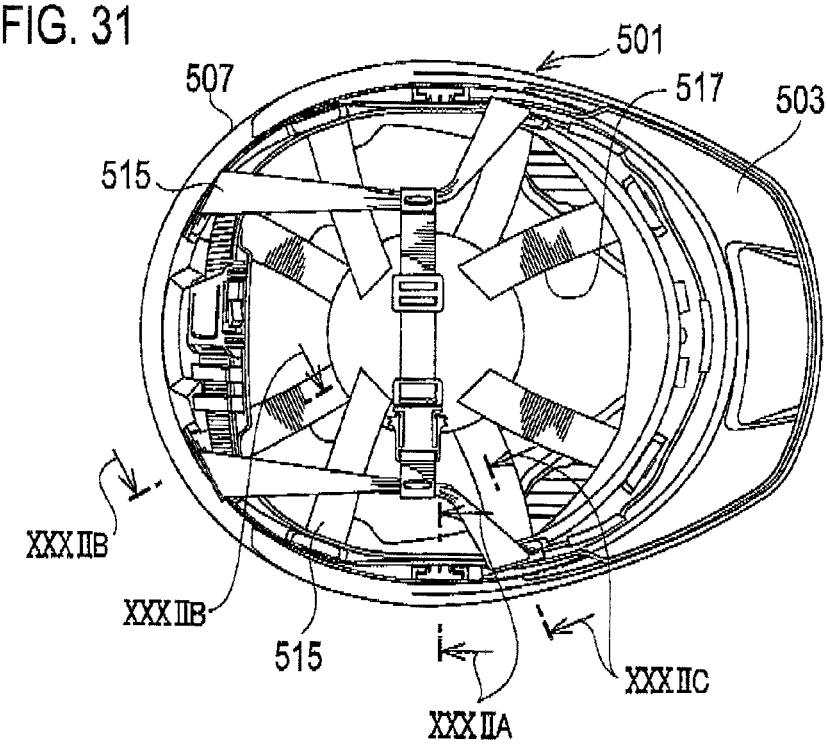
FIG. 31 is an elevational view of the protective cap and also viewed from an arrow XXXI in FIG. 29.

FIG. 29 is a cross sectional view showing a summarized configuration of the protective cap, FIG. 30 is an elevational view of the protective cap and also viewed from an arrow XXX in FIG. 29, and FIG. 31 is an elevational view of the protective cap and also viewed from an arrow XXXI in FIG. 29.

Figure 33:
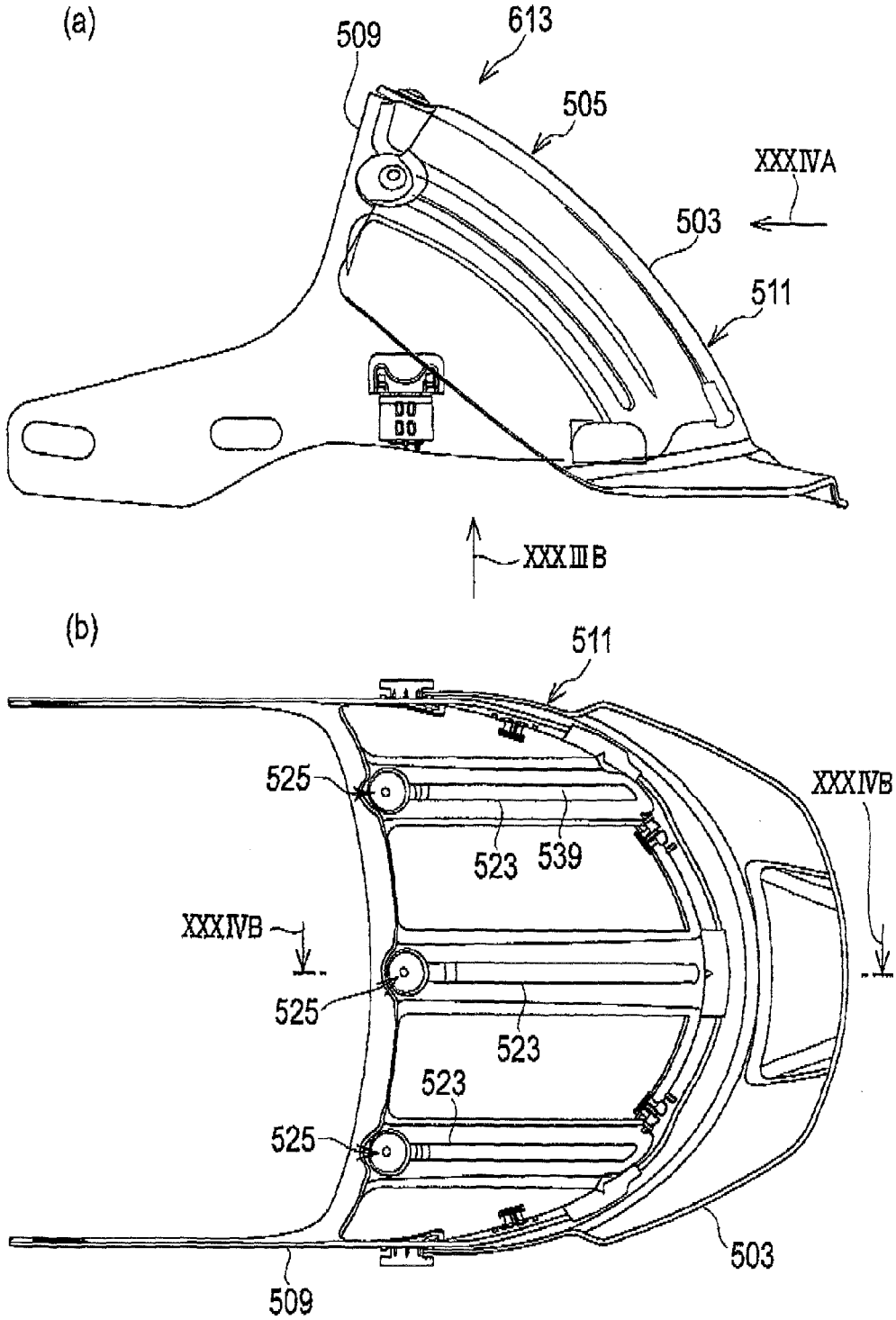
FIG. 33 is a drawing showing an assembly of the guide member and the shield plate.
Figure 34:
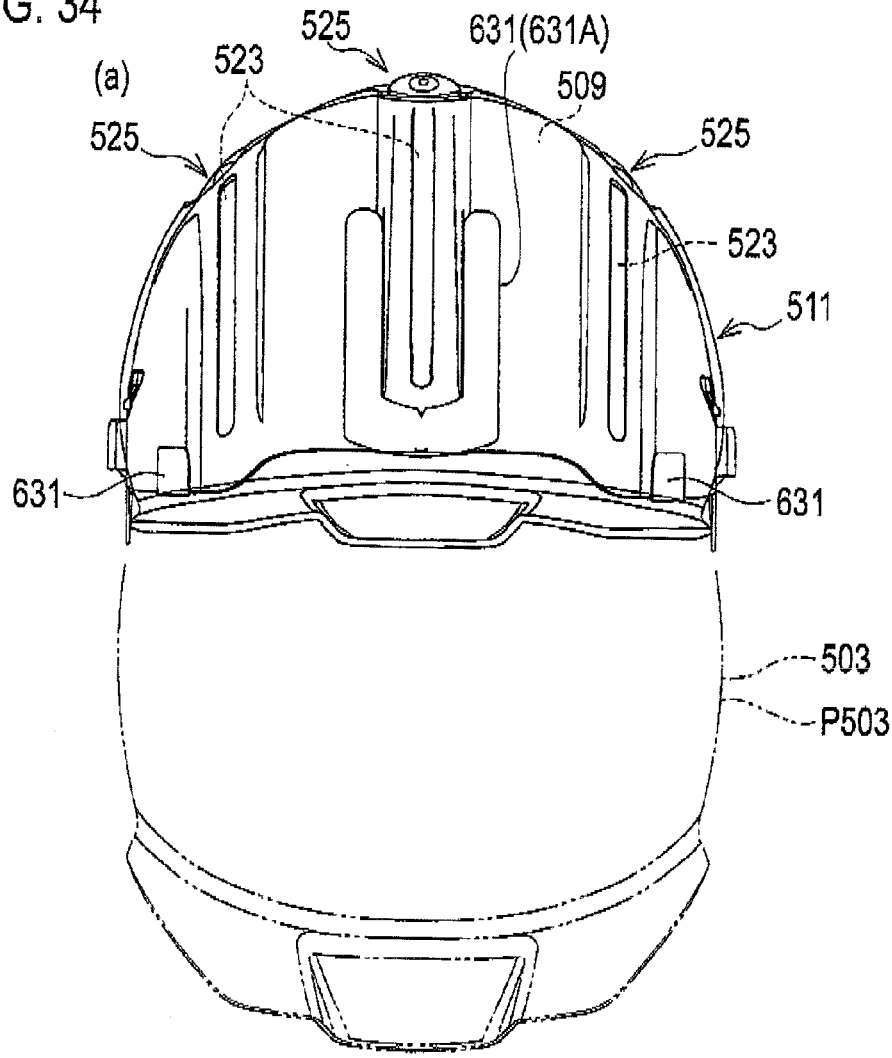
FIG. 34 is a drawing showing an assembly of the guide member and the shield plate.
Figure 34:
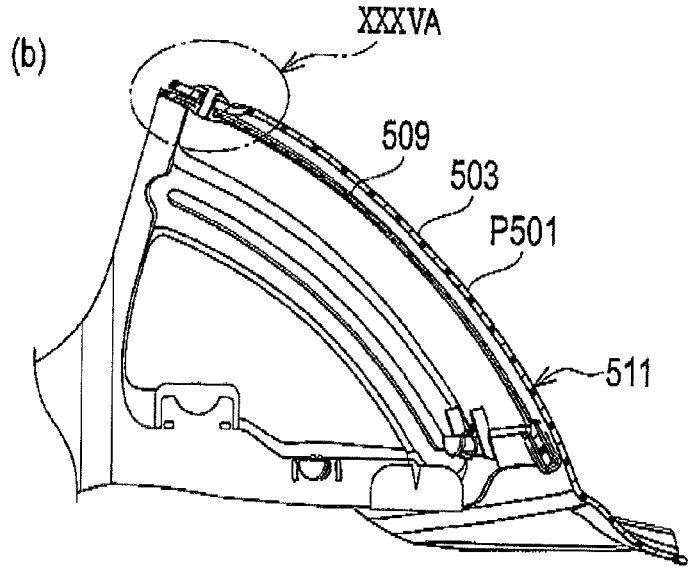

FIG. 33 and FIG. 34 are drawings showing an assembly 511 of the guide member 509 and the shield plate 503, FIG. 33(*a*) is a side view of the assembly 511, FIG. 33(*b*) is a bottom view of the assembly 511 and also a view viewed from an arrow XXXIIB in FIG. 33(*a*), FIG. 34(*a*) is an elevational view of the assembly 511 and also a view viewed from an arrow XXXIVA in FIG. 33(*a*), and FIG. 34(*b*) is a view taken from a cross section XXXIVB-XXXIVB in FIG. 33(*b*).

Figure 35:
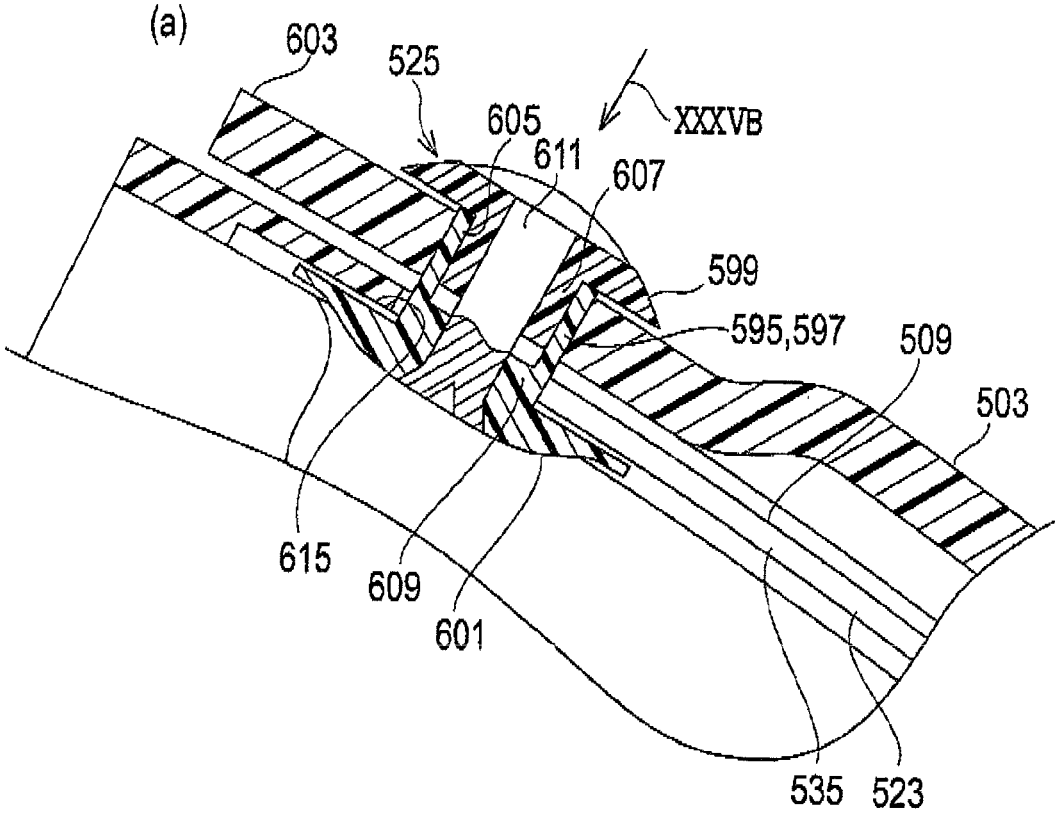
FIG. 35 is a drawing showing details of a guide portion or such in the guide member.
Figure 35:
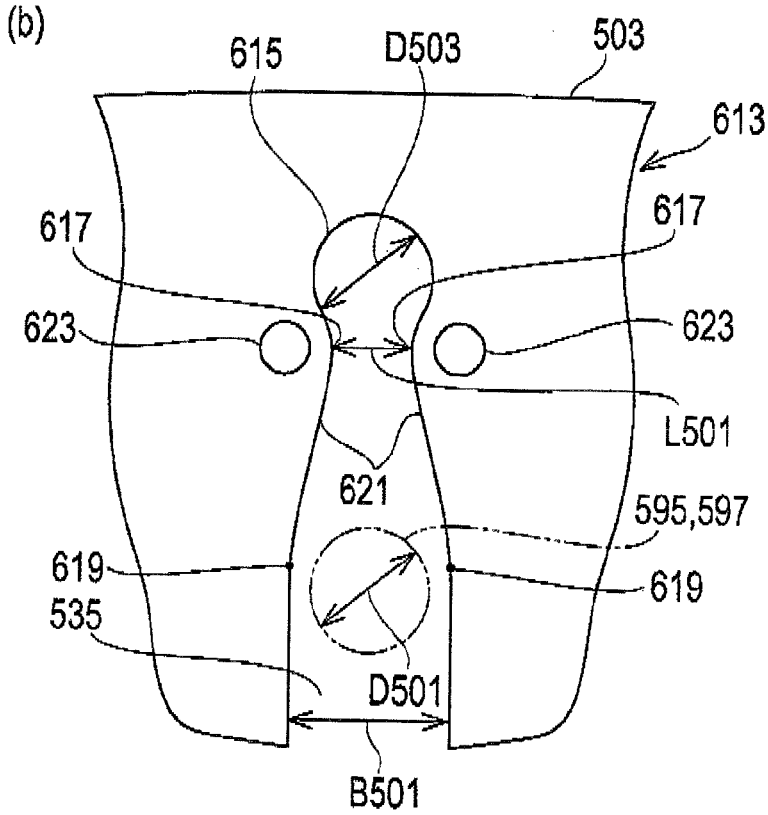

FIG. 35 is a drawing showing details of a guide portion or such in the guide member. FIG. 35(*a*) is an enlarged view of a part XXXVA in FIG. 34(*b*). FIG. 35(*b*) is a drawing viewed from an arrow XXXVB in FIG. 35(*a*), or an enlarged view of a part XXXVB in FIG. 39(*b*). Meanwhile, whereas the shield plate 503 and such are drawn in FIG. 35(*a*), showing of the shield plate 503 and such is omitted in FIG. 35(*b*) and only the guide member 509 is drawn therein.

Figure 39:
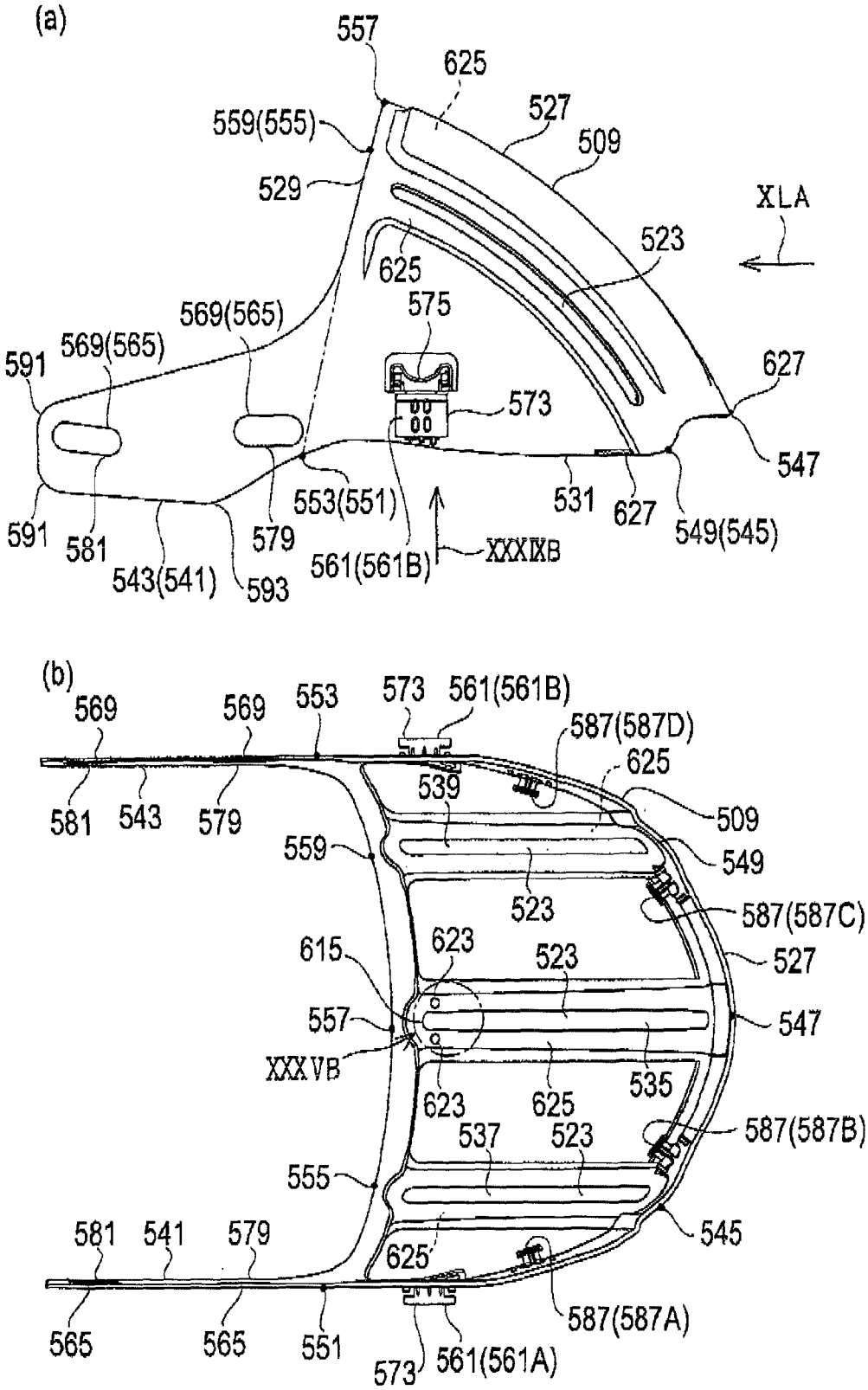
FIG. 39 is a drawing showing a guide member.
Figure 40:
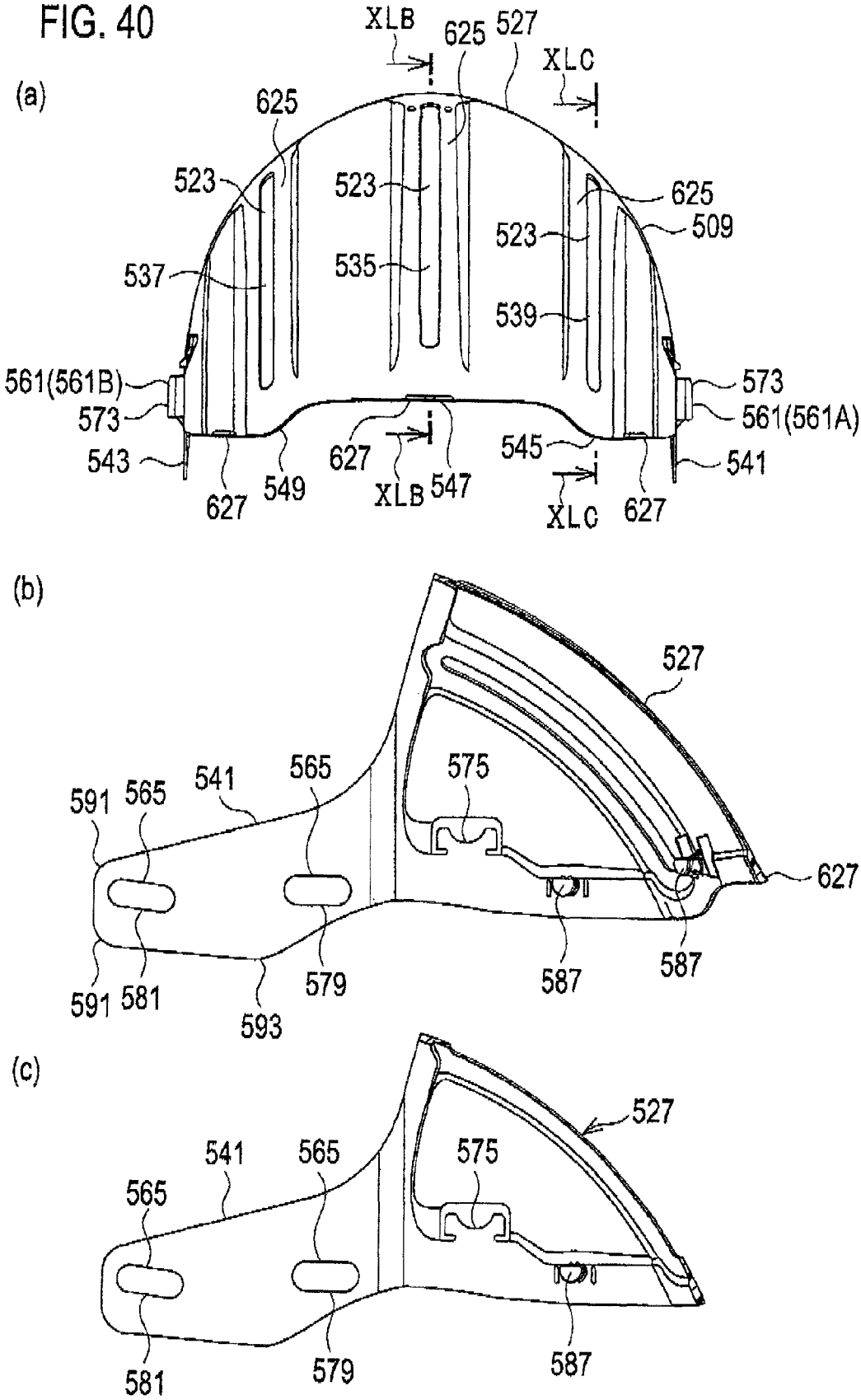
FIG. 40 is a drawing showing a guide member.

FIG. 39 and FIG. 40 are drawings showing the guide member 509, FIG. 39(*a*) is a side view of the guide member 509, FIG. 39(*b*) is a plan view of the guide member 509 and also a view viewed from an arrow XXXIXB in FIG. 39(*a*), FIG. 40(*a*) is an elevational view of the guide member 509 and also a view viewed from an arrow XLA, in FIG. 39(*a*), FIG. 40(*b*) is a drawing showing a cross section XLB-XLB in FIG. 40(*a*), and FIG. 40(*c*) is a drawing showing a cross section XLC-XLC in FIG. 40(*a*).

Figure 42:
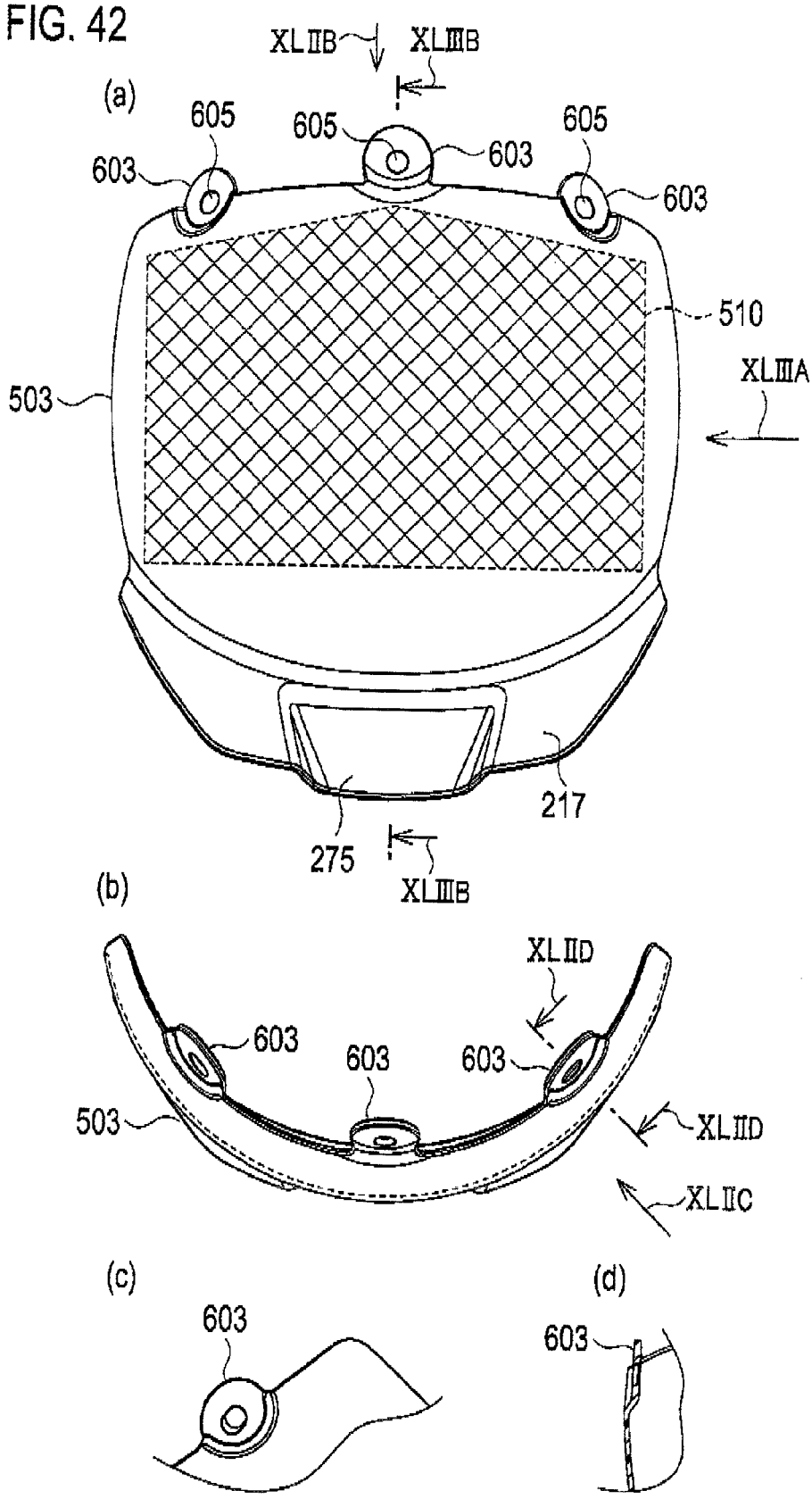
FIG. 42 is a drawing showing a shield plate.
Figure 43:
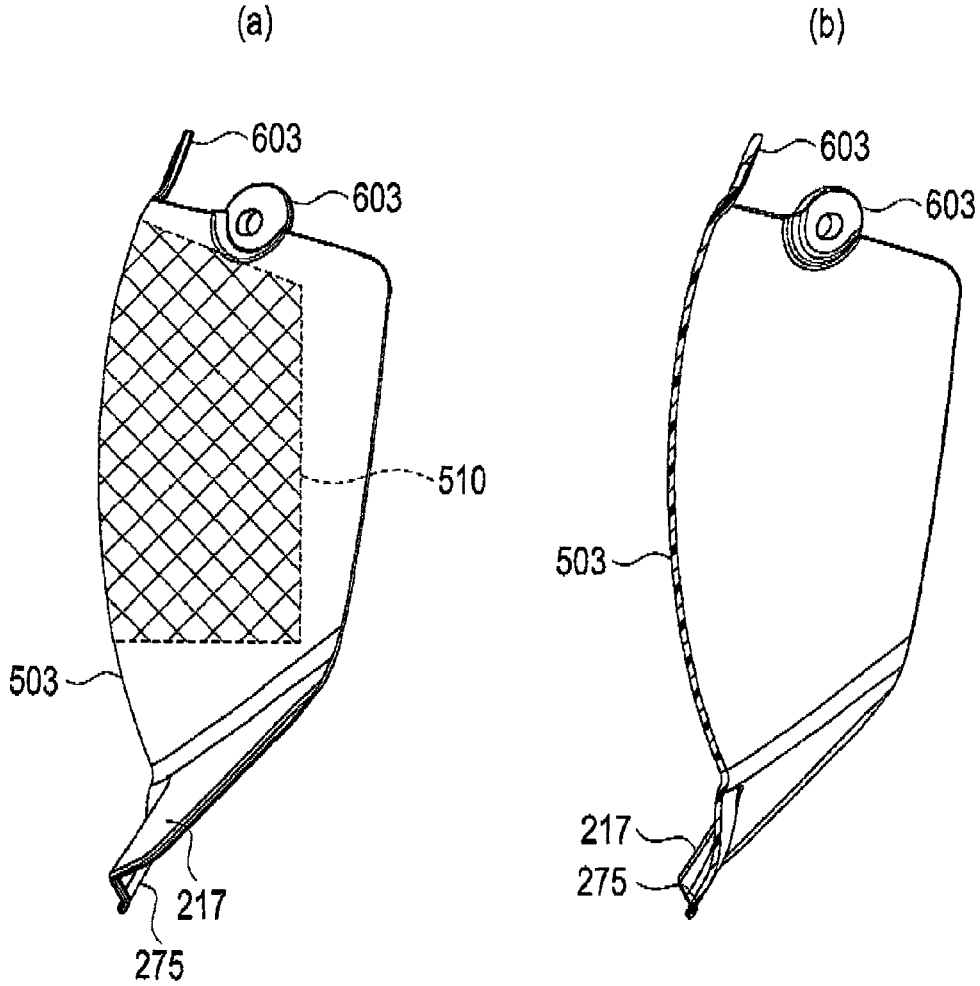
FIG. 43 is a drawing showing a shield plate.

FIG. 42 and FIG. 43 are drawings showing the shield plate 503, FIG. 42(*a*) is an elevational view of the shield plate 503, FIG. 42(*b*) is a plan view of the shield plate 503 and also a view viewed from an arrow XLIIB in FIG. 42(*a*), FIG. 42(*c*) is a partial arrow view of the shield plate 503 and also a view viewed from an arrow XLIIC in FIG. 42(*b*), FIG. 42(*d*) is a partial cross sectional view of the shield plate 503 and also a drawing showing a cross section XLIID-XLIID in FIG. 42(*b*), FIG. 43(*a*) is a side view of the shield plate 503 and also a view viewed from an arrow XLIIIA in FIG. 42(*a*), and FIG. 43(*b*) is a drawing showing a cross section XLIIIB-XLIIIB in FIG. 42(*a*). Meanwhile, a part 510 shaded in FIG. 42(*a*) and FIG. 43(*a*) an optical property range in the ANSI regulation (a range which provides good optical properties for a wearer of the protective cap 501 viewing an object via the shield plate 503).

The guide means 505 is constituted to comprise guide portions 523 provided in the guide member 509 for example constituted of a resin, and engagement portions 525 provided in the shield plate 503 constituted of a transparent or translucent resin.

The guide member 509 comprises a central portion 527 having a sphere-like curved surface to form a plate-like shape, and the guide portions 523 are formed at the central portion 527. Further, the guide portions 523 are formed in an elongated shape to guide the shield plate 503 when the shield plate 503 moves between the housing position P501 and the shielding position P503 and are provided in the plural number. The guide portions 523 run substantially in parallel with each other and are provided close to the center of the central portion 527 in its lateral direction (left-and-right direction).

Describing in more detail, the central portion 527 is formed in a spherical-shell-of-quarter-like shape. Here a spherical-shell-of-quarter (quarter-spherical-shell) shape is a body formed by the following way. First, from a first sphere of a predetermined radius, a body (spherical-shell) of a shape in which a second sphere having a common center with the first sphere and a slightly smaller radius than the first sphere is removed therefrom is obtained.

Next, the spherical-shell is divided by a first plane through the center, or its vicinity, of the respective spheres into two, and then a semi-spherical-shell as one of the two bodies is obtained.

Next, the semi-spherical-shell is divided by a second plane through the center, or its vicinity, of the respective spheres and substantially perpendicular to the first plane into two, and then a quarter-spherical-shell as one of the two bodies is obtained. Meanwhile, as the guide member 509 is to be installed in the interior (inside) of the cap body 507, a curvature radius (a curvature radius of the aforementioned first sphere) of the central portion 527 of the guide member 509 is made slightly smaller than a curvature radius of the cap body 507.

The central portion 527 is formed in a "quarter-spherical-shell-like" form and is thus not formed in a perfect quarter-spherical-shell form. More specifically, the central portion 527 is, as with the cap body 507, formed in a shape in which the curvature radius properly changes to fit it with a shape of a head of a wearer.

End portions of the central portion 527 are not formed in a perfect arc form but are formed in an arc-like shape in which the curvature radius properly changes to fit it with a shape of a head of a wearer. Here a portion (first semi-circular-end portion curved line 529) in an arc-like form (semi-arc-like form) formed by dividing by the aforementioned first plane and a portion (second semi-circular-end portion curved line 531) in an arc-like form (semi-arc-like form) formed by dividing by the aforementioned second plane are referred to as the end portions of the central portion 527.

The first semi-circular-end portion curved line 529 is for example positioned substantially on the first plane and forms to have substantially no convexes and concaves in a direction perpendicular to the first plane. Meanwhile, as the central portion 527 comprises a thickness (a difference between the radius of the first sphere and the radius of the second sphere), the first semi-circular-end portion curved line 529 can be, to be more precise, referred to as a first semi-circular-end portion curved surface.

The second semi-circular-end portion curved line 531 for example goes in and out of the second plane in a direction perpendicular to the second plane. More specifically, there are some convexes and concaves in the direction perpendicular to the second plane. Meanwhile, as with the first semi-circular-end portion curved line 529, the second semi-circular-end portion curved line 531 can be, to be more precise, referred to as a second semi-circular-end portion curved surface.

In a state where the guide member 509 is installed in the cap body 507, the central, portion 527 of the guide member 509 is slightly deviated from the cap body 507 in the front inside of the cap body 507 and is then provided integrally with the cap body 507. Thereby a space 533 of a quarter-spherical-shell-like form having predetermined thickness thicker than a thickness of the cap body 507 and a thickness of the central portion 527, and the shield plate (the shield plate positioned at the housing position P501) 503 is made to enter into the space 533 of the quarter-spherical-shell-like form.

Describing further, the first semi-circular-end portion curved line 529 is slightly apart from the internal wall of the cap body 507 and also along the internal wall of the cap body 507, and extends from the vicinity of a left end of a circular rim positioned at the lowermost end of the cap body 507 through the vicinity of a point just above the cap body 507 to the vicinity of a right end of a circular rim positioned at the lowermost end of the cap body 507. More specifically, the first semi-circular-end portion curved line 529 extends from a point above a left ear of a wearer through the vicinity of a head top of the wearer to a point above a right ear of the wearer.

Further, the second semi-circular-end portion curved line 531 is slightly apart from the front semi-circular rim at the lowermost end of the cap body 507 and also along the front semi-circular rim at the lowermost end of the cap body 507, and extends from the vicinity of the left end of the circular rim at the lowermost end of the cap body 507 through the vicinity of the front end of the rim of the cap body 507 to the right end of the circular rim at the lowermost end of the cap body 507. More specifically, the second semi-circular-end portion curved line 531 extends from a point above the left ear of the wearer through the vicinity of a forehead of the wearer to a point above the right ear of the wearer.

The guide portions 523 provided at the central portion 527 of the guide member 509 are for example provided in the number of three. The respective guide portions 523 are constituted of through holes (through holes penetrating the central portion 527 in its thickness direction) 535, 537, 539 of respectively elongated circular forms and are provided at the center, the left side and the right side of the central portion 527 in the lateral direction.

The guide portions 523 (through holes 535) provided at the center of the central portion 527 is formed from the vicinity of the center of the second semi-circular-end portion curved line 531 to the vicinity of the center of the first semi-circular-end portion curved line 529. More specifically, the through hole 535 provided at the center keeps the position of the center in the sideways direction (lateral direction; left-and-right direction) to extend from the vicinity of the center of the forehead of the wearer through a center of a frontal portion of the wearer to the vicinity of the head top of the wearer.

The left guide portions 523 (through holes 537) are provided in parallel with the through hole 535 provided at the center and is formed from the vicinity of the obliquely front portion at the left side of the second semi-circular-end portion curved line 531 to the vicinity of the obliquely upper portion of the left side of the first semi-circular-end portion curved line 529. More specifically, the through hole 537 provided at the left side extends from the vicinity of the left front portion of a chin of a wearer through an obliquely left front portion of a frontal portion of the wearer to the vicinity of an obliquely left upper portion of a head top portion of the wearer.

The right guide portions 523 (through holes 539) are provided symmetrical with the through hole 537 at the left side having the through hole 535 at the center interposed therebetween. More specifically, the right through hole 539 is provided symmetrical with the left through hole 537 relative to a plane extending in the upper-and-lower and front-and-rear directions through a center of the guide member 509.

Here, positional relations of the three guide portions 523 (through holes 535, 537, 539) will be described in more detail hereinafter. For convenience of explanation, existence of the respective side portions 541, 543 (see FIG. 39 and such) of the guide portion will be neglected (it is supposed that the side portions 541, 543 of the guide member 509 do not exist).

Intersection points between respective extrapolations of the three through holes 535, 537, 539 (central lines of the elongated circular through holes 535, 537, 539 in the lateral direction which are elongated in the longitudinal direction of the through holes 535, 537, 539) and the second semi-circular-end portion curved line 531 will be referred to as a lower portion left side intersection point 545, a lower portion central intersection point 547 and a lower portion right side intersection point 549, respectively (see FIG. 39(*a*), (*b*), FIG. 40(*a*)).

Then a distance between a left end 551 of the second semi-circular-end portion curved line 531 (a left end consistent with a left end of the first semi-circular-end portion curved line 529; see FIG. 39(*a*)) and the lower portion left side intersection point 545 is equal to or slightly larger than a distance between the lower portion left side intersection point 545 and the lower portion central intersection point 547 (a distance along the second semi-circular-end portion curved line 531).

Further, likewise, a distance between a right end 553 of the second semi-circular-end portion curved line 531 (a right end consistent with a right end of the first semi-circular-end portion curved line 529; see FIG. 39(*a*)) and the lower portion right side intersection point 549 (a distance along the second semi-circular-end portion curved line 531) is equal to or slightly larger than a distance between the lower portion right side intersection point 549 and the lower portion central intersection point 547 (a distance along the second semi-circular-end portion curved line 531).

Further, intersection points between the respective extrapolations of the three through holes 535, 537, 539 and the first semi-circular-end portion curved line 529 will be referred to as an upper portion left side intersection point 555, an upper central intersection point 557, and an upper portion right side intersection point 559, respectively, as shown in FIG. 39(*b*).

Then a distance between the left end 551 of the first semi-circular-end portion curved line 529 and the upper portion left side intersection point 555 is equal to or slightly larger than a distance between the upper portion left side intersection point 55 and the upper portion central intersection point 557 (a distance along the first semi-circular-end portion curved line 529).

Further, likewise, a distance between the right end 553 of the first semi-circular-end portion curved line 529 and the upper portion right side intersection point 559 (a distance along the first semi-circular-end portion curved line 529) is equal to or slightly larger than a distance between the upper portion right side intersection point 559 and the upper portion central intersection point 557 (a distance along the first semi-circular-end portion curved line 529).

Thus as the guide portions 523 are provided, the guide portions 523 (through holes 535, 537, 539) are provided to extend in the upper-and-lower and front-and-rear directions at the central portion side of the central portion 527 (in the lateral direction and close to the central portion).

Meanwhile a configuration in which the guide portion 523 (through hole 535) at the center is omitted and the guide portions 523 are provided in two may be used, or a configuration in which the guide portion 523 (through hole 535) at the center is provided in two and one of the guide portions is slightly moved leftward relative to the center and the other is slightly moved rightward relative to the center so that four guide portions (elongated circular through holes) may be used. Further, a configuration in which five guide portions elongated in the upper-and-lower and front-and-rear directions are provided at the side of the center of the central portion 527 (close the center in the lateral direction) may be used.

Further, the guide member 509 is constituted to comprise the aforementioned central portion 527 and a first side portion (side portion at the left side) 541 in a plate-like form and a second side portion (side portion at the right side) 543 in a plate-like form. The first side portion 541 is provided integrally with the central portion 527 at one end portion side (left side) in the lateral direction of the central portion 527 and at the lower side of the central portion 527. The second side portion 543 is provided integrally with the central portion 527 at another end portion side (right side) in the lateral direction of the central portion 527 and at the lower side of the central portion 527.

Further, a pair of central portion engagement portions 561 (see FIG. 39(*b*)) engage with a pair of central portion to-be-engaged portions 563 (see FIG. 36(*c*)), first side portion engagement portions 565 at the left (see FIG. 39(*a*)) engage with first side portion to-be-engaged portions 567 (see FIG. 36(*c*)), and second side portion engagement portions 569 (see FIG. 39(*a*)) at the right engage with second side portion to-be-engaged portions 571 (see FIG. 36(*c*)), thereby the guide member 509 is constituted to be provided integrally with the cap body 507.

The pair of central portion engagement portions 561 are formed in the vicinity of the respective side portions 541, 543 on the central portion 527, and the pair of central portion to-be-engaged portions 563 are provided at the sides of the cap body 507. The first side portion engagement 565 is provided on the first side portion 541, and the first side portion to-be-engaged portion 567 is provided at the leftward obliquely rear side of the cap body 507. The second side portion engagement portion 569 is provided on the second side portion 543, and the second side portion to-be-engaged portion 571 is provided at the rightward obliquely rear side of the cap body 507.

Describing in more detail, the first side portion 541 is formed with a thickness substantially identical to the central portion 527 in a short belt-like form. Further, one end portion in the longitudinal direction of the first side portion 541 is connected to the lowermost end portion side (left and lower end portion side) of the first semi-circular-end portion curved line 529. Further, the second side portion 543 is provided symmetrical to the first side portion 541 relative to a plane extending in the upper-and-lower and front-and-rear direction through the center of the guide member 509. Thereby, substantially on an extrapolation at the left of the second semi-circular-end portion curved line 531 of the central portion 527 positioned is one end portion (lower end portion) in the lateral direction of the first side portion 541, and substantially on an extrapolation at the right of the second semi-circular-end portion curved line 531 of the central portion 527 positioned is one end portion (lower end portion) in the lateral direction of the second side portion 543.

The guide member 509 is detachably attached to the cap body 507, and as the pair of central portion engagement portions 561 formed on the central portion 527 of the guide member 509 engage with the pair of central portion to-be-engaged portions 563 provided on the cap body 507, the guide member 509 installed on the cap body 507 is made uneasy to separate from the cap body 507.

Figure 38:
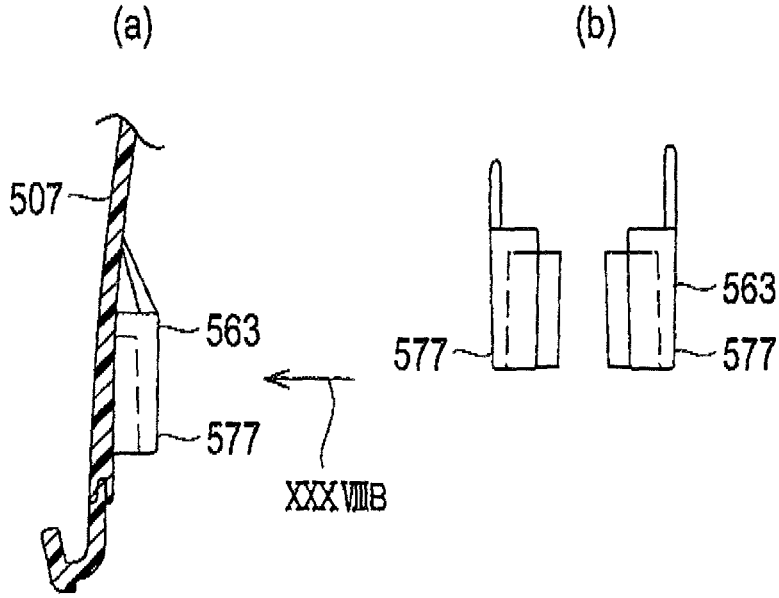
FIG. 38 is a drawing showing a central portion to-be-engaged portion provided in the cap body.

The central portion engagement portions 561 are for example constituted of first central portion engagement portions (projections slightly projecting outward from the central portion 527) 573 (see FIG. 39(*a*)) acknowledged as a rigid body and second central portion engagement portions 575 (see FIG. 39(*a*)) having elasticity. The central portion to-be-engaged portions 563 are constituted of portions 577 (projections slightly projecting from the inner wall of the cap body toward the interior of the cap body 507; see FIG. 36(*c*), FIG. 38) acknowledged as rigid bodies. Meanwhile FIG. 38(*a*) is a side view of the central portion to-be-engaged portion 563 and FIG. 38(*b*) is a view viewed from an arrow XXXVIIIB in FIG. 38(*a*).

Further when the guide member 509 is installed on the cap body 507 (when the first central portion engagement portions 573 are made engaged with the central portion to-be-engaged portions 563), the second central portion engagement portions 575 butt on the cap body 507 (the central portion to-be-engaged portions 563 and its peripheries) to elastically deform. After installing the guide member 509 on the cap body 507 (after having the first central portion engagement portions 573 engaging with the central portion to-be-engaged portions 563), the second central portion engagement portions 575 are made to restore the original shape. By the restored second central portion engagement portions 575, the guide member 509 once installed on the cap body 507 is made uneasy to separate from the cap body 507.

More specifically, when the shield plate 503 is in motion or such for example, even in a case where an external force is loaded on the cap body 507, the guide member 509 or the shield plate 503, the guide member 509 is made to uneasy to separate from the cap body 507. Meanwhile the central portion engagement portions 561 and the central portion to-be-engaged portions 563 are provided at positions where they do not interfere with the shield plate 503.

Figure 32:
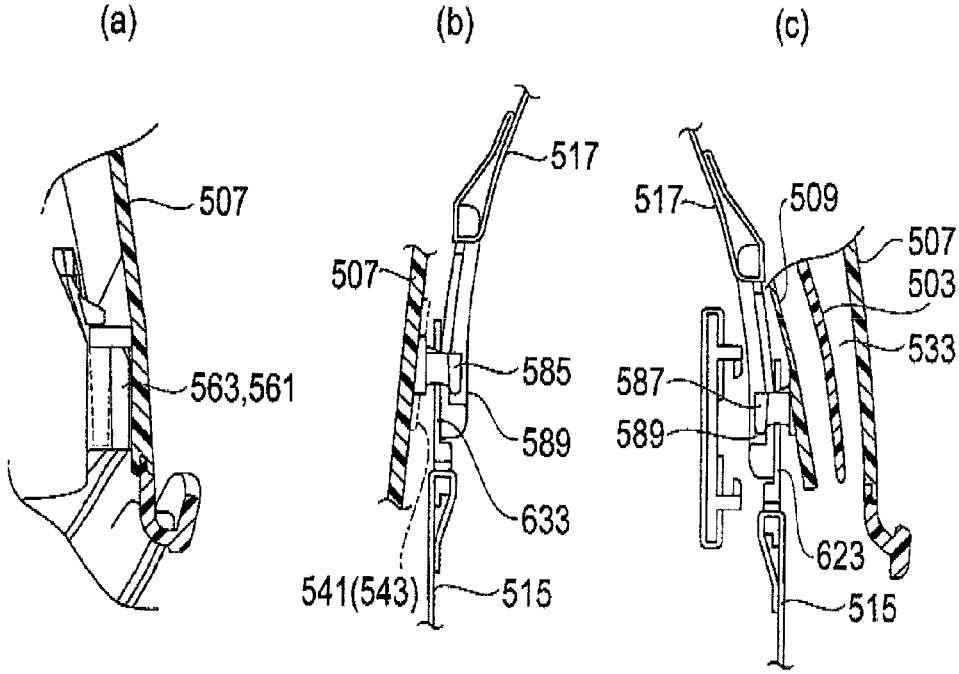
FIG. 32 is a drawing showing a state of engagement between a cap body and a guide member and a state of engagement between the cap body and a chin-strap or a hammock.

Meanwhile FIG. 32(*a*) is a drawing showing a state where the central portion engagement portions 561 of the guide member 509 engage with the central portion to-be-engaged portions 563 of the cap body 507 and is a drawing showing a partial cross section XXXIIA-XXXIIA shown in FIG. 31.

A value of a length of the first side portion 541 in a band-like form or the second side portion 543 is slightly smaller than a value of a half of a length of the second semi-circular-end portion curved line 531. The first side portion engagement portion 55 is constituted of two through holes 579, 581 penetrating the first side portion 541 in the thickness direction.

One through hole (rear through hole) 581 of the two through holes 579, 581 constituting the first side portion engagement portions 565 is provided at the vicinity of a tip end portion of the first side portion 541 (an end portion opposed to the central portion 527 in the longitudinal direction of the first side portion 541) and another through hole (front through hole) 579 of the two through holes 579, 581 constituting the first side portion engagement portion 565 is provided in between the central portion engagement portions 561 in the longitudinal direction of the first side portion 541 and the rear through holes 581 (substantially at the central portion for example).

The second side portion engagement 569 is also, as with the case of the first side portion engagement portion 565, constituted of a rear through hole 581 and a front through hole 579, and the respective through holes 579, 581 of the side portion engagement portion 569 are provided symmetrical to the respective through holes 579, 581 of the first side portion engagement portion 565 relative to a plane extending in the upper-and-lower and front-and-rear directions through the center of the guide member 509.

Figure 37:
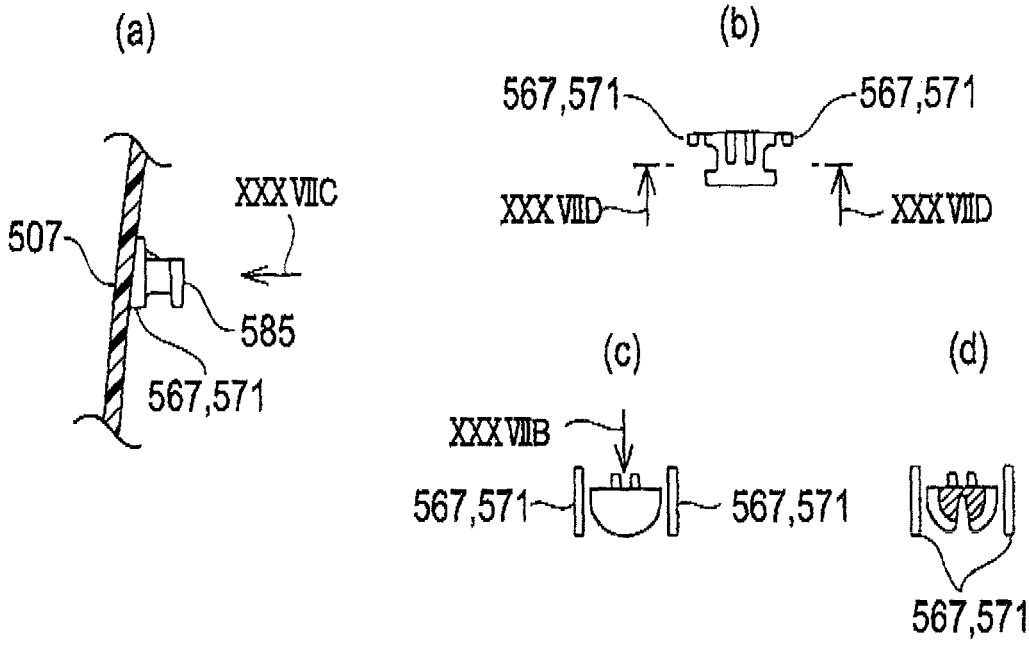
FIG. 37 is a drawing showing a side portion to-be-engaged portion provided in the cap body.

The first side portion to-be-engaged portion 567 is as shown in FIG. 36(*c*) and FIG. 37 constituted of two projections (a front side projection and a rear side projection) 583 slightly projecting from the inner wall of the cap body 507 at the vicinity of an opening portion (a rim at the lowermost end portion) of the cap body 507 toward the interior of the cap body 507. The second side portion to-be-engaged portion 571 is provided symmetrical with the first side portion to-be-engaged portion 567 relative to a plane extending in the upper-and-lower and front-and-rear direction through the center of the cap body 507. More specifically, the side portion to-be-engaged portions 567, 571 are constituted of two front side projections 583 and two rear side projections 583.

Meanwhile, FIG. 37(*a*) is a side view of the side portion to-be-engaged portion 567, 571 and a later described cap body locking portion 585, FIG. 37(*c*) is a view viewed from an arrow XXXVIIC in FIG. 37(*a*), FIG. 37(*b*) is a view viewed from an arrow XXXVIIB in FIG. 37(*c*), and FIG. 37(*d*) is drawing showing a cross section XXXVIID-XXVIII) in FIG. 37(*b*).

In a state where the first side portion engagement portions 565 engage with the first side portion to-be-engaged portions 567, the first side portion 541 is in contact with the inner wall of the cap body 507. Further, in a state where the first side portion engagement portions 565 engage with the first side portion to-be-engaged portions 567, the guide member 509 (first side portion 541) is limited in its movement in the upper-and-lower direction relative to the cap body 507 and is allowed to slightly move in the front-and-rear direction of the cap body 507 (a direction toward inner peripheries of the cap body 507) relative to the cap body 507. Meanwhile movement of the cap body 507 in the thickness direction is constituted to be regulated by installing the hammock 517 in the cap body 507. A state where the second side portion engagement portion 569 engages with the second side portion to-be-engaged portion 571 is similar to a state where the first side portion engagement portions 565 engage with the first side portion to-be-engaged portions 567.

In a state where it is finished to install the guide member 509 in the cap body 507, the first side portion engagement portions 565 engage with the first side portion to-be-engaged portions 567, the second side portion engagement portions 569 engage with the second side portion to-be-engaged portions 571, and the central portion engagement portions 561 engage with the central portion to-be-engaged portions 563. Further, the guide member 509 is firmly installed in the cap body 507.

Further, in a state where it is finished to install the guide member 509 in the cap body 507, a rim at the lower side of the guide member 509 (a lowermost end portion of the second semi-circular-end portion curved line 531 and the respective side portions 541, 543) extends along a rim of the cap body 507 at the vicinity of the inside of the rim (opening portion) of the cap body 507. Further, in a state where it is finished to install the guide portion 509 in the cap body 507, when viewing the cap body 507 and the guide member 509 from these lower side toward these upper side, the rim of the cap body 507 is formed in a circle-like form (a circle-like form having a diameter in the front-and-rear direction larger than a diameter in the lateral direction). As compared therewith, the guide member 509 is formed in a horseshoe shape having a narrow portion unconnected at the rear (tip end portions of the respective side portions 541, 543 are slightly apart from each other). Meanwhile, the guide member 509 is so constituted as to be a circle-like form as with the cap body 507.

At the first side portion to-be-engaged portions 567 and at the side portion to-be-engaged portions 571 formed are locking portions (cap body locking portion constituted of four projections) 585 constituted of projections having a projecting length (a projecting length toward the interior of the cap body 507) than the projections 583 constituting the to-be-engaged portions 567, 571 (see FIG. 36(*c*), FIG. 37). Cap body engagement portions 585 are portions for locking the hammock 517.

Figure 41:
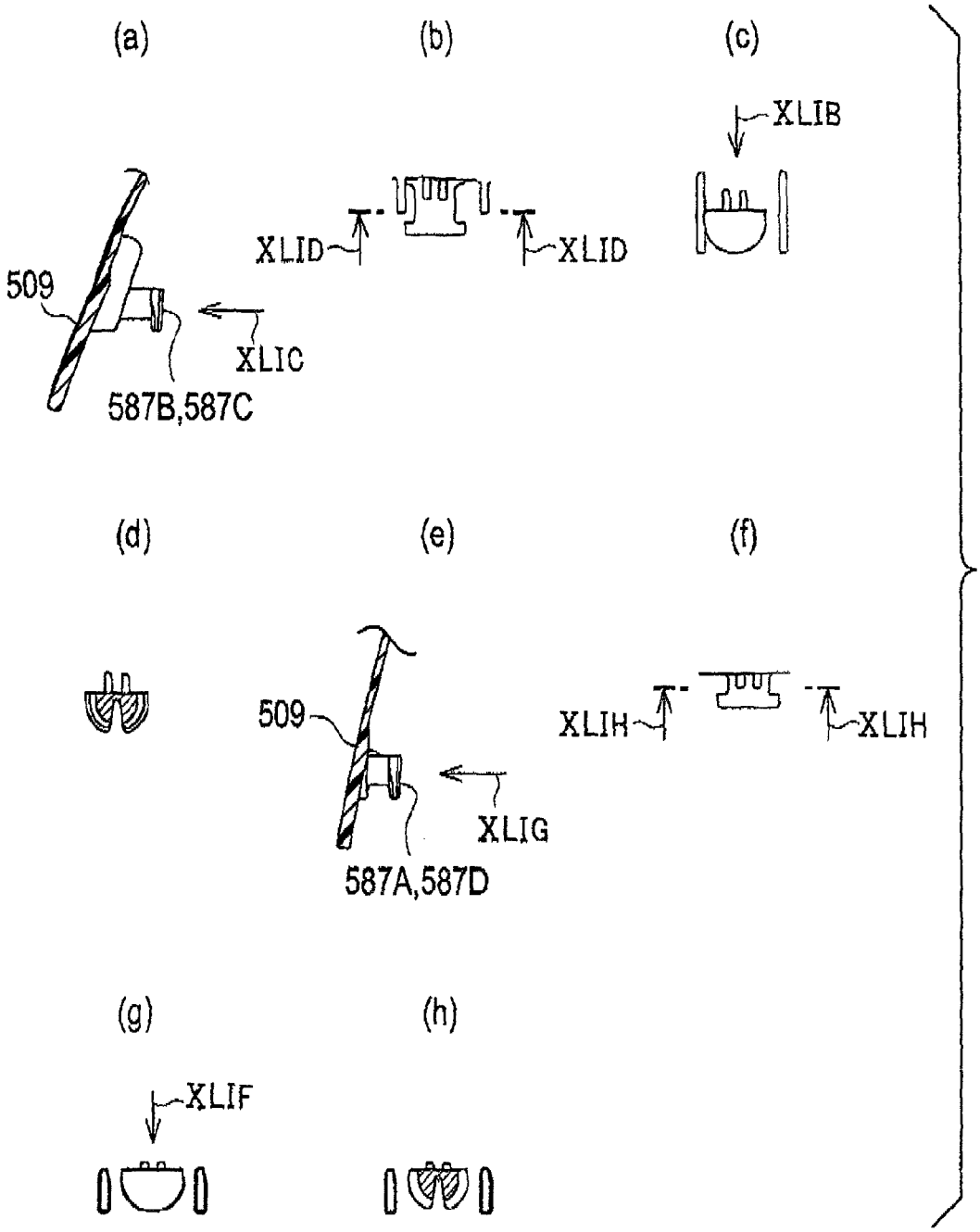
FIG. 41 is a drawing showing a guide member retaining portion.

At the inside of the central portion 527 of the guide member 509 and at the vicinity of the second semi-circular-end portion curved line 531 formed are locking portions (guide member locking portions constituted of four projections) constituted as similar to the cap body locking portions 585 (see FIG. 39(*b*) and FIG. 41). Guide member locking portions 587 are also portions for locking the hammock 517.

Meanwhile, FIG. 41(*a*) is a side view of the guide member locking portion 587 which is positioned at the front among the guide member locking portions, FIG. 41(*c*) is a view viewed from an arrow XLIC in FIG. 41(*a*), FIG. 41(*b*) is a view viewed from an arrow XLIB in FIG. 41(*c*), and FIG. 41(*d*) is a drawing showing a cross section XLID-XLID in FIG. 41(*b*).

Moreover, FIG. 41(*e*) is a side view of the guide member locking portion 587 which is positioned at the front among the guide member locking portions, FIG. 41(*g*) is a view viewed from an arrow XLIG in FIG. 41(*e*), FIG. 41(*f*) is a view viewed from an arrow XLIF in FIG. 41(*g*), and FIG. 41(*h*) is a drawing showing a cross section XLIH-XLIH in FIG. 41(*g*).

The guide member locking portions 587 of the guide member 509 are provided symmetrical relative to a plane extending in the upper-and-lower and front-and-rear directions through the center of the guide member 509. Thereby, in a state where it is finished to install the guide member 509 in the cap body 507, the locking portions 585, 587 are provided at eight points in total.

Further, in a state where it is finished to install the guide member 509 in the cap body 507, when to-be-engaged portions 589 of the hammock 517 are locked to the cap body engagement portions 585 and the guide member locking portions 587 so as to finish installation of the hammock 517 in the cap body 507, it is made that the respective side portions 541, 543 of the guide member 509 is caught between the cap body 507 and the to-be-engaged portions 589 of the hammock 517 so that the respective side portions 541, 543 of the guide member 509 get contact on the inner wall of the cap body 507, thereby the respective side portions 541, 543 of the guide portion 509 are fixed to the cap body 507 and then installed therein as described above (see FIG. 32(*b*) and FIG. 32(*c*)). Meanwhile, FIG. 32(*b*) is a drawing showing a cross section XXXIIB-XXXIIB in FIG. 31 and FIG. 32(*c*) is a drawing showing a cross section XXXIIC-XXXIIC in FIG. 31.

The respective side portions 541, 543 are so formed that these corner portions are rounded. More specifically, outlines of two corner portions (corner portions positioned at both end portions in the upper-and-lower direction) at the tip end portions (tip end portions opposed to the central portion 527) in the longitudinal direction of the first side portion 541 and the second side portion 543 are formed in a quarter arc-like form when viewed from the thickness direction of the side portions 541, 543 (see the reference sign 591 in FIG. 39(*a*)). Further, at the other portions of the side portions 541, 543 (central portions in the longitudinal direction and lowermost end portions in the upper-and-lower direction), corner portions are formed to be rounded (see the reference sign 593 in FIG. 39(*a*)).

As the corner portions of the respective side portions 541, 543 are formed to be rounded, damage to the guide member 509 by stress concentration can be prevented, and scratches on the cap body 507, the shield plate 503 and a wearer of the protective cap 501 by the guide member 509 can be prevented.

By the way, the guide portions 523 of the guide member 509 are, as described above, constituted of the three elongated circular through holes 535, 537, 539 for example. In accordance with this, the engagement portions 525 of the shield plate 503 are constituted of three columnar portions 595 (see FIG. 35).

Further, as the columnar portions 595 constituting the engagement portions 525 respectively engage with the three through holes 535, 537, 539 constituting the guide portions 523 of the guide member 509 (the columnar portions 595 enter into the through holes 535, 537, 539), the shield plate 503 is guided to move between the housing position P501 and the shielding position P503.

Describing in more detail, the thickness B501 of the elongated through holes 535, 537, 539 is very slightly larger than the outer diameter D501 of the columnar portions 595 (see FIG. 35(*b*)). Further, at both end portions of the columnar portions 595, disc-like flange portions 599, 601 larger than the columnar portions 595 in diameter are formed integrally so as to form an engagement member 597 (see FIG. 35(*a*)).

At the uppermost end portion of the shield plate 503, as shown in FIG. 42(*a*), semi-disc-like installation portions 603 for installation of the engagement member 597 are formed integrally. At the central portions of the semi-disc-like installation portions 603 formed are through holes (through holes, the inner diameter of which is slightly larger than the outer diameter D501 of the columnar portions 595 of the engagement member 597) 605 penetrating the semi-disc-like installation portions 603 in its thickness direction. Meanwhile, the installation portions 603 and the through holes 605 are provided at three sites in accordance with the three through holes 535, 537, 539 of the guide member 509.

Further, in between the respective flange portions 599, 601 provided at both end portions of the columnar portion 595, the installation portions 603 of the shield plate 503 and the central portion 527 of the guide member 509 enter into slot that the installation portions 603 of the shield plate 503 and the central portion 527 of the guide member 509 are caught between the flange portions 599, 601 and the columnar portion 595 penetrates the elongated circular through holes 535, 537, 539 of the guide portions 523 and the circular through holes 605 of the installation portions 603. Thereby, when the shield plate 503 moves relative to the cap body 507 and the guide member 509, the shield plate 503 is made to move substantially only in the longitudinal direction of the through holes 535, 537, 539 constituting the guide portions 523.

Meanwhile, the engagement member (the member with the flange) 597 is constituted of a first tubular member 607 comprising a flange portion 599 at its one end portion, a second tubular member 609 comprising a flange portion 601 at its another end portion, a rivet 611 penetrating the tubular members 607, 609 along these central axes and is caulked to make the respective tubular member 607, 609 be a unitary body.

In a state where the shield plate 503 is positioned at the housing position P501, the portions 595 of the columnar form of the members 597 with the flanges are in contact with the uppermost end portions of the respective elongated circular through holes 535, 537, 539. On the other hand, in a state where the shield plate 503 is positioned at the shielding position P503, the portions 595 of the columnar form of the members 597 with the flanges are in contact with the lowermost end portions of the respective elongated circular through holes 535, 537, 539.

Further, in the protective cap 501, as with the protective caps 1, 201, a retaining means 613 for retaining states in which the shield plate 503 is positioned at the housing position P501 and the shielding position P503 is provided. The retaining means 613 will be described in detail hereinafter.

The widths of two through holes 537, 539, which exist at left and right sides among the three elongated circular through holes 535, 537, 539 forming the guide portions 523, are made constant. On the other hand, the elongated circular through hole 535 existing at the center among the three elongated circular through holes 535, 537, 539 forming the guide portions 523 are made slightly smaller in its width at the vicinity of the end portion of its longitudinal direction (see FIG. 35(*b*)). Thereby, the shield plate 503 is made to retain its position at either the housing position P501 or the shielding position P503.

Describing in more detail, as shown in FIG. 35(*b*), an upper most portion 615 of the elongated circular through hole (central through hole) 535 existing at the center of the guide members 509 is formed in an arc-like horseshoe shape. A diameter D503 of an arc of the uppermost portion 615 formed in the arc-like horseshoe shape is equal to or slightly larger than the outer diameter D501 of the columnar portion 595 of the member 597 with the flange.

A distance L501 between both end portions 617 of the uppermost portion 615 (a distance in the lateral direction in exits of uppermost end portions of the arc-like and horseshoe shape) is slightly smaller than the outer diameter D501 of the columnar portion 595 of the member 597 with the flange. Then when the member 597 with the flange existing at the central portion in the longitudinal direction of the elongated circular central through hole 535 moves to the uppermost portion 615 of the elongated circular central through hole 535, it is constituted that the columnar portion 595 of the member 597 with the flange comes into contact with said both end portions 617 of the uppermost end portion 615 and a part of the guide member 509 elastically deforms and the distance L501 between said both end portions 617 becomes large up to the value of the outer diameter D501 of the columnar portion 595. Further, when the member 597 with the flange is moved so that the columnar portion 595 of the member 597 with the flange is positioned at the uppermost portion 615, said both end portions 617 restore its original positions to retain the position of the member 597 with the flange.

Between said both end portions 617 and separated portions 619 which are separated from said end portions 617 toward the lowermost end side of the elongated circular through hole 535 by a predetermined distance, the width of the elongated circular through hole 535 is gradually reduced from the separated portions 619 toward said both end portions 617. More specifically, a taper portion 621 is formed between the separated portions 619 and said both end portions 617. Thereby it is prevented that the columnar portion 595 of the member 597 with the flange abruptly abuts on said both end portions 617 of the uppermost portion 615 of the horseshoe form when the shield plate 503 moves from the shielding position P503 to the housing position P501, and thus damage to said both end portions 617 of the uppermost portion 615 can be prevented.

Meanwhile the lowermost end portion side of the elongated circular through hole 535 is also formed to comprise a taper portion and such like as those of the uppermost portion side. Further, to have elastic deformation of said both end portions 617 of the horseshoe shape easier, a pair of through holes (two through holes of a circle-like form penetrating the central portion 527 of the guide member 509 in its thickness direction) 623 are provided.

Meanwhile, in addition to, or instead of, providing the uppermost portion side of the elongated circular through hole 535 with the aforementioned through hole 623, it may be provided at the lowermost end portion side of the through hole 535 of the elongated circular shape.

Further, in addition to, or instead of, providing the aforementioned retaining means 613 at the central elongated circular through hole 535, it may be provided at the left and right elongated circular through holes 537, 539.

By the way, concave portions 625 dented toward the insides of the central portions 527 are provided at the peripheries of the elongated circular through holes 535, 537, 539 provided at the central portion 527 of the guide member 509. The concave portions 625 comprise predetermined widths and are provided so as to enclose the elongated circular through holes 535, 537, 539. Further, the installation portions 603 provided at the uppermost end portion of the shield plate 503 as described above are provided to dent slightly toward the inside of the shield plate 503 (see FIG. 42(*b*) and FIG. 43). In the vicinities of the three concave portions 625 and at the second semi-circular-end portion curved line 531 of the central portion 527 of the guide member 509, three projections 627 are provided. These three projections 627 project toward the front side (outside) of the central portion 527 in the thickness direction of the central portion 527 of the guide member 509.

In a state where the shield plate is installed in the guide member 509 by using three members 597 with the flanges provided accordingly to the three through holes 535, 537, 539, three parts of the uppermost end portion of the shield plate 503 are supported by the guide member 509 via the members 597 with the flanges, the installation portion 603 provided at the uppermost end portion of the shield plate 503 enters into the concave portions 625 provided at the central portion 527, and a face at the inside of the shield plate 503 indirectly, with having a packing 631 interposed therebetween, which will be described later in detail, abuts on the respective projections 627 of the central portion 527.

Further, in a state where the guide member 509 provided in the shield plate 503 is installed in the cap body 507, a small gap 629 is formed between a surface at the outside of the shield plate 503 and a semi-circular rim at a front side of the cap body 507 (see FIG. 29).

Thereby, in a regular state (a state where an uprightly standing wearer simply wears the protective cap 501) three parts of the uppermost end portion of the shield plate 503 are supported by the guide member 509 via the members 597 with the flanges, the surface at the inside of the shield plate 503 are indirectly supported by the projection 627 of the central portion 527 with having the packing 631 which will be described later in detail interposed therebetween, and the shield plate 503 is supported by the guide member 509, thereby the shield plate 503 moves in an arc-like trajectory between the housing position P501 and the shielding position P503.

Further, in a case where an external force in a direction for lifting up the lowermost end of the shield plate 503 or drawing the shield plate 503 apart from a face of a wearer is applied to the shield plate 503 in a state where the guide member 509 in which the shield plate 503 is installed is installed, in the cap body 507, the small gap 629 between the surface at the outside of the shield plate 503 and the arc-like rim at the front side of the cap body 507 is gone, and then the face at the outside of the shield plate 503 indirectly, with having the packing 631 interposed therebetween, which will be described later in detail, abuts on the arc-like rim at the front side of the cap body 507, thereby limiting swing of the shield plate 503 by the aforementioned external force.

More specifically, the shield plate 503 engages with the guide member 509 at the installation, portion 603 of the uppermost end portion thereof. Further, the shield plate 503 engages with any of the projection 627 and the semi-arc-like rim at the front side of the cap body 507 at a portion at the lower portion (a portion covering a face of a wearer of the cap body 507) with being caught between the projection 627 and the semi-arc-like rim at the front side of the cap body 507. Then it is prevented that the shield plate 503 shakes to a great extent.

Meanwhile, portions of the shield plate 503 other than the aforementioned engaging portion are opposed to the guide member 509 and the cap body 507 with having a small gap therebetween.

At the three projections 627 provided at the central portion 527 of the guide member 509 and its peripheries, and at the rim of the cap body 507 forming the gap 629 and its vicinities, the packing (low friction member; scratch prevention member) 631 of a plate-like form for example is adhered (see FIG. 34(*a*) and FIG. 36(*c*)). Thereby the shield plate 503 (excepting the installation portions 603 and the visor 217) does not contact with the guide portion 509 and the cap body 507, the shield plate 503 can move with small frictional resistance between the housing position P501 and the shielding position P503, and further any portions of the shield plate 503 which come into view of a wearer of the cap body 507 (optical property range 510 regulated in the ANSI regulation as shown in FIG. 42(*a*) or such) are prevented from being given scratches.

A packing 631A provided at the central portion of the guide member 509 is formed in a U-letter shape, and is provided from the lowermost end toward the uppermost end of the guide member 509 to be longer than the other packing 631. Thereby giving scratches to the shield plate 503 is further surely prevented.

Positional relationships among respective elongated circular through holes 535, 537, 539 provided at the central portion 527 of the guide member 509, the concavity portions 625 formed around the through holes 535, 537, 539, and the guide member locking portions 587 will be described in more detail hereinafter.

The guide member locking portions 587 are as described above provided by four as shown in FIG. 33(*b*). The guide member locking portion 587A positioned at the leftmost side is positioned substantially at the center between the central portion engagement portion 561A at the left side and the through hole 537 at the left in an extending direction of the second semi-circular-end portion curved line 531, and the guide member locking portion 587B positioned at the next to the leftmost side is positioned adjacent to the concave portion 625 of the through hole 537 at the left side and between the through hole 537 at the left and the central through hole 535 in the extending direction of the second semi-circular-end portion curved line 531. Further the two guide member locking portions 587C, 587D at the right side are provided symmetrically to the guide member locking portions 587A, 587B at the right side relative to a plane extending in the upper-and-lower and front-and-rear directions through the center of the guide member 509.

As the guide member locking portions 587 are provided at these positions, the hammock 517 can be installed at any proper position of the guide member 509 with avoiding interference by the guide member locking portions 587 and the guide portions 523 of the guide member 509, and is, with the hammock 517, capable of properly receiving an external force applied to the cap body 507.

Further, by engaging to-be-locked portions 633 of an ear-strap (chin-strap) 515 with the locking portion 585A provided at the leftmost side among the cap body locking portions 585 (see FIG. 36(*c*)) and the locking portion 587A provided at the leftmost side among the guide member locking portions 587 (see FIG. 33(*b*)), and further by engaging the other, ear-strap (chin-strap) 515 with the locking portion 585D provided at the rightmost side among the cap body locking portions 585 or the locking portion 585C next thereto (see FIG. 36(*c*)) and the locking portion 587D provided at the rightmost side among the guide member locking portions 587 (see FIG. 33(*b*)), the respective chin-straps 515 can be installed at any proper positions of the cap body 507 or the guide member 509, and then a wearer of the protective cap 501 can wear the protective cap 501 without feeling wrong and can fix the protective cap 501 with his or her head by using the respective chin-straps 515.

Meanwhile, as being understood already, as the cap body locking portions 585 are provided at the rear side of the cap body 507 and the guide member 509 is provided at the front side of the cap body 507, the cap body locking portion 585 is positioned at the rear side relative to the guide member locking portions 587.

After engaging the to-be-locked portions 633 of the chin-strap 515 with the cap body locking portions 585 or the guide member locking portions 587, by engaging the to-be-locked portions 589 of the hammock 517 with the cap body locking portions 585 or the guide member locking portion 587, the chin-strap 515 (the to-be-locked portions 633) and the hammock 517 (the to-be-locked portions 589) are made to be installed integrally with the cap body 507 and the guide member 509. Meanwhile the hammock 517 is made to be easily detachably attached to the cap body 507 and the guide member 509 and then it is made that the once installed hammock 517 is not easily detached from the cap body 507 and the guide member 509.

Further, in the protective cap 501, the respective side portions 541, 543 of the guide member 509 and the to-be-engaged portions 633 of the chin-strap 515 are caught between the cap body 507 and the to-be-engaged portions 589 of the hammock 517 and then installed integrally with the cap body 507 (see FIG. 32(*b*)).

According to the protective cap 501, as the guide member 509 comprises the central portion 527 formed in the plate-like shape comprising the curved surface of the sphere-like shape and the guide portion 523 is formed at the central portion (close to the center of the central portion 527 in the lateral direction, for example) 527, a so-called narrow guide is formed and getting the shield plate 503 in and out (movement between the housing position P501 and the shielding position P503) can be carried out smoothly as compared with a case where the guide portion 523 is provided at sides of the sides (at the sides of respective end portions in the lateral direction) of the central portion 527.

Further, according to the protective cap 501, as the guide member 509 is constituted to comprise the central portion 527 of the guide member 509 and the side portions 541, 543, the pair of central portion engagement portions 561 (561A, 561B) formed in the vicinity of the respective side portions 541, 543 and at the central portion 527 engage with the pair of central portion to-be-engaged portions 563 provided in the cap body 507, and the side portion engagement portions 565, 569 formed at the respective side portions 541, 543 engage with the side portion to-be-engaged portions 567, 571, the degree of how the guide member 509 shakes relative to cap body 507 can be reduced.

More specifically, in a case where one gets the shield plate 503 in and out, as the guide member 509 guides the shield plate 503, while a rotation moment about the axis C501 extending in the lateral direction of the cap body 507 is applied to the guide member 509 and this rotation moment is transmitted through the guide member 509 to the cap body 507, the central portion engagement portions 561 of the guide member 509 engaging with the central portion to-be-engaged portions 563 of the cap body 507 function as pivots and the side portion engagement portions 565, 569 of the guide member 509 engaging with the side portion to-be-engaged portion 567, 571 of the cap body 507 receive the rotation moment, thereby reducing the degree of shaking as described above.

Further, as the side portion engagement portions 565, 569 of the guide member 509 are provided at two sites at the left and two sites at the right, the degree of shaking can be further reduced. Further the side portion engagement portion (through hole 581) at the rear side among the two side portion engagement portions 565 at the left side and, the side portion engagement portion (through hole 581) at the rear side among the two side portion engagement portions 565 at the right side are positioned in the vicinity of the rearmost end portion of the cap body 507, the distance between the central portion engagement portions 561 to be the pivots and the side portion engagement portions 565 at the rear side is made greater, thereby further reducing the degree of shaking.

Further, according to the protective cap 501, as the guide portions 523 of the guide member 509 are constituted of the three elongated circular through holes 535, 537, 539, the columnar portions 595 respectively engage with the three through holes 535, 537, 539 to guide the shield plate 503 to move between the housing position P501 and the shielding position P503, the shield plate 503 is allowed to smoothly move relative to the guide member 509 although the configuration is simple, as well as a degree of shaking the shield plate 503 is reduced.

Meanwhile, as the shield plate 503, that of a half type covering only an upper half of a face of a wearer can be used. Further, the shield plate 503 may be formed in a similar way to the shield plate in accordance with the second embodiment. More specifically, as shown in FIG. 22 and FIG. 23 for example, it may be formed in a shape in which a thickness is gradually reduced from a central portion toward a periphery portion.

The invention claimed is:

1. The protective cap, characterized by having:

a cap body formed in a bowl form;

a guide member comprising an arc-like guide portion, the guide member being so formed in the cap body and integrally with the cap body as to have the guide portion fitting along an internal surface at a front side of the cap body; and a shield plate comprised of a transparent material or a translucent material and formed in a plate-like form having a curved surface along the internal surface at the front side of the cap body, the shield plate comprising an engagement portion for engaging with the arc-like guide portion, wherein the engagement portion engages with the guide portion so that the shield plate moves along a curved surface of the cap body between a housing position where the shield member is housed in the cap body and a shielding position where the shield member covers almost all of the face of the wearer wherein the guide member is constituted to comprise a central portion comprising a curved surface along the internal surface at the front side of the cap body to be formed in a plate form, a first side portion provided at one end side in a lateral direction of the central portion and integral with the central portion, a second side portion provided at another end side in the lateral direction of the central portion and integral with the central portion, the guide portion is formed at a portion of a proximal end side of the first side portion and at a portion of a proximal end side of the second side portion, the first side portion and the second side portion engage with the cap body, and the guide portion is provided integral with the cap body; and the shield plate is so constituted as to enter into a space formed among the cap body, the central portion of the guide member and the portion of the proximal end side to be housed in the cap body.

2. The protective cap as recited in claim 1, characterized in that:

the portion of the proximal end side of the first side portion is constituted to comprise a plate-like rising portion rising from a tip end side portion of the first side portion and a plate-like connection portion connecting the rising portion with the central portion, and the guide portion is constituted of an arc-like curved surface in a thickness direction of the rising portion and an arc-like elongated hole formed on the connection portion;

the portion of the proximal end side of the second side portion is constituted to comprise a plate-like rising portion rising from a tip end side portion of the second side portion and a plate-like connection portion connecting the rising portion with the central portion, and the guide portion is constituted of an arc-like curved surface in a thickness direction of the rising portion and an arc-like elongated hole formed on the connection portion; and the engagement portion of the shield plate is constituted to comprise an arc-like end surface at one side in a lateral direction of the shield plate engaging with one of a curved surface in a thickness direction of the rising portion of the first side portion, an arc-like end surface at another side in the lateral direction of the shield plate engaging with one of the curved surface in the thickness direction of the rising portion of the second side portion, one engagement piece engaging with the elongated hole of the connection portion of the first side portion, and another engagement piece engaging with the elongated hole of the connection portion of the second side portion.

3. A protective cap characterized by having:

a cap body formed in a bowl form;

a guide member comprising an arc-like guide portion, the guide member being so formed in the cap body and integrally with the cap body that a center of the guide portion corresponds with an axis extending in left and right directions at the rear of ears of the wearer of the cap body through a portion; and a shield plate formed in a plate form of a transparent material or a translucent material, the shield plate comprising an engagement portion for engaging with the arc-like guide portion, wherein the engagement portion engages with the guide portion so that the shield plate moves about a center of the guide portion between a housing position where the shield member is housed in the cap body and a shielding position where the shield member covers almost all of the face of the wearer.

4. The protective cap as recited in claim 3, characterized in that:

the guide member is constituted to comprise a central portion comprising a spherical curved surface to be formed in a plate form, a first side portion provided at one end side in a lateral direction of the central portion and integral with the central portion, a second side portion provided at another end side in the lateral direction of the central portion and integral with the central portion, the guide portion is formed at a portion of a proximal end side of the first side portion and at a portion of a proximal end side of the second side portion, the first side portion and the second side portion engage with the cap body, and the guide portion is provided integral with the cap body; and the shield plate is so constituted as to enter into a space formed among the cap body, the central portion of the guide member and the portion of the proximal end side to be housed in the cap body.

5. The protective cap as recited in claim 4, characterized in that:

the portion of the proximal end side of the first side portion is constituted to comprise a plate-like rising portion rising from a tip end side portion of the first side portion and a plate-like connection portion connecting the rising portion with the central portion;

the portion of the proximal end side of the second side portion is constituted to comprise a plate-like rising portion rising from a tip end side portion of the second side portion and a plate-like connection portion connecting the rising portion with the central portion; and the engagement portion of the shield plate is constituted to comprise one engagement piece engaging with the elongated hole of the connection portion of the first side portion, another engagement piece engaging with the elongated hole of the connection portion of the second side portion, and a projection for engaging with a central area of the central portion.

6. The protective cap as recited in claim 3, characterized in that:

the guide member is constituted to comprise a central portion comprising a spherical curved surface, and the guide portion is formed at the central portion.

7. The protective cap as recited in claim 6, characterized in that:

the guide member is constituted to comprise the central portion, a first side portion provided at one end side in a lateral direction of the central portion, and a second side portion provided at another end side in the lateral direction of the central portion;

a pair of central portion engaging portions formed in the vicinity of the respective side portions on the central portion engages with a pair of central portion to-be-engaged portion provided at sides of the cap body, a first side portion engaging portion provided at the first side portion engages with a first side portion to-be-engaged portion provided at a rear side of the cap body, a second side portion engaging portion provided at the second side portion engages with a second side portion to-be-engaged portion provided at a rear side of the cap body, and the guide member is provided integrally with the cap body; and the shield plate is so constituted as to enter into a space formed between the cap body and the central portion of the guide member to be housed in the cap body.

8. The protective cap as recited in claim 6, characterized in that:

a guide portion of the guide member is constituted of three oval through holes;

an engaging portion of the shield plate is constitute of three cylindrical portions; and the cylindrical portions respectively engage with the three through holes constituting the guide portion of the guide member to guide the shield plate to move between the housing position and the shielding position.

9. The protective cap as recited in claim 7, characterized in that:

a guide portion of the guide member is constituted of three oval through holes;

an engaging portion of the shield plate is constitute of three cylindrical portions; and the cylindrical portions respectively engage with the three through holes constituting the guide portion of the guide member to guide the shield plate to move between the housing position and the shielding position.

10. The protective cap as recited in claim 3, characterized in that:

the shield member is constituted to comprise a main body portion and a visor portion;

the main body portion is formed in a plate form curved spherically; and the visor portion is bent below the main body portion in a direction opposite to the main body portion to protrude.

11. The protective cap as recited in claim 10, characterized in that:

a concave portion dented toward an inner side of the main body portion with a predetermined width is formed at a central portion of the visor portion in a lateral direction.

* * * * *